US011371228B2

(12) United States Patent
Sun et al.

(10) Patent No.: US 11,371,228 B2
(45) Date of Patent: Jun. 28, 2022

(54) FLUSHING ASSEMBLY, WATER SUPPLY ASSEMBLY, LOWER POSITION WATER SUCTION ASSEMBLY, WATER TANK, CHECK VALVE FOR USE IN A TOILET, AND METHOD, DEVICE, AND STORAGE MEDIUM FOR CONTROLLING TOILET WATER CONSUMPTION

(71) Applicant: Shanghai Kohler Electronics, Ltd., Shanghai (CN)

(72) Inventors: Junfeng Sun, Shanghai (CN); Yunqing Zang, Shanghai (CN)

(73) Assignee: Kohler Co., Kohler, WI (US)

( * ) Notice: Subject to any disclaimer, the term of this patent is extended or adjusted under 35 U.S.C. 154(b) by 120 days.

(21) Appl. No.: 16/707,750

(22) Filed: Dec. 9, 2019

(65) Prior Publication Data

US 2020/0208387 A1 Jul. 2, 2020

(30) Foreign Application Priority Data

Dec. 28, 2018 (CN) ..... 201811620964.0
Dec. 28, 2018 (CN) ..... 201811624110.X
(Continued)

(51) Int. Cl.
*E03D 1/28* (2006.01)

(52) U.S. Cl.
CPC ..... *E03D 1/286* (2013.01); *E03D 1/283* (2013.01)

(58) Field of Classification Search
CPC ..... E03D 1/286; E03D 1/283
(Continued)

(56) References Cited

U.S. PATENT DOCUMENTS 9,816,259 B2 * 11/2017 Ahola ..... E03D 1/30
2005/0081284 A1 4/2005 Grob
(Continued)

FOREIGN PATENT DOCUMENTS

CN 1050069 A 3/1991
CN 101517171 B 1/2011
(Continued)

OTHER PUBLICATIONS

Chinese Office Action for Chinese Application No. CN201811624110.X dated Dec. 18, 2020.
(Continued)

*Primary Examiner* — Christine J Skubinna
(74) *Attorney, Agent, or Firm* — Lempia Summerfield Katz LLC

(57) ABSTRACT

The present disclosure provides a water supply assembly of a toilet comprising a water input pipe, a water tank, a water suction pump and a water output pipe; wherein the water input pipe is connected to the water tank; clean water enters the water tank through the water input pipe; the water tank is connected to the water suction pump connected to the water output pipe; the water suction pump pumps the clean water inside the water tank into the water output pipe; the water tank comprises a main water tank portion, an auxiliary water tank portion, and a water equalizing pipe connecting between and through the main water tank and the auxiliary water tank. The present disclosure provides a flushing assembly, a water suction assembly, and a check valve for use in the toilet. The present disclosure provides a method, device, and storage for controlling toilet water consumption.

7 Claims, 38 Drawing Sheets

(30) Foreign Application Priority Data

| | | |
|---|---|---|
| Dec. 28, 2018 | (CN) | 201822231206.1 |
| Dec. 28, 2018 | (CN) | 201822234378.4 |
| Dec. 28, 2018 | (CN) | 201822234749.9 |
| Dec. 28, 2018 | (CN) | 201822236081.1 |
| May 17, 2019 | (CN) | 201910412728.8 |

(58) Field of Classification Search
USPC ..... 4/329
See application file for complete search history.

(56) References Cited

U.S. PATENT DOCUMENTS

| | | | | |
|---|---|---|---|---|
| 2007/0113331 | A1 | 5/2007 | Prokopenko | |
| 2013/0291297 | A1* | 11/2013 | Kitamura | E03D 5/10 4/422 |
| 2021/0355667 | A1* | 11/2021 | Jensen | E03D 1/082 |

FOREIGN PATENT DOCUMENTS

| | | | |
|---|---|---|---|
| CN | 103122653 | B | 4/2015 |
| CN | 104563242 | A | 4/2015 |
| CN | 204590209 | U | 8/2015 |
| CN | 104264759 | B | 7/2016 |
| CN | 108005188 | A | 5/2018 |
| CN | 207660055 | U | 7/2018 |
| CN | 108625449 | A | 10/2018 |
| CN | 109518775 | A | 3/2019 |
| CN | 105735439 | B | 2/2020 |
| EP | 2392738 | A2 | 12/2011 |
| GB | 201628 | A | 8/1923 |
| JP | 2000234374 | A | 8/2000 |
| JP | 2002061262 | A | 2/2002 |
| JP | 2002201691 | A | 7/2002 |
| JP | 2003213775 | A | 7/2003 |

OTHER PUBLICATIONS

Chinese Office Action for Chinese Application No. CN201910412728.8 dated Dec. 11, 2020.
Chinese Office Action for Chinese Application No. 201811624110.X dated Aug. 17, 2020.
Chinese Office Action for Chinese Application No. 201811624110.X dated Feb. 3, 2020.
Chinese Office Action for Chinese Application No. 201910412728.8 dated Apr. 16, 2020.
European Office Action for European Patent Application No. 19219519.6-1002 / 3674491 dated Sep. 3, 2020.
European Office Action for European Patent Application No. 19219519.6-1002 dated May 27, 2020.

* cited by examiner

FLUSHING ASSEMBLY, WATER SUPPLY ASSEMBLY, LOWER POSITION WATER SUCTION ASSEMBLY, WATER TANK, CHECK VALVE FOR USE IN A TOILET, AND METHOD, DEVICE, AND STORAGE MEDIUM FOR CONTROLLING TOILET WATER CONSUMPTION

CROSS REFERENCE TO RELATED APPLICATION

This application claims the benefit of priority to: Chinese Patent Application No. 201822231206.1 filed in the Chinese Intellectual Property Office on Dec. 28, 2018, which is hereby incorporated by reference in its entirety; Chinese Patent Application No. 201811620964.0 filed in the Chinese Intellectual Property Office on Dec. 28, 2018, which is hereby incorporated by reference in its entirety; Chinese Patent Application No. 201822236081.1 filed in the Chinese Intellectual Property Office on Dec. 28, 2018, which is hereby incorporated by reference in its entirety; Chinese Patent Application No. 201811624110.X filed in the Chinese Intellectual Property Office on Dec. 28, 2018, which is hereby incorporated by reference in its entirety; Chinese Patent Application No. 201822234378.4 filed in the Chinese Intellectual Property Office on Dec. 28, 2018, which is hereby incorporated by reference in its entirety; Chinese Patent Application No. 201822234749.9 filed in the Chinese Intellectual Property Office on Dec. 28, 2018, which is hereby incorporated by reference in its entirety; Chinese Patent Application No. 201910412728.8, filed in the Chinese Intellectual Property Office on May 17, 2019, which is hereby incorporated by reference in its entirety.

FIELD

The present disclosure relates to the technical field of bathroom, in particular to a flushing assembly for toilet and a toilet.

The present disclosure relates to the bathroom technical filed, especially to a flushing water supply assembly and a toilet.

The present disclosure relates to the bathroom technical field, in particular to a flushing assembly for a toilet with a lower water tank and a toilet.

The present disclosure relates to the bathroom technology filed, in particular to a lower position water suction assembly and a water tank.

The present disclosure relates to the technical field of bathroom, in particular to a check valve.

The present disclosure is directed to a technical field relating to toilet products, in particular, a method, a device, and a storage medium for controlling toilet water consumption.

BACKGROUND

With respect to the orientation of a toilet, when a user faces towards the toilet, the side of the user's left hand is often called the left side of the toilet. According to ordinary construction custom, the corresponding water input port on the wall is also located at the left side of the toilet.

The angle valve hidden inside the main body of the toilet is also located at the left side of the toilet. But the angle valve should lead to the other side of the toilet (i.e. the right side) via a relative long water input pipe and then connect to a water input valve and a vacuum breaker in turn to make sure that clean water is conveyed into a water tank situated at the right side of the toilet. This is because the relative long water input pipe (extending from the left side to the right side of the toilet) is relatively more flexible in rigidity and thus the position of its connecting port (to the water input valve) is easier to be adjusted.

However, regarding this kind of internal arrangement, there are water passage elements located at both the left side and the right side of the toilet. So, the electrical assembly has to be interposed across the interspace among the water passage elements. Once any of the water passage elements leaks water, the electrical assembly is risky to be destroyed.

Therefore, there's a need of designing an internal structure of an intelligent toilet whose electrical assembly is separated from the water passage elements.

Some flushing water tanks of toilets, in order to solve the problem of insufficient flushing water volume, are arranged to increase the partial height of the water tank under the toilet bowl part within the toilet bottom internal borders so that the goal of enlarging the volume of the flushing water is achieved.

However, regarding the toilet which has very small bottom profile and the height of the bowl part is limited, even the toilet whose bottom is shrunken inward to some extent, its flushing water volume probably still cannot reach reasonable water supply volume under this circumstance. In addition, because of the insufficiency of the flushing water supply volume, the flushing speed of the toilet is not enough, which renders several problems including the faeces are unable to be flushed away timely and cleanly enough.

Therefore, there's a need of designing a flushing water supply assembly of a toilet under the condition of limited space under its bowl part and within its skirt part of the toilet. This flushing water supply assembly and this toilet should have large flushing water volume and be able to flush away faeces thoroughly.

For some intelligent toilets, their flushing water tank commonly situate at the position under the bowl part of the toilet. However, with respect to the bowl part with rectangle-shaped or other sharp turning inner surface, under the circumstance of low water flow from the main water input passage such as municipal tap water passage inside the house wall, the flushing water current is inadequate to circle alongside all sides of the inner surface because of its insufficient potential energy. Therefore, the flushing water is hard to wash out the whole inner surface of the bowl part during flushing.

Therefore, there's a need of designing a flushing structure which renders the toilet with the bowl part having rectangle-shaped or other sharp turning inner surface to be able to not only wash out the whole inner surface of the bowl part during flushing adequately and evenly but also discharge the faeces by siphon effect swiftly and powerfully, which saves water consumption.

Refering to FIG. 13 as an example, it can be seen that the water tank 6' includes a first water gate 61' (water may flow both inwardly and outwardly therethrough) and a second water gate 62' (water can only flow outwardly therethrough). The first water gate 61' situates above the second water gate 62'. The cut-off water level of the first water gate 61' is AL1, the cut-off water level of the second water gate 62' is AL2. When the water level in the water tank 6' reaches the cut-off water level AL1, the air inside the water tank 6' begins to enter into the drainage cavity C and the Venturi effect is just terminated, which causes the concurrent supply of water from the water tank 6' and tap water directly coming from outside to be unable to continue. However, because of the existence of the second water gate 62' connecting to water suction pump, the position of the first water gate 61' cannot be arranged at the same place.

Therefore, there's a need of designing an additional component (low water suction component) which makes sure that even if the water level in the water tank 6' is lower than the original cut-off water level AL1 of the first water gate 61', the water is still able to be obtained and conveyed into the drainage cavity C.

In order to prevent the water that has already entered into the internal water passages of a toilet and even the water that has already flushed into the bowl part of the toilet ("contaminated water") from flowing backwards, a check valve is necessary to be set in the water passages. In the meanwhile, for the sake of safety, the developer needs to pay attention to the failure caused by wire-shaped article mixed in the water flow in the water passage.

In some examples, iron wire could be used to imitate the wire-shaped article to be sandwiched between the sealing surfaces of the check valve to let the check valve fail to operate and then let the water inlet of the passage connect to the vacuum source which causes the water to flow backwards. Thus, whether there's any backflow water coming from downstream and going back to clean water source can be observed.

During the actual test, using the combination of a vacuum breaker and a check valve is an optional way for effectively prohibiting the contaminated water from flowing backwards in the test. In this way, the check valve is situated at a side close to the clean water source, the vacuum breaker is arranged at the downstream of the internal water passages of the toilet. When the vacuum source sucks the contaminated water, the diameter of the check valve that is invalidated by the iron wire needs to be as small as possible, then the air-intake requirement of the vacuum breaker could be lowered down. Namely, relatively little air-intake volume can meet the requirement of breaking the suction caused by the vacuum.

For some normal spring type check valves, after inserting the iron wire, the diameter of the check valves for flowing backwards is very large, which leads to very high technical requirement to the vacuum breaker.

As for some normal duckbill valves, after inserting the iron wire, the diameter of the valves for flowing backwards is very small that is very beneficial of lowering down the technical requirement to the vacuum breaker, but the diameter of the duckbill valves for flowing forwards is also decreased dramatically.

Therefore, there's a need to design a check valve whose diameter for flowing backwards is as small as possible and diameter for flowing forwards is as large as possible.

A method for controlling toilet water consumption requires to determine a flushing duration. In Chinese Application No. CN200780033872.6, the method comprises measuring a duration T starting from the commencement of flush water replenishment until the volume of the flush water in the tank reaches the height of a float (i.e. the duration for replenishing water after a previous toilet flush). Then, T is used to estimate the water supply pressure, based on which the duration for a next toilet flush is calculated.

A jet pump refers to a pump having a jet flush structure. FIG. 29 illustrates a toilet comprising a jet pump. The jet pump pressurizes a water stream into a water outlet 1' and expels the water stream from a jet mouth 2' to produce jet water under the influence of the Venturi effect. The jet water from the jet mouth 2' drives another water stream coming from a tank water outlet 3' to leave from a water outlet 4' with the jet water together. Both water streams then enter a bowl part or bowl rim.

The jet water stream coming from the jet mouth 2' is defined as a first water stream. The water stream coming from the tank water outlet 3' is defined as a second water stream. Thus, the toilet having the jet pump uses two water streams to perform the toilet flush. However, in these examples, the toilets in the only calculate the duration for water replenishment and fails to distinguish the different flow velocities of the two water streams. Accordingly, some toilets cannot precisely estimate and control the amount of water consumption.

SUMMARY

The objective of the present disclosure is to provide an internal structure of an intelligent toilet to ensure the electrical assembly is separated from the water passage elements.

In order to achieve to above-identified objective, the present disclosure provides a flushing assembly for a toilet, wherein the flushing assembly is arranged at the left or right side of the toilet, the electrical assembly of the toilet is arranged at the right or left side of the toilet.

In one example, the flushing assembly comprises a water tank situated under the bowl part of the toilet.

In one example, the water tank comprises a main water tank (e.g. a main water tank portion), an auxiliary water tank (e.g. an auxiliary water tank portion) and a water equalizing pipe connecting between and through the main water tank and the auxiliary water tank; the main water tank is provided at the left or right side of the toilet and the auxiliary water tank is provided at the right or left side of the toilet.

In one example, the flushing assembly further comprises a water suction pump; the water suction pump is connected to the main water tank and located at the bottom of the toilet.

In one example, the flushing assembly further comprises a vacuum breaker; the vacuum breaker is located at the top of the toilet; the valve element of the vacuum breaker moves horizontally.

In one example, the flushing assembly further comprises a jet hole pipe; the vacuum breaker is connected to the jet hole pipe; the water suction pump pumps the clean water in the water tank to the jet hole pipe through the vacuum breaker; the jet hole pipe conveys the clean water to the siphon jet hole located at the bottom of the bowl part of the toilet.

In one example, the flushing assembly further comprises a main water input pipe and a switching valve; the main water input pipe is connected to the vacuum breaker, the vacuum breaker is then connected to the switching valve; the output of the switching valve is connected to a jet flow water input pipe and a water tank input pipe.

In one example, the output of the switching valve is connected to the jet flow water input pipe and the water tank input pipe; when the switching valve is powered off, the switching valve switches to communicate with the jet flow water input pipe, the jet flow water input pipe is connected through the water tank and then conveys the tap water in the main water input pipe together with the clean water in the water tank to the upper rim of the bowl part of the toilet; when the switching valve is powered on, the switching valve switches to communicate with the water tank input pipe; the water tank input pipe is connected through the water tank and then conveys the tap water in the main water input pipe to the water tank.

In one example, the flushing assembly further comprises a jet flow water output pipe; the jet flow water output pipe conveys the tap water and the stored clean water in the water tank together to the upper rim of the bowl part of the toilet; the jet flow water output pipe and the water tank input pipe are all connected to the water tank via a jet flow element; the jet flow element comprises a jet flow water input connector, a water tank input connector, a water tank connector, a jet flow water output connector and a jet flow pipe; the jet flow water input connector is connected to the jet flow water input pipe; the water tank input connector is connected to the water tank input pipe; the water tank connector is connected through the water tank; the jet flow water output connector is connected to the jet flow water output pipe and connected through the water tank connector as well as the jet flow water input connector; the jet flow pipe is located inside the jet flow water output connector; the jet flow water input connector is located beneath the water tank input connector; the bottom of the jet flow pipe is connected through the jet flow water input connector.

In order to achieve to above-identified objective, the present disclosure also provides a toilet comprising a bowl part for receiving faeces, wherein the toilet further comprises a flushing assembly according to any of solutions summarized above and an electrical assembly; the flushing assembly is arranged at the left side of the toilet, the electrical assembly is arranged at the right side of the toilet, or vice versa.

After adopting the above-mentioned technical solutions, these following beneficial technical effects can be achieved accordingly:

By arranging the flushing assembly of a toilet all to the left side of the toilet and arranging the electrical assembly of the toilet all to the right side of the toilet (or vice versa), the electrical assembly is therefore fully separated from the water passage elements. This decreases the risk of destroying the electrical assembly by leakage and prolongs the lifetime of the intelligent toilet.

The present disclosure discloses a flushing assembly for a toilet. The flushing assembly is arranged at the left side of the toilet. The present disclosure also discloses a toilet comprising a bowl part for bearing faeces and a water flushing assembly as well as an electrical assembly. The electrical assembly is located at the right side of the toilet. The present disclosure, by arranging the flushing assembly to the left side of the toilet and arranging the electrical assembly to the right side of the toilet, makes the part of water passages and the part of electrical circuits separate each other, which decreases the risk of damage to the electrical assembly and prolongs the lifetime of the toilet.

The objective of the present disclosure is to overcome the defect(s) in some technologies and provide a flushing water supply assembly and a toilet on the premise of limited space under its bowl part and within its skirt part of the toilet.

In order to achieve the objective summarized above, the present disclosure provides a water supply assembly of a toilet comprising a water input pipe, a water tank, a water suction pump and a water output pipe; wherein the water input pipe is connected to the water tank, clean water enters the water tank through the water input pipe; the water tank is connected to the water suction pump which is connected to the water output pipe; the water suction pump pumps the clean water inside the water tank into the water output pipe; the water tank comprises a main water tank (e.g. a main water tank portion), an auxiliary water tank (e.g. an auxiliary water tank portion) and a water equalizing pipe connecting between and through the main water tank and the auxiliary water tank; the main water tank is provided with a water inlet and a water outlet thereon, the water input pipe is mounted at the water inlet, the water suction pump is mounted at the water outlet.

In one example, the water tank further comprises an air equalizing pipe connecting through the upper parts of the main water tank and the auxiliary water tank respectively; the water equalizing pipe connects through the lower parts of the main water tank and the auxiliary water tank respectively; the diameter of the air equalizing pipe is smaller than the one of the water equalizing pipe.

In one example, the top of the auxiliary water tank is provided with a first air inlet. In one example, the top of the main water tank is provided with a second air inlet whose diameter is smaller than 5 mm. In one example, the top of the main water tank is provided with a second air inlet; when the main water tank supplies water, the second air inlet is blocked. In one example, the second air inlet is provided with an automatic blocking element comprising a tapered blocking pipe and a blocking bead put inside the blocking pipe; when the main water tank supplies water, the blocking bead is sucked towards the blocking pipe by vacuum and blocks the blocking pipe; when the main water tank stops supplying water, the vacuum disappears, thus the blocking bead is separated from the blocking pipe and the blocking is resolved. In one example, the main water tank and the auxiliary water tank is designed whose upper parts are relatively bigger and lower parts are relatively smaller in section.

In order to achieve the objective summarized above, the present disclosure also provides a toilet comprising an external housing, a bowl part and a faeces discharging pipe; wherein the bowl part is used for receiving faeces; installation space is set aside under the bowl part and between the two sides of the external housing; the faeces discharging pipe is located at the installation space and connects to the bottom of the bowl part; the toilet further comprises the water supply assembly of a toilet according to any of solutions summarized above; the main water tank and the auxiliary water tank are arranged under the bowl part.

In one example, the main water tank and the auxiliary water tank are arranged at the left and right sides of the faeces discharging pipe respectively. In one example, the shapes of the external sides of the main water tank and the auxiliary water tank can match the ones of the internal sides of the external housing.

After adopting the above-mentioned technical solutions, these following beneficial technical effects can be achieved accordingly:

By setting a main water tank (e.g. a main water tank portion) and an auxiliary water tank (e.g. an auxiliary water tank portion) in the toilet, the present disclosure increases the total water supply volume of the water tank. In addition, with the aid of the water equalizing pipe for connecting the main water tank and the auxiliary water tank, the clean water in the auxiliary water tank can enter into the main water tank, and then the water can be pumped into the water output pipe by a water suction pump.

Moreover, by setting the main water tank and the auxiliary water tank under the bowl part and within the skirt part of the toilet conjointly, the limited space under the bowl part can be utilized fully. Thus, the total water supply volume is enhanced.

The present disclosure discloses a toilet water supply assembly includes a water input pipe, a water tank, a water suction pump and a water output pipe. The water input pipe is connected to the water tank, clean water enters into the water tank through the water input pipe. The water tank is connected to the water suction pump which is connected to the water output pipe. The clean water inside the water tank is pumped into the water output pipe by the water suction pump. The water tank comprises a main water tank (e.g. a main water tank portion), an auxiliary water tank (e.g. an auxiliary water tank portion) and a water equalizing pipe connecting between and through the main water tank and the auxiliary water tank. The main water tank is arranged with a water inlet at where the water input pipe is mounted and a water outlet at where the water suction pump is mounted. The present disclosure also discloses a toilet. By setting the main water tank, the auxiliary water tank and the water equalizing pipe preferably at the position below a bowl part, the present disclosure is able to enhance the volume of the water tank as far as possible on the premise that the outer scale of the toilet is not increased. In addition, through the configuration of air inlets, the speed of water flow coming from the two water tanks to the extracting side of the water suction pump can be enhanced, which makes the water supply effect of the water suction pump be close to the solution of integral water tank.

The objective of the present disclosure is to provide a flushing structure which can render the toilet with bowl part having rectangle-shaped or other sharp turning inner surface be able to not only wash out the whole inner surface of the bowl part during one flushing adequately and evenly but also discharge the faeces by siphon effect swiftly and powerfully.

In order to achieve the above-identified objective, the present disclosure provides a flushing assembly for a toilet with a lower water tank, comprising a first flushing water passage and a second flushing water passage; wherein the first flushing water passage conveys tap water and clean water in a water tank to the upper rim of the bowl part of the toilet, the second flushing water passage conveys the clean water in the water tank to the bottom of the bowl part.

In one example, the first flushing water passage comprises a main water input pipe, a vacuum breaker, a switching valve, a jet flow water input pipe and a lower water tank; the main water input pipe is connected to the vacuum breaker, the vacuum breaker is connected to the switching valve; when the switching valve is powered off, the switching valve communicates with the jet flow water input pipe; the jet flow water input pipe is connected through the lower water tank, and conveys the tap water in the main water input pipe together with the clean water in the lower water tank to the upper rim of the bowl part of the toilet.

In one example, the second flushing water passage extends in sequence through the lower water tank, the water suction pump, the vacuum breaker and the jet hole pipe; a water tank input pipe connects through the lower water tank, the lower water tank is connected to the water suction pump, the water suction pump is connected to the vacuum breaker, the vacuum breaker is connected to the jet hole pipe; the water suction pump pumps the clean water in the water tank to the jet hole pipe through the vacuum breaker; the jet hole pipe conveys the clean water to at least one siphon jet hole located at the bottom of the bowl part of the toilet.

In one example, the flushing assembly further comprises a water tank input passage for filling the tap water into the water tank; when the switching valve is powered on, the switching valve switches to communicate with the water tank input pipe; the water tank input passage extends in sequence through the main water input pipe, the vacuum breaker, the switching valve, the water tank input pipe and the water tank.

In one example, the flushing assembly further comprises a jet flow element and a jet flow water output pipe; the jet flow water output pipe conveys the tap water and the clean water in the water tank together to the upper rim of the bowl part of the toilet;

the jet flow element comprises a jet flow water input connector, a water tank input connector, a water tank connector, a jet flow water output connector and a jet flow pipe; the jet flow water input connector is connected to the jet flow water input pipe; the water tank input connector is connected to the water tank input pipe; the water tank connector is connected through the water tank; the jet flow water output connector is connected to the jet flow water output pipe and connected through the water tank connector as well as the jet flow water input connector; the jet flow pipe is located inside the jet flow water output connector; the jet flow water input connector is located beneath the water tank input connector; the bottom of the jet flow pipe is connected through the jet flow water input connector.

In one example, the flushing assembly further comprises a pump water input pipe and a pump water output pipe; one end of the pump water input pipe is connected through the water tank, another end of the pump water input pipe is connected through the water suction pump; one end of the pump water output pipe is connected through the water suction pump, another end of the pump water output pipe is connected through the vacuum breaker which is connected through the jet hole pipe.

In order to achieve the above-identified objective, the present disclosure also provides a toilet, comprising the flushing assembly for a toilet with a lower water tank according to any of solutions summarized above, the lower water tank is arranged below the bowl part.

In one example, the upper rim of the bowl part is provided with an annular water circle distributed with a plurality of small holes facing down; the small holes convey the clean water onto the upper surface of the bowl part. In one example, the bottom of the bowl part is provided with two siphon jet holes facing the entrance of the faeces discharging pipe of the toilet. After adopting the above-mentioned technical solutions, these following beneficial technical effects can be achieved accordingly: By conveying tap water and the clean water inside the water tank conjointly into the upper rim of the bowl part of a toilet, the whole inner surface of the bowl part is made to be filled with water successfully, even for the bowl part having rectangle-shaped or other sharp turning inner surface.

In the meanwhile, by conveying the clean water inside the water tank into the siphon jet hole located at the bottom of the bowl part, the siphon effect is motivated. The faeces in the bowl part is discharged by the siphon effect swiftly and powerfully, resulting in the water saving.

The present disclosure discloses a flushing assembly of toilet with a lower water tank. The flushing assembly of toilet comprises a first flushing water passage and a second flushing water passage. The first flushing water passage conveys tap water and clean water in the lower water tank to the upper rim of a bowl part of the toilet. The second flushing water passage conveys the clean water in the lower water tank to the bottom part of the bowl part of the toilet. The present disclosure also discloses a toilet. By conveying the tap water and the clean water inside the lower water tank conjointly to the upper rim of the bowl part of the toilet, the present solution makes the water be full of the bowl part. In the meanwhile, by conveying the clean water in the lower water tank to a siphon jet hole of the bottom of the bowl part that motivates the siphon effect, the present solution makes the toilet discharge the faeces in the bowl part swiftly and powerfully, the water saving effect is significant.

The objective of the present disclosure is to provide an additional component ("low water suction component") which makes sure that even if the water level in the water tank goes lower than the original cut-off water level of the first water gate, the water is still able to be obtained and conveyed into the drainage cavity via Venturi effect.

In order to achieved the above-identified objective, the present disclosure provides a lower position water suction assembly comprising a lower position water suction pipe and a jet flow element; wherein the lower position water suction pipe comprises a pipe body, a water suction pipe port together with a water input pipe port arranged at the two ends of the pipe body respectively; the water suction pipe port is provided with a plurality of projections distributed alternately; the adjacent projections form water suction ports therebetween; the projections are used for contacting with the inner bottom surface of a water tank; the water input pipe port is used for connecting to the first water gate of the water tank; the lower position water suction pipe conveys the water in the bottom of the water tank into the jet flow element; the jet flow element is used for conveying the clean water in the water tank and the outside tap water together into the upper rim of the bowl part of a toilet.

In one example, the pipe body comprises a sideling pipe and a straight pipe; one end of the sideling pipe is the water suction pipe port, another end of the sideling pipe is connected to one end of the straight pipe, another end of the straight pipe is the water input pipe port.

In one example, the water suction pipe port is arranged along a horizontal plane, the water input pipe port is arranged along a vertical plane.

In one example, the jet flow element comprises a jet flow water input connector, a water tank input connector, a water tank connector, a jet flow water output connector and a jet flow pipe; the jet flow water input connector is connected to the jet flow water input pipe; the water tank input connector is connected to the water tank input pipe; the water tank connector is connected through the water tank; the jet flow water output connector is connected to the jet flow water output pipe and connected through the water tank connector as well as the jet flow water input connector; the jet flow pipe is located inside the jet flow water output connector; the jet flow water input connector is located beneath the water tank input connector; the bottom of the jet flow pipe is connected through the jet flow water input connector.

In order to achieved the above-identified objective, the present disclosure also provides a toilet comprising a bowl part and a water tank situated under the bowl part; wherein the water tank includes a first water gate that water is able to flow both inwardly and outwardly therethrough and a second water gate that water is only able to flow outwardly therethrough; the first water gate situates above the second water gate; the toilet further comprises the lower position water suction assembly according to any of the summarized above solutions.

In one example, the toilet further comprises a first flushing water passage comprising a main water input pipe, a vacuum breaker, a switching valve, a jet flow water input pipe, a jet flow water output pipe and a jet flow element; the main water input pipe is connected to the vacuum breaker, the vacuum breaker is connected to the switching valve; when the switching valve is powered off, the switching valve communicates with the jet flow water input pipe; the jet flow water input pipe is connected through the lower water tank by the jet flow element, and conveys the tap water in the main water input pipe together with the clean water in the water tank to the upper rim of the bowl part of the toilet by the jet flow water output pipe.

In one example, the jet flow element comprises a jet flow water input connector, a water tank input connector, a water tank connector, a jet flow water output connector and a jet flow pipe; the jet flow water input connector is connected to the j et flow water input pipe; the water tank input connector is connected to the water tank input pipe; the water tank connector is connected through the water tank; the jet flow water output connector is connected to the jet flow water output pipe and connected through the water tank connector as well as the jet flow water input connector; the jet flow pipe is located inside the jet flow water output connector; the jet flow water input connector is located beneath the water tank input connector; the bottom of the jet flow pipe is connected through the jet flow water input connector.

In one example, the toilet further comprises a water tank input passage for filling the tap water into the water tank; when the switching valve is powered on, the switching valve switches to communicate with the water tank input pipe; the water tank input passage extends in sequence through the main water input pipe, the vacuum breaker, the switching valve, the water tank input pipe and the water tank.

In one example, the toilet further comprises a second flushing water passage for conveying the clean water in the water tank to the bottom of the bowl part, the second flushing water passage extends in sequence through the water tank, a water suction pump, the vacuum breaker and a jet hole pipe; the second water gate of the water tank is connected to the water suction pump, the water suction pump is connected to the vacuum breaker, the vacuum breaker is connected to the jet hole pipe; the water suction pump pumps the clean water in the water tank to the jet hole pipe through the vacuum breaker; the jet hole pipe conveys the clean water to at least one siphon jet hole located at the bottom of the bowl part of the toilet.

In one example, the bottom of the bowl part is provided with two siphon jet holes facing the entrance of the faeces discharging pipe of the toilet.

After adopting the above-mentioned technical solutions, these following beneficial technical effects can be achieved accordingly: The lower position water suction assembly as provided in the present disclosure is composed of a lower position water suction pipe and a jet flow element. By setting the lower position water suction pipe, the water in the bottom of the water tank (even lower than the original cut-off water level of the first water gate) can also be obtained and conveyed into the jet flow element via Venturi effect. Thus, the clean water in the water tank together with the tap water from outside is all conveyed into the upper rim of the bowl part of a toilet through the jet flow element, which enhances the utilization of the water volume in the water tank. Under the circumstance of unchanging the volume of the water tank, the flushing water volume coming out of the upper rim of the bowl part is promoted, then the toilet performance is promoted accordingly.

The present disclosure discloses a lower position water suction assembly comprising a lower position water suction pipe and a jet flow element. The lower position water suction pipe comprises a pipe body as well as a water suction pipe port and a water input pipe port arranged at the ends of the pipe body. The water suction pipe port is provided with a plurality of projections distributed alternately. The adjacent projections form water suction port therebetween. The projections are used for contacting with the inner bottom surface of a water tank. The water input pipe port is used for connecting to a water input gate of the water tank. The lower position water suction pipe conveys the water in the bottom of the water tank to the jet flow element. The jet flow element is used for conveying the clean water in the water tank and the external tap water together to the upper rim of a bowl part of a toilet. The lower position water suction pipe conveys the water in the bottom of the water tank to the jet flow element, and the jet flow element conveys the clean water in the water tank and the external tap water together to the upper rim of the bowl part of the toilet. This increases the use ratio of the water volume in the water tank. It can enhance the flushing water volume under the condition of keeping the volume of the water tank unchanged, which then causes the performance of the toilet upgrade.

The objective of the present disclosure is to provide a check valve whose diameter for flowing backwards by contaminated water is reached as small as possible and whose diameter for flowing forwards by clean water is reached as large as possible.

In order to achieve to above-identified objective, the present disclosure provides a check valve, comprising an upper sealing element, a lower sealing element, and a supporting element; the upper sealing element comprises a flexible part which seals the lower sealing element; the supporting element is provided with a plurality of hollow parts; the supporting element is mounted in the lower sealing element and located at the forward water inflowing side; when water flows forwardly, the clean water flows through the hollow parts, and deforms and thrusts aside the flexible part; when water flows backwardly, the contaminated water presses the flexible part towards the lower sealing element, the supporting element is used for supporting the flexible part and preventing the flexible part from transformation.

In one example, the flexible part is circular rubber sheet. In one example, the upper sealing element further comprises a connecting pin, the connecting pin inserts into a pin hole of the supporting element. In one example, the lower sealing element is an annular object; the lower sealing element comprises a blocking ring; the upper sealing element seals with the outer surface of the blocking ring; the supporting element is mounted on the inner surface of the blocking ring. In one example, the supporting element is circular; the supporting element further comprises a plurality of rib strips distributed radially; hollow parts are formed between the adjacent rib strips. In one example, the check valve is mounted downstream a vacuum breaker of a toilet. In one example, the check valve is mounted at a place between a main water input pipe of the toilet and a main filter screen.

After adopting the above-mentioned technical solutions, these following beneficial technical effects can be achieved accordingly: When the clean water flows forwardly through the check valve as provided in the present disclosure, the clean water can transform and thrust aside the flexible part when flowing through the hollow parts of the supporting element, which makes the flexible part separate from the lower sealing element, then the diameter for flowing forwards by the clean water is enlarged.

On the other hand, when the contaminated water flows backwardly towards the check valve as provided, the contaminated water presses the flexible part towards the lower sealing element and the supporting element is used for supporting the flexible part and preventing the flexible part from transformation, which makes the flexible part compress to and seal the lower sealing element, then the diameter for flowing backwards by the contaminated water is diminished.

The present disclosure discloses a check valve comprising an upper sealing element, a lower sealing element and a supporting element. The upper sealing element comprises a flexible part that seals the lower sealing element. The supporting element is provided with a plurality of hollow part. The supporting element is mounted in the lower sealing element and located at a forward water inflow side of the flexible part. When the water flows forward, the water transforms and bursts through the flexible part through the hollow part; when the water flows backward, the water pushes the flexible part towards the lower sealing element. The supporting element is used for supporting the flexible part to avoid its transformation. In the present disclosure, when the water flows forward, the clean water transforms and bursts through the flexible part via the hollow part; when the water flows backward, the waste water pushes the flexible part towards the lower sealing element. The supporting element is used for supporting the flexible part to avoid transformation. Thus, the flexible part is compressed and sealed with the lower sealing element so that the backward flow radius is reduced.

As discussed above, some toilets having a jet pump cannot precisely estimate the amount of water consumption. Thus, the toilets cannot precisely control the amount of water consumption. In order to overcome these technical problems, it is necessary to provide a method, a device, and a storage medium for controlling the toilet water consumption.

The present disclosure provides a method for controlling toilet water consumption, the method comprising steps of: supplying a first water stream by a jet pump in response to a request for a toilet flush; driving a second water stream coming from a tank by the first water stream to generate a flow velocity of the second water stream and using the flow velocity of the second water stream as a tank flow velocity; obtaining and using a flow velocity of the first water stream as a jet flow velocity; calculating a target water supply duration regarding a target amount of water supply as requested according to the tank flow velocity and the jet flow velocity; and controlling the jet pump to supply the water according to the target water supply duration.

In one embodiment, the step of driving the second water stream coming from the tank by the first water stream to generate the flow velocity of the second water stream and using the flow velocity of the second water stream as the tank flow velocity comprises: obtaining a first time difference between a first time when an upper float is triggered by the water and a second time when a lower float is triggered by the water in turn; and calculating the tank flow velocity by using a volume between the upper float and the lower float and the first time difference.

In one embodiment, the step of driving the second water stream coming from the tank by the first water stream to generate the flow velocity of the second water stream and using the flow velocity of the second water stream as the tank flow velocity comprises: obtaining the first time difference between the first time when the upper float is triggered by the water and the second time when the lower float is triggered by the water in turn; using the volume between the upper float and the lower float minus an amount of water withdrawn by a water suction pump as a flow-velocity-calculation volume when the water suction pump withdraws the water during the first time difference, or using the volume between the upper float and the lower float as the flow-velocity-calculation volume when the water suction pump does not withdraw the water during the first time difference; and calculating the tank flow velocity according to the flow-velocity-calculation volume and the first time difference.

In one embodiment, the step of obtaining and using the flow velocity of the first water stream as the jet flow velocity comprises: obtaining a functional equation indicating a relationship between the tank flow velocity and the jet flow velocity; and obtaining the jet flow velocity by substituting the tank flow velocity into the functional equation.

In one embodiment, the step of obtaining and using the flow velocity of the first water stream as the jet flow velocity comprises: after completing a previous toilet flush and switching from a jet pump water supply to a tank water replenishment, obtaining a second time difference between a third time when a lower float is triggered by the water and a fourth time when an upper float is triggered by the water in turn, wherein the jet pump has a same water source as the tank does; and calculating a jet flow velocity according to a volume between the upper float and the lower float and the second time difference.

In one embodiment, the step of obtaining and using the flow velocity of the first water stream as the jet flow velocity comprises: obtaining a functional equation indicating a relationship between the tank flow velocity and the jet flow velocity, using the flow velocity of the second water stream in a previous toilet flush as the tank flow velocity in the previous toilet flush, and substituting the tank flow velocity in the previous toilet flush into the functional equation to obtain the jet flow velocity.

In one embodiment, the step of obtaining and using the flow velocity of the first water stream as the jet flow velocity comprises: obtaining a functional equation indicating a relationship between the tank flow velocity and the jet flow velocity, using the flow velocity of the second water stream in a previous toilet flush as the tank flow velocity in the previous toilet flush, and substituting the tank flow velocity in the previous toilet flush into the functional equation to obtain a first reference value of the jet flow velocity;

After completing a previous toilet flush and switching from a jet pump water supply to a tank water replenishment, obtaining a second time difference between a third time when a lower float is triggered by the water and a fourth time when an upper float is triggered by the water in turn, and calculating a second reference value of the jet flow velocity according to a volume between the upper float and the lower float and the second time difference, wherein the jet pump has a same water source as the tank does; and calculating the jet flow velocity according to the first reference value of the jet flow velocity and/or the second reference value of the jet flow velocity.

In one embodiment, the step of calculating the target water supply duration regarding the target amount of the water supply as requested according to the tank flow velocity and the jet flow velocity comprises: measuring a performed water supply duration and calculating an amount of supplied water according to the jet flow velocity, the tank flow velocity, and the performed water supply duration; calculating a continued water supply duration according to the amount of the supplied water and the target amount of the water supply as requested; and calculating the target water supply duration according to the performed water supply duration and the continued water supply duration.

In one embodiment, the step of calculating the step of calculating the target water supply duration regarding the target amount of the water supply as requested according to the tank flow velocity and the jet flow velocity comprises: using the flow velocity of the first water stream as the jet flow velocity in the previous toilet flush, using the flow velocity of the second water stream as the tank flow velocity in the previous toilet flush, and calculating a first water supply duration of a first water consumption as predetermined according to the jet flow velocity in the previous toilet flush and the tank flow velocity in the previous toilet flush; calculating a second water supply duration according to a second water consumption as requested, the jet flow velocity, and the tank flow velocity, wherein the target amount of the water supply as requested comprises the first water consumption and the second water consumption; and calculating the target water supply duration according to the first water supply duration and the second water supply duration.

The present disclosure provides a device for controlling toilet water consumption, the device comprising: at least one processor; and a memory communicably coupled to the at least one processor, wherein the memory stores instructions executable by the at least one processor to perform steps of: supplying a first water stream by a jet pump in response to a request for a toilet flush; driving a second water stream coming from a tank by the first water stream to generate a flow velocity of the second water stream and using the flow velocity of the second water stream as a tank flow velocity; obtaining and using a flow velocity of the first water stream as a jet flow velocity; calculating a target water supply duration regarding a target amount of water supply as requested according to the tank flow velocity and the jet flow velocity; and controlling the jet pump to supply the water according to the target water supply duration.

In one embodiment, the step of driving the second water stream coming from the tank by the first water stream to generate the flow velocity of the second water stream and using the flow velocity of the second water stream as the tank flow velocity comprises: obtaining a first time difference between a first time when an upper float is triggered by the water and a second time when a lower float is triggered by the water in turn; and calculating the tank flow velocity by using a volume between the upper float and the lower float and the first time difference.

In one embodiment, wherein the step of driving the second water stream coming from the tank by the first water stream to generate the flow velocity of the second water stream and using the flow velocity of the second water stream as the tank flow velocity comprises: obtaining the first time difference between the first time when the upper float is triggered by the water and the second time when the lower float is triggered by the water in turn; using the volume between the upper float and the lower float minus an amount of water withdrawn by a water suction pump as a flow-velocity-calculation volume when the water suction pump withdraws the water during the first time difference, or using the volume between the upper float and the lower float as the flow-velocity-calculation volume when the water suction pump does not withdraw the water during the first time difference; and calculating the tank flow velocity according to the flow-velocity-calculation volume and the first time difference.

In one embodiment, the step of obtaining and using the flow velocity of the first water stream as the jet flow velocity comprises: obtaining a functional equation indicating a relationship between the tank flow velocity and the jet flow velocity; and obtaining the jet flow velocity by substituting the tank flow velocity into the functional equation.

In one embodiment, the step of obtaining and using the flow velocity of the first water stream as the jet flow velocity comprises: after completing a previous toilet flush and switching from a jet pump water supply to a tank water replenishment, obtaining a second time difference between a third time when a lower float is triggered by the water and a fourth time when an upper float is triggered by the water in turn, wherein the jet pump has a same water source as the tank does; and calculating a jet flow velocity according to a volume between the upper float and the lower float and the second time difference.

In one embodiment, the step of obtaining and using the flow velocity of the first water stream as the jet flow velocity comprises: obtaining a functional equation indicating a relationship between the tank flow velocity and the jet flow velocity, using the flow velocity of the second water stream in a previous toilet flush as the tank flow velocity in the previous toilet flush, and substituting the tank flow velocity in the previous toilet flush into the functional equation to obtain the jet flow velocity.

In one embodiment, the step of obtaining and using the flow velocity of the first water stream as the jet flow velocity comprises: obtaining a functional equation indicating a relationship between the tank flow velocity and the jet flow velocity, using the flow velocity of the second water stream in a previous toilet flush as the tank flow velocity in the previous toilet flush, and substituting the tank flow velocity in the previous toilet flush into the functional equation to obtain a first reference value of the jet flow velocity; after completing a previous toilet flush and switching from a jet pump water supply to a tank water replenishment, obtaining a second time difference between a third time when a lower float is triggered by the water and a fourth time when an upper float is triggered by the water in turn, and calculating a second reference value of the jet flow velocity according to a volume between the upper float and the lower float and the second time difference, wherein the jet pump has a same water source as the tank does; and calculating the jet flow velocity according to the first reference value of the jet flow velocity and/or the second reference value of the jet flow velocity.

In one embodiment, the step of calculating the target water supply duration regarding the target amount of the water supply as requested according to the tank flow velocity and the jet flow velocity comprises: measuring a performed water supply duration and calculating an amount of supplied water according to the jet flow velocity, the tank flow velocity, and the performed water supply duration; calculating a continued water supply duration according to the amount of the supplied water and the target amount of the water supply as requested; and calculating the target water supply duration according to the performed water supply duration and the continued water supply duration.

In one embodiment, the step of calculating the target water supply duration regarding the target amount of the water supply as requested according to the tank flow velocity and the jet flow velocity comprises: using the flow velocity of the first water stream as the jet flow velocity in the previous toilet flush, using the flow velocity of the second water stream as the tank flow velocity in the previous toilet flush, and calculating a first water supply duration of a first water consumption as predetermined according to the jet flow velocity in the previous toilet flush and the tank flow velocity in the previous toilet flush; calculating a second water supply duration according to a second water consumption as requested, the jet flow velocity, and the tank flow velocity, wherein the target amount of the water supply as requested comprises the first water consumption and the second water consumption; andalculating the target water supply duration according to the first water supply duration and the second water supply duration.

The present disclosure provides a storage media, storing instructions executable by a computer to perform the steps of any of the methods for controlling toilet water consumption.

The present disclosure obtains the flow velocities of the two water streams in a jet flush toilet. Thus, the toilet water consumption may be precisely controlled to avoid the fluctuation of toilet flush function.

A method, a device, and a storage medium are provided for use in controlling the toilet water consumption. The method comprises: supplying a first water stream by a jet pump in response to a request for a toilet flush; driving a second water stream coming from a tank by the first water stream to generate a flow velocity of the second water stream and using the flow velocity of the second water stream as a tank flow velocity; obtaining and using a flow velocity of the first water stream as a jet flow velocity; calculating a target water supply duration regarding a target amount of water supply as requested according to the tank flow velocity and the jet flow velocity; and controlling the jet pump to supply the water according to the target water supply duration. The present disclosure obtains the flow velocities of the two water streams in a jet flush toilet. Thus, the toilet water consumption may be precisely controlled to avoid the fluctuation of toilet flush function.

DETAILED DESCRIPTION

Flushing Assembly for Toilet and Toilet

Figure 4:
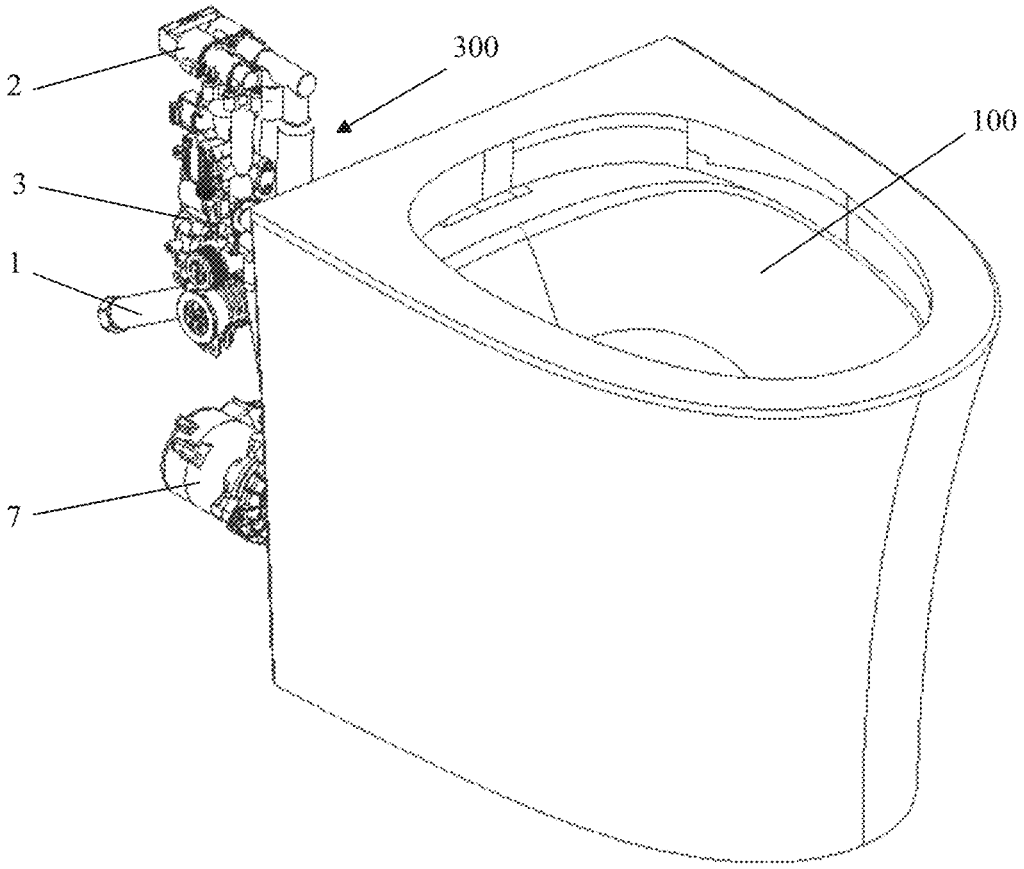
FIG. 4 is a structural diagram of a flushing assembly and a bowl part in one embodiment of the present disclosure.

In one embodiment of the present disclosure, please refer to FIG. 4, the toilet comprises a bowl part 100 for receiving faeces, a flushing assembly 300 and an electrical assembly. The flushing assembly 300 can be arranged at the left side of the toilet, the electrical assembly can be arranged at the right side of the toilet, or vice versa.

Figure 9:
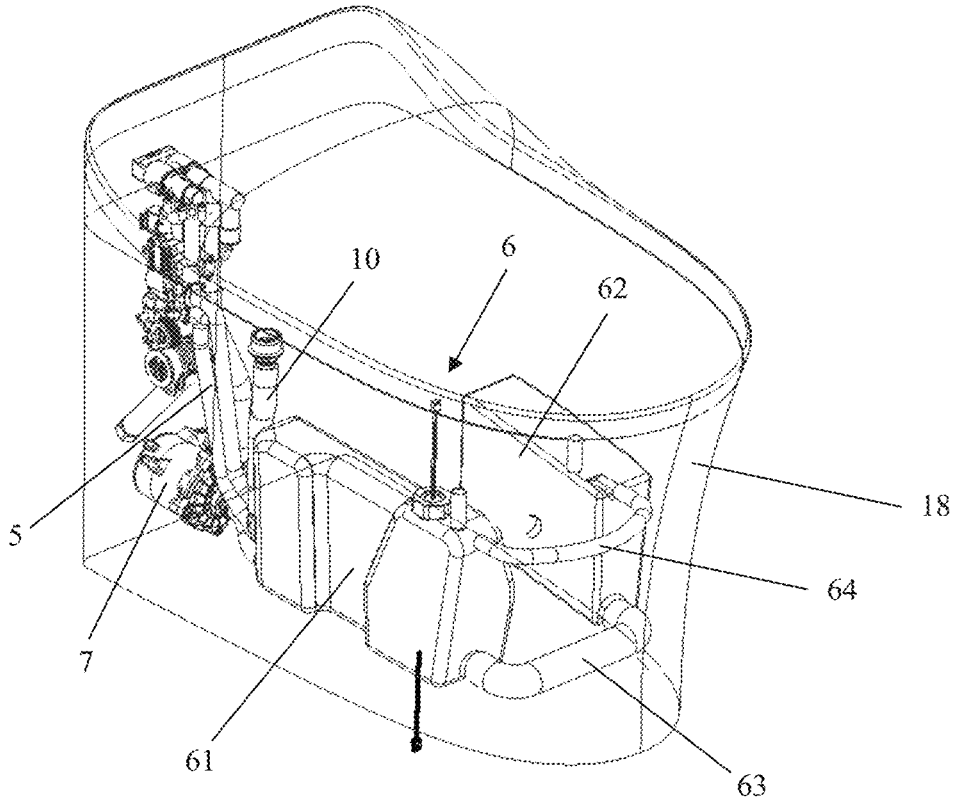
FIG. 9 is a structural diagram of a water tank inside a toilet in one embodiment of the present disclosure.
Figure 10:
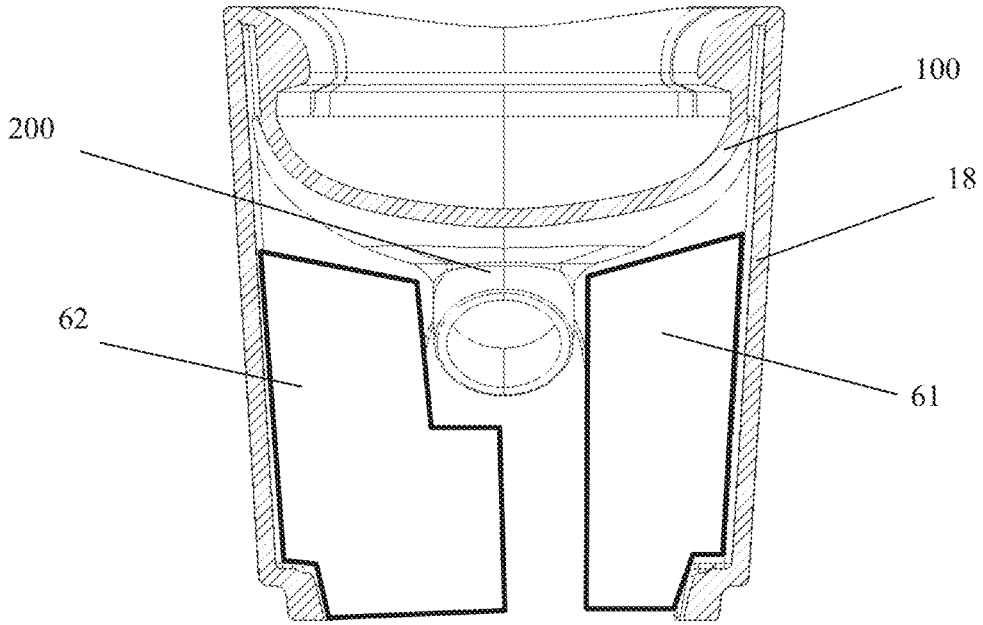
FIG. 10 is a sectional view of a water tank inside a toilet in one embodiment of the present disclosure.

Further, please refer to FIG. 9 and FIG. 10. FIG. 9 is a structural diagram of a water tank inside a toilet in one embodiment of the present disclosure. FIG. 10 is a sectional view of a water tank inside a toilet in one embodiment of the present disclosure. The flushing assembly 300 comprises a water tank 6 situated under the bowl part 100 of the toilet.

Furthermore, the water tank 6 comprises a main water tank (e.g. a main water tank portion) 61, an auxiliary water tank (e.g. an auxiliary water tank portion) 62 and a water equalizing pipe 63 connecting through therebetween. The main water tank 61 can be provided at the left side of the toilet, the auxiliary water tank 62 can be provided at the right side of the toilet, or vice versa.

The main water tank 61 is provided with a water inlet and a water outlet thereon, a water tank input pipe 5 is mounted at the water inlet, a water suction pump 7 is mounted at the water outlet.

The water input pipe 5 is connected to an external water source which makes the clean water enter and store inside the water tank 6. When the water in the water tank 6 is needed, the water suction pump 7 operates and pumps the clean water in the main water tank 61 into the pump water output pipe 12 and then to the bowl part 100 (please refer to FIG. 1), the faeces in the bowl part 100 is flushed into a faeces discharging pipe 200.

As the clean water flows into the pump water output pipe 12 quickly from the main water tank 61, the water level in the main water tank 61 drops down quickly as well. Due to the connection of the water equalizing pipe 63 between the main water tank 61 and the auxiliary water tank 62, the clean water in the auxiliary water tank 62 can flow into the main water tank 61 via the water equalizing pipe 63, which realizes the supplement of the clean water in the main water tank 61.

In the embodiment, by arranging the main water tank 61 and the auxiliary water tank 62, the water supply volume of the water tank 6 is increased, which can thoroughly clean the bowl part 100 of the toilet.

Further, please refer to FIG. 9, the water tank 6 may also comprise air equalizing pipe 64 connecting through the upper parts of the main water tank 61 and the auxiliary water tank 62 respectively. The water equalizing pipe 63 connects through the lower parts of the main water tank 61 and the auxiliary water tank 62 respectively. Wherein, the water equalizing pipe 63 connected at the bottom parts is used for equalizing the water levels in the two water tanks 61, 62; the air equalizing pipe 64 connected at the top parts is used for equalizing the air pressure levels in the two water tanks 61, 62.

In another embodiment, please refer to FIG. 9, the diameter of the air equalizing pipe 64 is smaller than the one of the water equalizing pipe 63. In one example, the inner diameter of the water equalizing pipe 63 is bigger than 15 mm. The water equalizing pipe 63 with bigger diameter can let the clean water enter the main water tank 61 from the auxiliary water tank 62 quickly. The air equalizing pipe 64 with smaller diameter can make the pressure levels inside the main water tank 61 and the auxiliary water tank 62 become different. For example, when the water level in the main water tank 61 drops down quickly, the main water tank 61 is in a state of temporary vacuum. The vacuum can help the water in the auxiliary water tank 62 enter the main water tank 61 quickly and then the flushing speed is accelerated which leads to wash the toilet out more easily.

Figure 1:
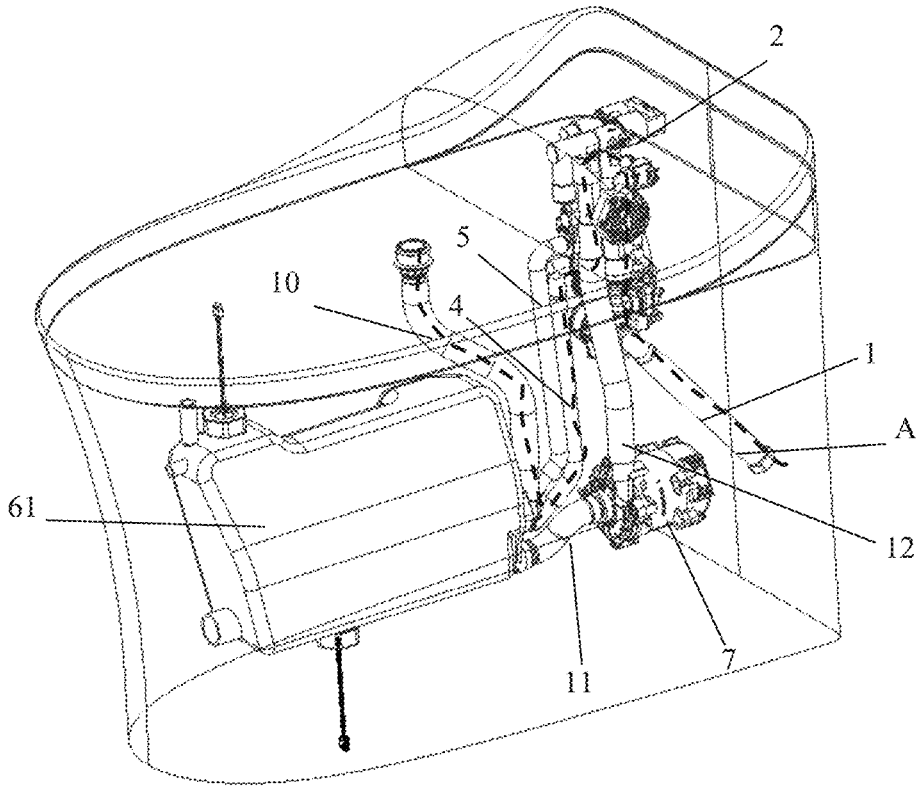
FIG. 1 is a structural diagram of a flushing assembly installed on a toilet in one embodiment of the present disclosure.
Figure 2:
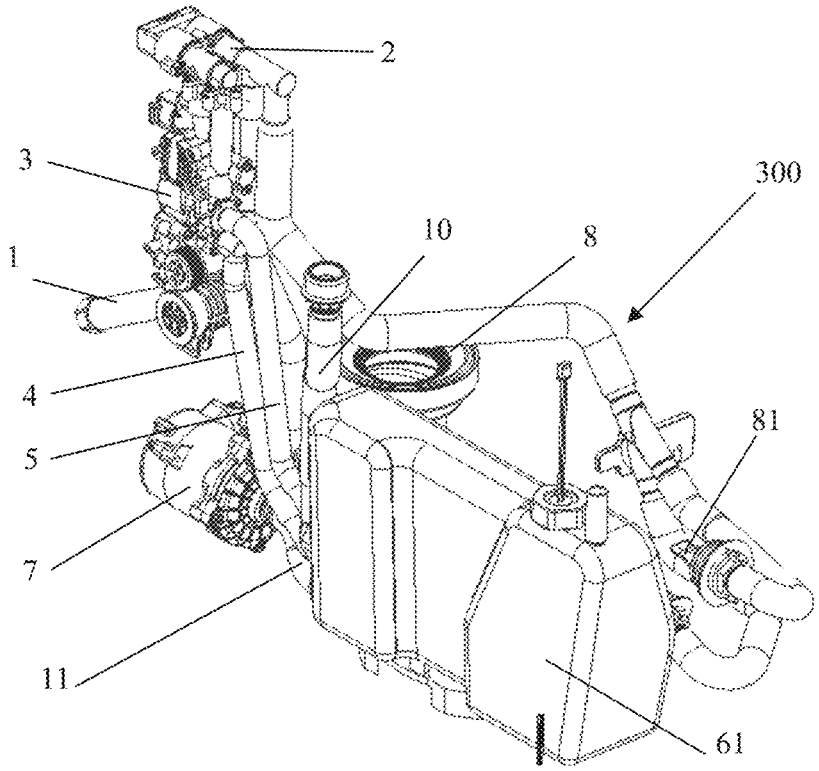
FIG. 2 is a stereogram of a flushing assembly in one embodiment of the present disclosure.

Please refer to FIG. 1 and FIG. 2. FIG. 1 is a structural diagram of a flushing assembly installed on a toilet in one embodiment of the present disclosure. FIG. 2 is a stereogram of a flushing assembly in one embodiment of the present disclosure. The flushing assembly 300 further comprises the water suction pump 7. The water suction pump 7 is connected to the main water tank 61 and located at the bottom of the toilet.

Further, please refer to FIG. 1 and FIG. 2, the flushing assembly 300 further comprises a vacuum breaker 2. The vacuum breaker 2 is located at the top of the toilet. The valve element of the vacuum breaker 2 moves horizontally. The horizontal disposition of the vacuum breaker 2 may decrease the toilet inner space occupied by the vacuum breaker 2, then the arrangement is optimized.

Figure 3:
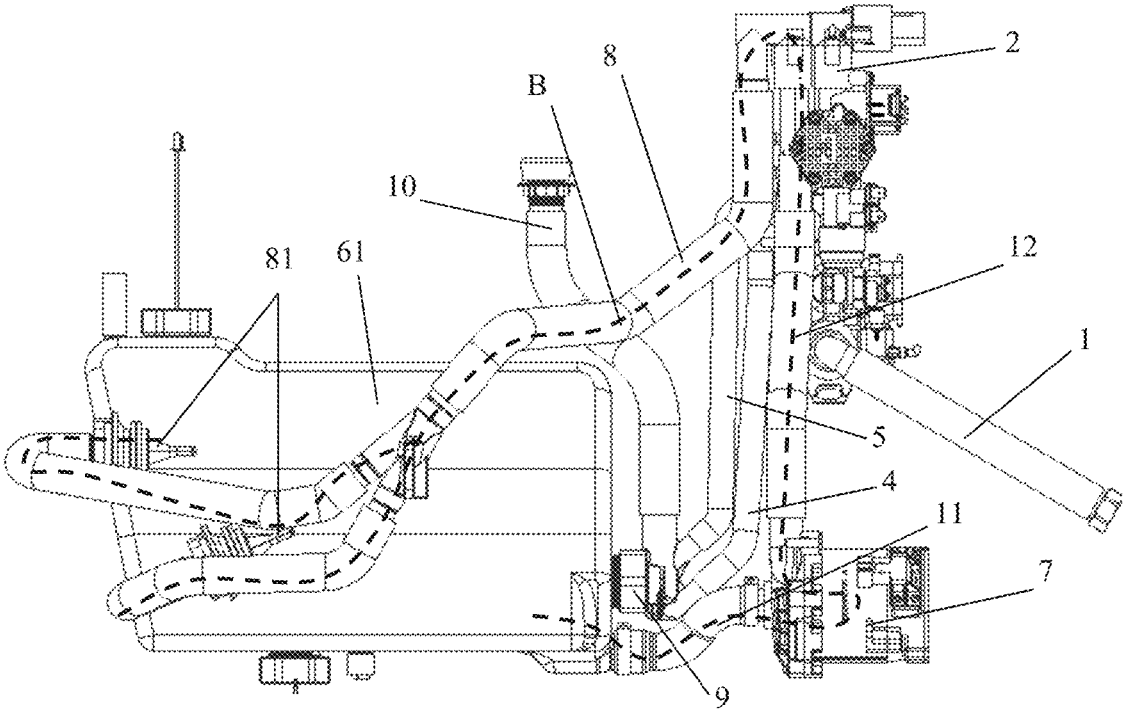
FIG. 3 is a rear view of a flushing assembly in one embodiment of the present disclosure.

In addition, please refer to FIG. 2 and FIG. 3. FIG. 2 is a stereogram of a flushing assembly in one embodiment of the present disclosure. FIG. 3 is a rear view of a flushing assembly in one embodiment of the present disclosure. The flushing assembly 300 further also comprises a jet hole pipe 8 which is connected to the vacuum breaker 2. The water suction pump 7 pumps the clean water in the water tank 6 to the jet hole pipe 8 through the vacuum breaker 2. The jet hole pipe 8 conveys the clean water to the siphon jet hole 101 located at the bottom of the bowl part 100 of the toilet (please refer to FIG. 5).

Still further, the flushing assembly 300 further comprises a main water input pipe 1 and a switching valve 3. The main water input pipe 1 is connected to the vacuum breaker 2, the vacuum breaker 2 is then connected to the switching valve 3. The output of the switching valve 3 is connected to a jet flow water input pipe 4 and a water tank input pipe 5. When the switching valve 3 is powered off, the switching valve 3 is switched to be connected through the jet flow water input pipe 4. The jet flow water output pipe 10 is connected to the water tank 6. The tap water in the main water input pipe 1 and the stored clean water in the water tank 6 is conveyed to the upper rim of the bowl part 100 of the toilet together. When the switching valve 3 is powered on, the switching valve 3 is switched to be connected through the water tank input pipe 5. The water tank input pipe 5 is connected through the water tank 6, the tap water in the main water input pipe 1 is filled into the water tank 6.

Further, please refer to FIG. 1, the dotted line in the FIG. 1 indicates the pathway of the first flushing water passage A. The first flushing water passage A extends in sequence through the main water input pipe 1, the vacuum breaker 2, the switching valve 3, the jet flow water input pipe 4 and merges the water tank 6, finally combines into and extends through a jet flow element 9 and then extends from a jet flow water output pipe 10 to the upper rim of the bowl part 100 of the toilet (please refer to FIG. 5). Wherein, the pathway of the first flushing water passage A can contain a main path and a side path. The main path indicates the path that the water flows through the jet flow element 9 and the jet flow water output pipe 10 directly from the main water input pipe 1 receiving the tap water, the side path indicates the path that the stored water flows into the jet flow element 9 and the jet flow water output pipe 10 from the water tank 6 as a result of Venturi effect. The main path and side path merge together at the jet flow element 9 and incorporate into the jet flow water output pipe 10 later. Namely, in the embodiment, by conveying tap water and the stored clean water inside the water tank conjointly into the upper rim of the bowl part of a toilet, the whole inner surface of the bowl part is filled with the water quickly and successfully.

Please refer to FIG. 3, the dotted line in the FIG. 3 indicates the pathway of the second flushing water passage B. The second flushing water passage B extends in sequence through the water tank 6, the water suction pump 7, the vacuum breaker 2 and the jet hole pipe 8. The ends of the jet hole pipe 8 are provided with two jet nozzles 81. As shown in the FIG. 5, the two jet nozzles 81 connect to the two siphon jet holes 101 located at the bottom of the bowl part 100. The jet nozzles 81 eject the clean water in the water tank 6 to the bottom of the bowl part 100, and then motivate the occurrence of siphon or cause a siphoning effect, which make the faeces discharging pipe 200 discharge the faeces quickly and powerfully. The water saving effect can also be achieved.

Further, please refer to FIG. 2, the flushing assembly 300 can also comprise a water tank input passage (not marked in the figures) for filling the tap water into the water tank 6. The water tank input passage extends in sequence through the main water input pipe 1, the vacuum breaker 2, the switching valve 3, the water tank input pipe 5 and the water tank 6. Hence, the water tank input passage successfully fills the tap water from an external water source into the water tank 6 and realizes the objective of supplementing water for the water tank 6.

Still further, the flushing assembly 300 further comprises the jet flow water output pipe 10. The jet flow water output pipe 10 conveys the tap water and the stored clean water in the water tank 6 together to the upper rim of the bowl part 100 of the toilet. The jet flow water output pipe 10 and the water tank input pipe 5 are all connected to the water tank 6 via jet flow element 9.

Figure 6:
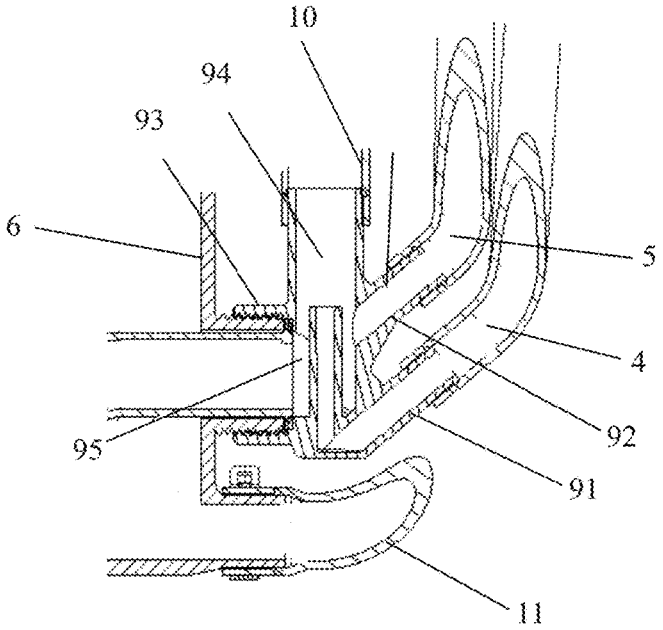
FIG. 6 is a partial sectional view of a flushing assembly in one embodiment of the present disclosure.

Please refer to FIG. 6, the jet flow element 9 may comprise a jet flow water input connector 91, a water tank input connector 92, a water tank connector 93, a jet flow water output connector 94 and a jet flow pipe 95. The jet flow water input connector 91 is connected to the jet flow water input pipe 4. The water tank input connector 92 is connected to the water tank input pipe 5. The water tank connector 93 is connected through the water tank 6. The jet flow water output connector 94 is connected to the jet flow water output pipe 10 and connected through the water tank connector 93 as well as the jet flow water input connector 91. The jet flow pipe 95 is located inside the jet flow water output connector 94. The jet flow water input connector 91 is located beneath the water tank input connector 92. The bottom of the jet flow pipe 95 is connected through the jet flow water input connector 91.

Figure 7:
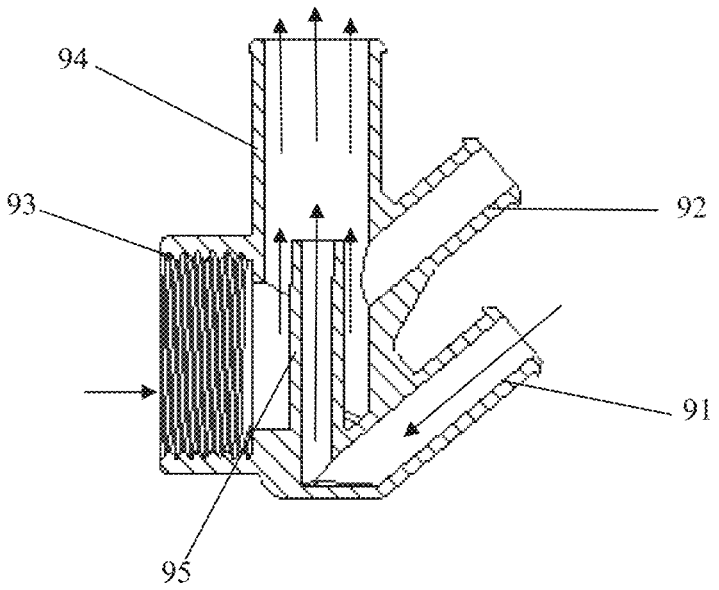
FIG. 7 is the flow direction diagram of the jet flow element when the first flushing passage is working in one embodiment of the present disclosure.

Specifically, please refer to FIG. 7, when the first flushing water passage A works, the tap water inside flows through the main water input pipe 1, the vacuum breaker 2, the switching valve 3 and the jet flow water input pipe 4, then enters the jet flow water input connector 91, and afterwards the jet flow pipe 95 and the jet flow water output connector 94. The clean water in the water tank 6 flows from the water tank connector 93 to the jet flow water output connector 94. The water flowing out from the jet flow pipe 95 brings the nearby water flowing out from the water tank 6 to the upper rim of the bowl part 100 of the toilet. Hence, vacuum can be created around the jet flow pipe 95 in the jet flow element 9, which makes the water previously stored in the water tank 6 flow into the jet flow element 9 continuously.

The jet flow element 9 causes the tap water and the clean water in the water tank 6 conjointly enter into the upper rim of the bowl part of the toilet, thus the whole inner surface of the bowl part can be filled with the water swiftly, rather than only relying on the supply of water from the water tank 6. As the water tank 6 is set at the lower part of the toilet, its volume is limited after all. By applying this way, more water volume can be provided to the bowl part 100 on the premise of keeping the same volume of the water tank 6.

Figure 8:
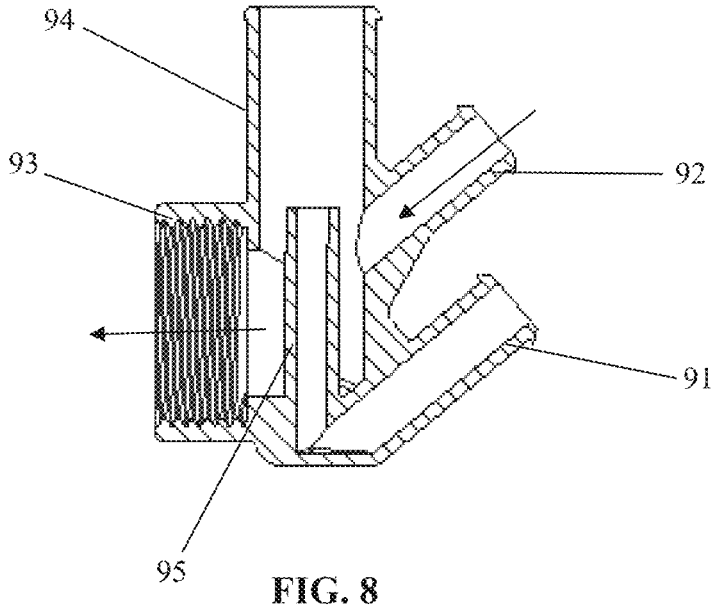
FIG. 8 is the flow direction diagram of the jet flow element when the water inlet channel of the water tank is working in one embodiment of the present disclosure.

Please refer to FIG. 8, when the water tank 6 is filling water, the tap water flows into the water tank input connector 92 from the water tank input pipe 5. Then the tap water goes across the jet flow water output connector 94 and circumvents the jet flow pipe 95, and then flows to the water tank connector 93, and finally into the water tank 6. The water replenishing is thus achieved by the external tap water.

Further, please refer to FIG. 3, the flushing assembly 300 can also comprise a pump water input pipe 11 and a pump water output pipe 12. One end of the pump water input pipe 11 is connected through the water tank 6, another end thereof is connected through the water suction pump 7. One end of the pump water output pipe 12 is connected through the water suction pump 7, another end thereof is connected through the vacuum breaker 2 which is connected through the jet hole pipe 8.

Figure 5:
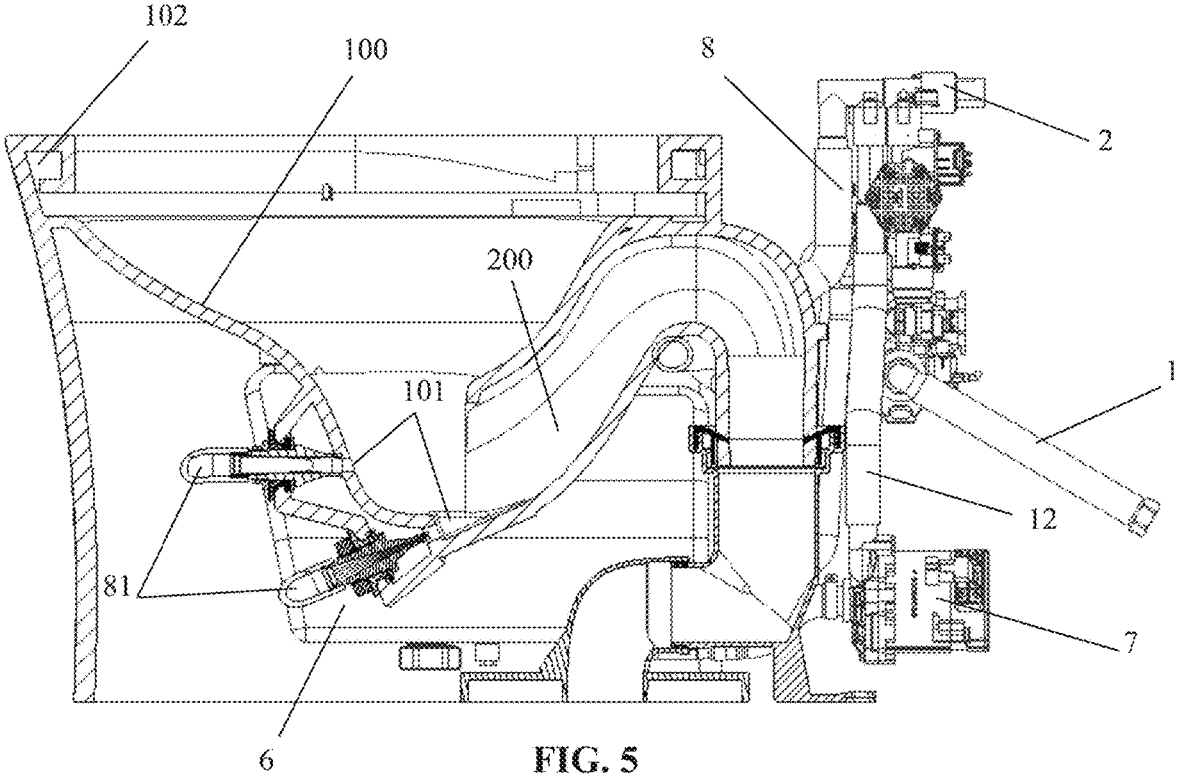
FIG. 5 is a sectional view of a flushing assembly installed into a toilet in one embodiment of the present disclosure.

Further, please refer to FIG. 5, the upper rim of the bowl part 100 is provided with an annular water circle 102 distributed with a plurality of small holes facing down. These small holes can convey the water onto the upper surface of the bowl part 100, which renders the upper surface be full of flushing water.

Furthermore, please refer to FIG. 5, the bottom of the bowl part 100 can be provided with two siphon jet holes 101 facing the entrance of the faeces discharging pipe 200.

After the water is ejected from the siphon jet holes 101 towards the faeces discharging pipe 200, the siphon effect is formed accordingly, which expedites the water in the bowl part 100 flush into the faeces discharging pipe 200 and enhances the power of discharging the faeces. Therefore, the faeces on the upper surface of the bowl part 100 can be flushed away more powerfully and thoroughly even under the circumstance of low water flow from the external water source and regarding the non-rounded bowl part e.g. having rectangle-shaped or other sharp turning inner surface.

Figure 11:
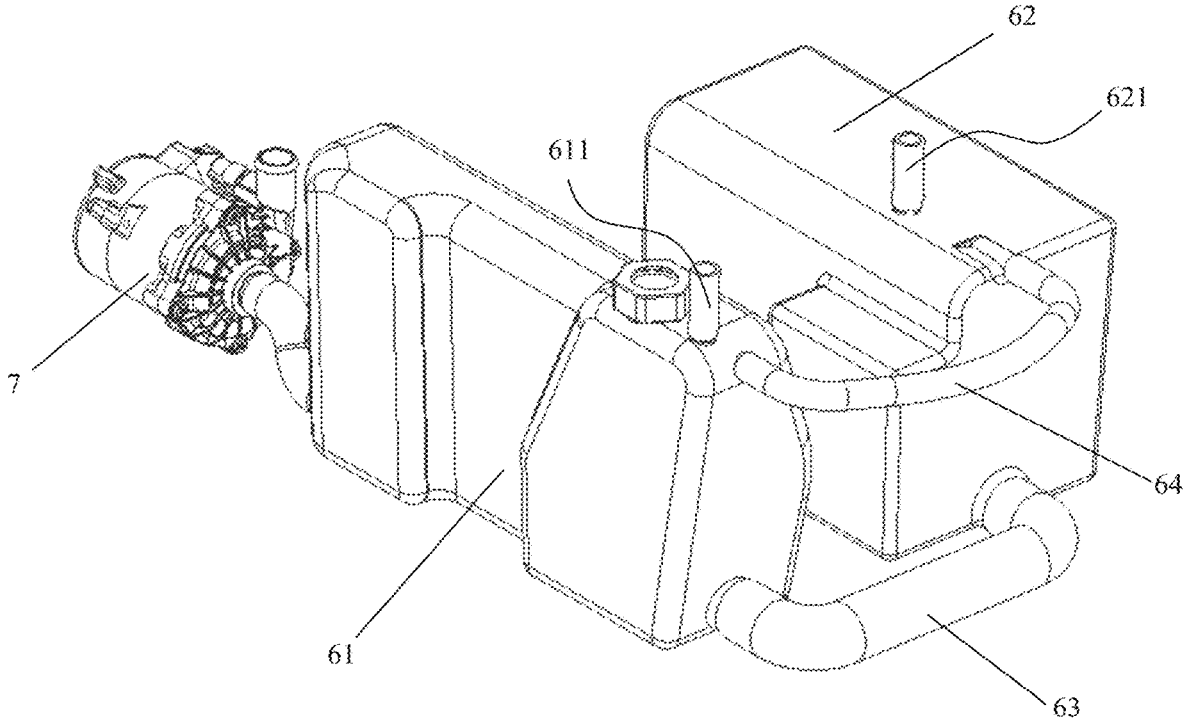
FIG. 11 is a stereogram of a flushing water supply assembly in one embodiment of the present disclosure.

In one embodiment of the present disclosure, please refer to FIG. 9 and FIG. 11. FIG. 9 is a structural diagram of a water tank inside a toilet in one embodiment of the present disclosure. FIG. 11 is a stereogram of a flushing water supply assembly in one embodiment of the present disclosure. The water supply assembly of a toilet may comprise a main water input pipe 1, a water tank 6, a water suction pump 7 and a jet flow water input pipe 4. The main water input pipe 1 is connected to the water tank 6, clean water enters the water tank 6 through the main water input pipe 1. The water tank 6 is connected to the water suction pump 7 which is connected to the jet flow water input pipe 4. The water suction pump 7 pumps the clean water inside the water tank 6 into the jet flow water input pipe 4. The water tank 6 comprises a main water tank (e.g. a main water tank portion) 61, an auxiliary water tank (e.g. an auxiliary water tank portion) 62 and a water equalizing pipe 63 connecting between and through the main water tank 61 and the auxiliary water tank 62. The main water tank 61 is provided with a water inlet and a water outlet thereon, the main water input pipe 1 is mounted at the water inlet, the water suction pump 7 is mounted at the water outlet.

Further, please refer to FIG. 11, the top of the auxiliary water tank 62 is provided with a first air inlet 621. The first air inlet 621 keeps the communication with atmosphere, which makes the clean water in the auxiliary water tank 62 can quickly enter the main water tank 61 as a joint result of the atmosphere, its own gravity and the vacuum in the main water tank 61. Furthermore, please refer to FIG. 11, the top of the main water tank 61 is provided with a second air inlet 611 whose diameter can be smaller than 5 mm.

Due to the diameter of the second air inlet 611 being smaller than the one of the first air inlet 621 and unable to timely supplement air to the main water tank 61 adequately, and due to the diameter of the air equalizing pipe 64 being relatively small also which causes to be unable to timely suction air from the air equalizing pipe 64, thus vacuum is formed inside the main water tank 61. But the air pressure in the auxiliary water tank 62 is close to atmospheric pressure, therefore the air pressure in the auxiliary water tank 62 is bigger than the one in the main water tank 61. Under the joint impact composed by the vacuum and gravity (e.g., force of gravity on the water), the water in the auxiliary water tank 62 enters the main water tank 61 via the water equalizing pipe 63. Because the water flow does not make the water levels in the two water tanks 61, 62 equal relying on gravity only, under the joint impact combining with the vacuum, the water level in the main water tank 61 is higher than the one in the auxiliary water tank 62. When the water suction pump 7 stops to operate, the vacuum source disappears, thus air enters the main water tank 61 via the air equalizing pipe 64 and second air inlet 611. The air pressures inside the two water tanks 61, 62 become equal gradually, so the water levels keep consistent under the effect of water gravity.

In one example, when the main water tank 61 supplies water, the second air inlet 611 can be blocked. The second air inlet 611 can be fully stuffed, thus the main water tank 61 can produce vacuum more easily. Under this circumstance, the diameter of the second air inlet 611 can be same as the one of the first air inlet 621. The blocking of the second air inlet 611 can be carried out manually or automatically.

Figure 12:
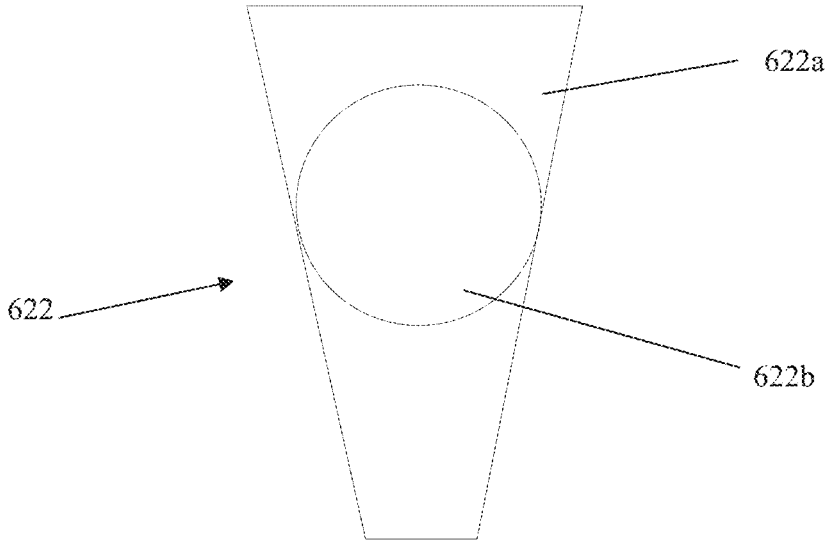
FIG. 12 is a structural diagram of an automatic blocking element of a flushing water supply assembly in one embodiment of the present disclosure.
Figure 13:
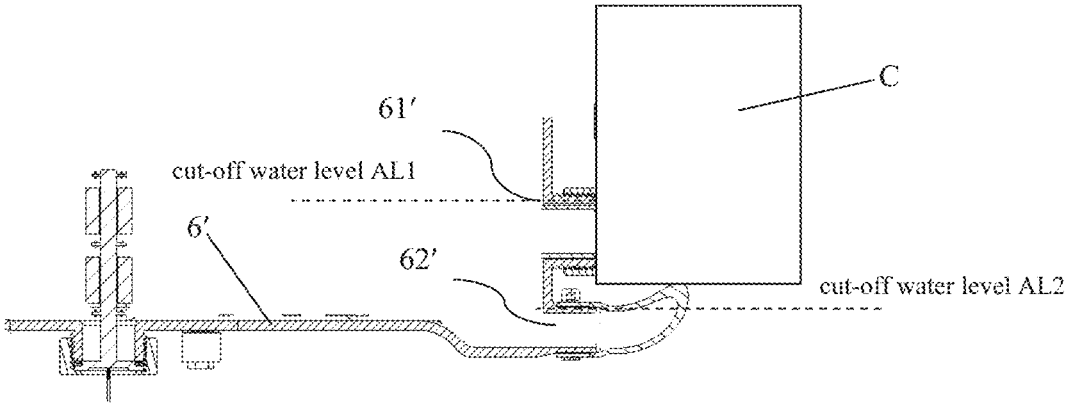
FIG. 13 is a partial structural diagram of a water tank.

In one example, please refer to FIG. 12, the second air inlet 611 is provided with an automatic blocking element 622 comprising a tapered blocking pipe 622*a* and a blocking bead 622*b* put inside the blocking pipe 622*a*. When the main water tank 61 supplies water, the blocking bead 622*b* is sucked towards the blocking pipe 622*a* by vacuum and blocks the blocking pipe 622*a*; when the main water tank 61 stops supplying water, the vacuum disappears, thus the blocking bead 622*b* is separated from the blocking pipe 622*a* and the blocking is resolved.

In one example, the main water tank can also choose not to provide with the second air inlet 211. Further, the main water tank 61 and the auxiliary water tank 62 can be designed whose upper parts are bigger and lower parts are smaller in section.

When the toilet is being designed its appearance by designer, the toilet is usually designed as the upper part is bigger and the lower part is smaller, thereby convenient for user to put the legs at comfortable positions and wouldn't hit the e.g. ceramic toilet body. Please refer to FIG. 10, the bottom of the toilet is relatively smaller and the top is relatively bigger (e.g., the bottom of the toilet may be in the range of 80% 95% by width of the top of the toilet). For the sake of aesthetics, the bottom can be further shrunk and forms the impression of the toilet floating in the air, so the bottom of the toilet can be provided with stepped surface. In order to fully utilize the internal space of the toilet under the bowl part 100, the main water tank 61 and the auxiliary water tank 62 can be designed whose upper parts are bigger and lower parts are smaller in section.

In another embodiment of the present disclosure, please refer to FIG. 9 and FIG. 10. FIG. 9 is a structural diagram of a water tank inside a toilet in one embodiment of the present disclosure. FIG. 10 is a sectional view of a water tank inside a toilet in one embodiment of the present disclosure. The toilet can include an external housing 18, a bowl part 100 and a faeces discharging pipe 200. The bowl part 100 is used for receiving faeces. Installation space is set aside under the bowl part 100 and between the two sides of the external housing 18. The faeces discharging pipe 200 is located at the installation space and connects to the bottom of the bowl part 100. The toilet also includes the water supply assembly as described in the aforesaid embodiments. The main water tank 61 and the auxiliary water tank 62 are arranged under the bowl part 100.

Further, please refer to FIG. 10, the main water tank 61 and the auxiliary water tank 62 are arranged at the left and right sides of the faeces discharging pipe 200 respectively. In the present disclosure, the so-called "left and right sides" is defined on the basis of the orientation of the toilet that has already mounted and used.

The main water tank 61 and the auxiliary water tank 62 are provided with a gap therebetween. The gap, on the one hand, facilitates the installation of the main water tank 61 and the auxiliary water tank 62, and on the other hand, sets aside enough space for installing the faeces discharging pipe 200 or other pipes.

Further, please refer to FIG. 10, the shapes of the external sides of the main water tank 61 and the auxiliary water tank 62 can match the ones of the internal sides of the external housing 18. In order to increase the water supply volume of the water tank 6 as far as possible, the shapes of the main water tank 61 and the auxiliary water tank 62 should match the ones of the internal sides of the external housing 18 as far as possible.

The present disclosure can enhance the actual volume of water tank system on the premise of not increasing the outside scale of the toilet. Furthermore, by configuring the air inlets, the speed that the water inside the two water tanks flows towards the suction side of the water suction pump 7 can be enhanced, which makes the water supply effect of the water suction pump 7 be close to integral water tank.

In one embodiment of the present disclosure, regarding the flushing assembly for a toilet with a low water flow from the main water input passage and/or with a bowl part having rectangle-shaped or other sharp turning inner surface, the flushing assembly may comprise a first flushing water passage A and a second flushing water passage B. The first flushing water passage A conveys tap water and the clean water in water tank 6 to the upper rim of the bowl part 100 of the toilet, the second flushing water passage B conveys the clean water in the water tank 6 to the bottom of the bowl part 100.

Specifically, please refer to FIG. 1 and FIG. 2. FIG. 1 is a structural diagram of a flushing assembly installed on a toilet in one embodiment of the present disclosure. FIG. 2 is a stereogram of a flushing assembly in one embodiment of the present disclosure. The flushing assembly can comprise a main water input pipe 1, a vacuum breaker 2, a switching valve 3, a jet flow water input pipe 4, a water tank input pipe 5, a water tank 6, a water suction pump 7 and a jet hole pipe 8.

The main water input pipe 1 is connected to the vacuum breaker 2, the vacuum breaker 2 is connected to the switching valve 3 and the jet hole pipe 8. The switching valve 3 is connected to the jet flow water input pipe 4 and the water tank input pipe 5. When the switching valve 3 is powered off, the switching valve communicates with the jet flow water input pipe 4; when the switching valve 3 is powered on, the switching valve 3 switches to communicate with the water tank input pipe 5. The jet flow water input pipe 4 is connected through the water tank 6, and then conveys the tap water in the main water input pipe 1 together with the clean water in the water tank 6 to the upper rim of the bowl part 100 of the toilet (please refer to FIG. 5).

The water tank input pipe 5 is connected to the water tank 6. The water tank 6 is connected to the water suction pump 7. The water suction pump 7 is connected to the vacuum breaker 2. The vacuum breaker 2 is connected to the jet hole pipe 8. The water suction pump 7 pumps the clean water in the water tank 6 into the jet hole pipe 8 through the vacuum breaker 2. The jet hole pipe 8 conveys the clean water to the siphon jet hole 101 at the bottom of the bowl part 100.

Furthermore, please refer to FIG. 3 and FIG. 6. FIG. 3 is a rear view of a flushing assembly in one embodiment of the present disclosure. FIG. 6 is a partial sectional view of a flushing assembly in one embodiment of the present disclosure. The flushing assembly can also comprise the jet flow element 9 and the jet flow water output pipe 10. The jet flow water output pipe 10 conveys the tap water and the clean water in the water tank 6 together to the upper rim of the bowl part 100 of the toilet.

Please refer to FIG. 4 and FIG. 5. FIG. 4 is a structural diagram of a flushing assembly and a bowl part in one embodiment of the present disclosure. FIG. 5 is a sectional view of a flushing assembly installed into a toilet in one embodiment of the present disclosure. The flushing assembly can be incorporated into the toilet, the water tank 6 is arranged below the bowl part 100.

The present disclosure solves the problems of under the circumstance of low water flow from the main water input passage and for the bowl part having rectangle-shaped or other sharp turning inner surface, the whole inner surface of the bowl part during flushing was not washed adequately and evenly, as well as too small siphon force was created in the bottom of the bowl part. The water consumption is also saved. Compared with some other solutions, the cost is lowered down.

Lower Position Water Suction Assembly and Water Tank

Figure 14:
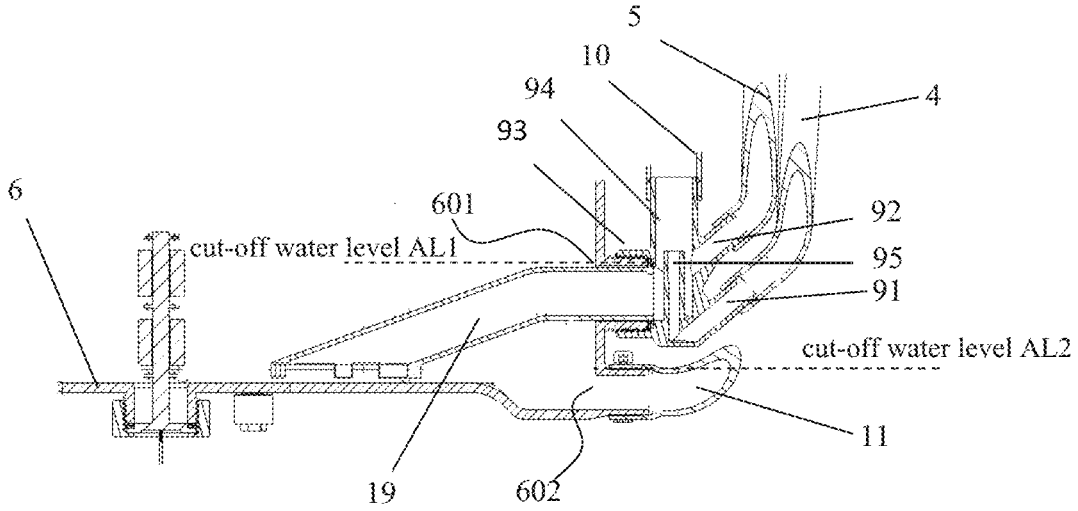
FIG. 14 is a structural diagram showing the connection between the lower position water suction assembly and the water tank in first embodiment of the present disclosure.
Figure 15:
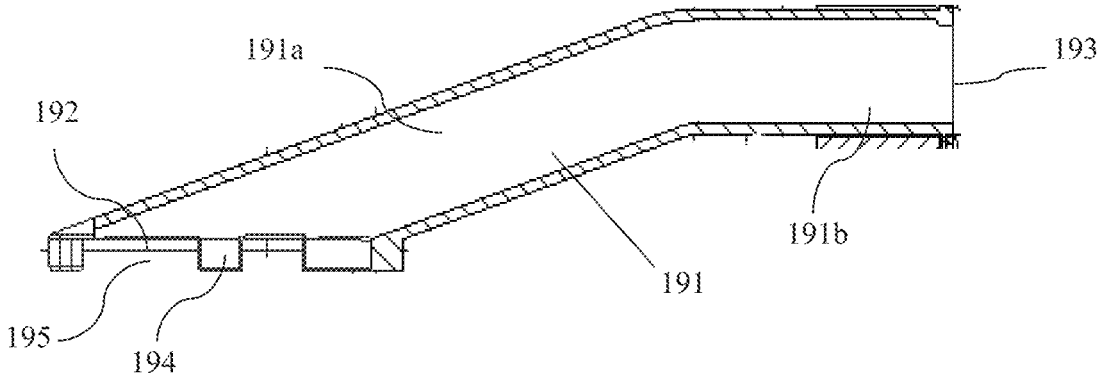
FIG. 15 is a structural diagram of the lower position water suction pipe in first embodiment of the present disclosure.

In one embodiment of the present disclosure, please refer to FIG. 14 and FIG. 15. FIG. 14 is a structural diagram showing the connection between the lower position water suction assembly and the water tank in first embodiment of the present disclosure. FIG. 15 is a structural diagram of the lower position water suction pipe in first embodiment of the present disclosure. The lower position water suction assembly may comprise a lower position water suction pipe 19 and a jet flow element 9.

The lower position water suction pipe 19 comprises a pipe body 191, a water suction pipe port 192 together with a water input pipe port 193 arranged at two ends of the pipe body 191 respectively. The water suction pipe port 192 is provided with a plurality of projections 194 distributed alternately. The adjacent projections 194 form water suction ports therebetween. The projections 194 are used for contacting with the inner bottom surface of water tank 6. The water input pipe port 193 is used for connecting to the first water gate 601 of the water tank 6.

The lower position water suction pipe 19 conveys the water in the bottom of the water tank 6 into the jet flow element 9. The jet flow element 9 is used for conveying the clean water in the water tank 6 and the outside tap water together into the upper rim of the bowl part 100 of a toilet (please refer to FIG. 5).

Because the lower position water suction pipe 19 is able to convey the water in the bottom of the water tank 6 into the jet flow element 9, the water in the bottom of the water tank 6 is fully utilized and the utilization efficiency of the water volume in the water tank 6 is also enhanced. Under the circumstance of unchanging the volume of the water tank 6, the flushing water volume can be elevated, and then the toilet performance is improved accordingly.

Further, please refer to FIG. 15, the pipe body 191 comprises a sideling pipe 191*a* and a straight pipe 191*b*. One end of the sideling pipe 191*a* is the water suction pipe port 192, another end of the sideling pipe 191*a* is connected to one end of the straight pipe 191*b*, another end of the straight pipe 191*b* is the water input pipe port 193. The water suction pipe port 192 is arranged along horizontal plane, the water input pipe port 193 is arranged along vertical plane.

In one example, the pipe body 191 can also be the pipes with other shapes. For example, camber bended pipe or right angle bended pipe.

The jet flow water output pipe 10 conveys the tap water and the clean water in the water tank 6 together to the upper rim of the bowl part 100 of the toilet.

Please refer to FIG. 7, when the external tap water flows from the jet flow water input pipe 4 to the jet flow water input connector 91, and afterwards the jet flow pipe 95 and then the jet flow water output connector 94. The clean water in the water tank 6 flows from the water tank connector 93 to the jet flow water output connector 94. The water flowing out from the jet flow pipe 95 brings the nearby water flowing out from the water tank 6 to the upper rim of the bowl part 100 of the toilet. Hence, vacuum can be created around the jet flow pipe 95 locally in the jet flow element 9, which makes the water previously stored in the water tank 6 flow into the jet flow element 9 continuously.

The jet flow element 9 causes the tap water and the clean water in the water tank 6 conjointly enter into the upper rim of the bowl part of the toilet, thus the whole inner surface of the bowl part can be filled with the water swiftly, rather than only relying on the supply of water from the water tank 6. As the water tank 6 is set at the lower part of the toilet, its volume is limited after all. By applying this way, more water volume can be provided to the bowl part 100 on the premise of keeping the same volume of the water tank 6.

Please refer to FIG. 14 and FIG. 8. FIG. 14 is a structural diagram showing the connection between the lower position water suction assembly and the water tank in first embodiment of the present disclosure. FIG. 8 is the flow direction diagram of the jet flow element when the water inlet channel of the water tank is working in one embodiment of the present disclosure. When the water tank 6 is filling water, the tap water flows into the water tank input connector 92 from the water tank input pipe 5. Then the tap water goes across the jet flow water output connector 94 and circumvents the jet flow pipe 95, and then flows to the water tank connector 93, and finally goes into the water tank 6. The water replenishing is thus achieved by the external tap water.

Embodiment 2

In another embodiment of the present disclosure, the internal structural of a toilet is depicted, please refer to FIG. 1 to FIG. 5 for more details. FIG. 1 is a structural diagram of a flushing assembly installed on a toilet in one embodiment of the present disclosure. FIG. 2 is a stereogram of a flushing assembly in one embodiment of the present disclosure. FIG. 3 is a rear view of a flushing assembly in one embodiment of the present disclosure. FIG. 4 is a structural diagram of a flushing assembly and a bowl part in one embodiment of the present disclosure. FIG. 5 is a sectional view of a flushing assembly installed into a toilet in one embodiment of the present disclosure. Firstly, please refer to FIG. 5 and FIG. 14. FIG. 14 is a structural diagram showing the connection between the lower position water suction assembly and the water tank in first embodiment of the present disclosure. The toilet comprises a bowl part 100 and a water tank 6 situated under the bowl part 100. The water tank 6 includes a first water gate 601 (water may flow both inwardly and outwardly therethrough) and a second water gate 602 (water only flow outwardly therethrough). The first water gate 601 situates above the second water gate 602. The toilet further comprises a lower position water suction assembly described in the above-stated embodiment(s).

The water tank input pipe 5 is connected through the water tank 6, the water tank 6 is connected to the water suction pump 7, and the water suction pump 7 is connected to the jet hole pipe 8. The water suction pump 7 pumps the clean water in the water tank 6 through the vacuum breaker 2 to the jet hole pipe 8. The jet hole pipe 8 conveys the clean water to the siphon jet holes 101 of the bottom of the bowl part 100 (please refer to FIG. 5).

Check Valve

Figure 16:
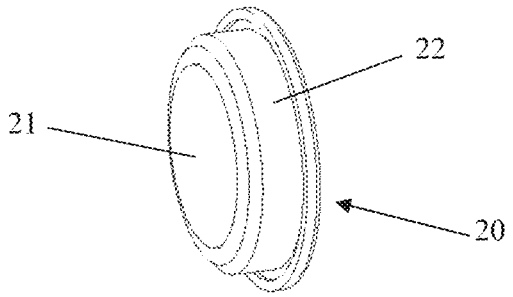
FIG. 16 is a stereogram of a check valve in one embodiment of the present disclosure.
Figure 17:
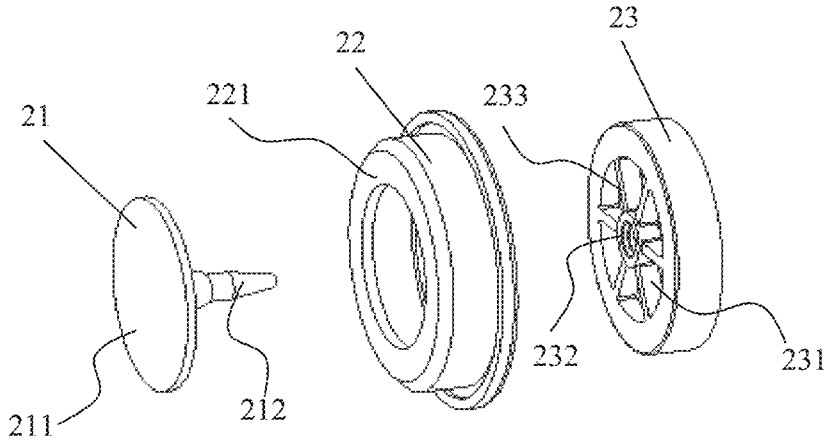
FIG. 17 is an explosion diagram of a check valve in one embodiment of the present disclosure.

In one embodiment of the present disclosure, please refer to FIG. 16 and FIG. 17. FIG. 16 is a stereogram of a check valve in one embodiment of the present disclosure. FIG. 17 is an explosion diagram of a check valve in one embodiment of the present disclosure. The check valve 20 comprises an upper sealing element 21, a lower sealing element 22 and a supporting element 23. The upper sealing element 21 comprises a flexible part 211 which seals the lower sealing element 22. The supporting element 23 is provided with a plurality of hollow parts 231. The supporting element 23 is mounted in the lower sealing element 22 and located at the forward water inflowing side, namely the clean water inflowing side (the right side in the figures).

When water flows forwardly, the clean water flows through the hollow parts 231 and deforms and thrusts aside the flexible part 211; when water flows backwardly, the contaminated water presses the flexible part 211 towards the lower sealing element 22, the supporting element 23 is used for supporting the flexible part 211 and preventing the flexible part 211 from transformation.

In the FIG. 16 and the FIG. 17, the right sides of the FIG. 16 and the FIG. 17 are the clean water inflowing sides. The clean water flows through the hollow parts 231, enters and then passes through the check valve 20.

Figure 19:
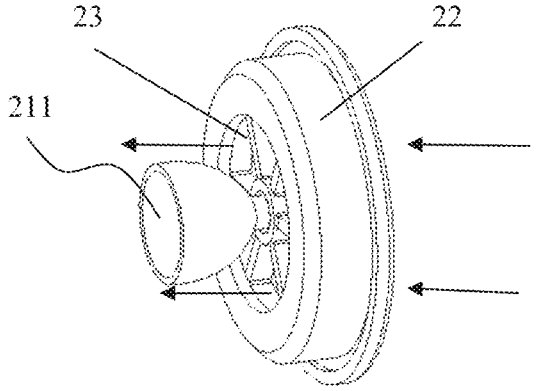
FIG. 19 is a state diagram of a check valve when water flows forwardly therethrough in one embodiment of the present disclosure.

Specifically, please refer to FIG. 19, the arrows in this figure indicate the flowing direction of the clean water. At present, the clean water flows forwardly, and flows through the hollow parts 231 and deforms and thrusts aside the flexible part 211. The flexible part 211 closes up downwardly. Hence, the flexible part 211 is separated from the lower sealing element 22 and exposes the hollow parts 231. Then the bigger diameter for flowing forwards is formed which allows the clean water to flow through the check valve 20 in quantity.

When the clean water stops to flow, the flexible part 211 recovers to its original form under the effect of self-elasticity.

When the contaminated water flows backwardly, namely towards the opposite direction of the arrows in the FIG. 19, the contaminated water presses the flexible part 211 towards the lower sealing element 22, and the supporting element 23 is used for supporting the flexible part 211 from transformation. The flexible part 211 is pressed tightly to the lower sealing element 22 for avoid the contaminated water from flowing backwardly.

When an iron-wire is used for a failure test, the iron-wire is located between the border of the flexible part 211 and the lower sealing element 22. When a vacuum is sucking against the check valve 20, the flexible part 211 could be a partially or substantially deformed and pressed towards the lower sealing element 22 tightly (the upper sealing element 21 and the lower sealing element 22 are all flexible). Thus, the iron-wire is tightly wrapped, which makes the diameter for flowing backwards become very small.

Further, please refer to FIG. 17, the flexible part 211 can be circular rubber sheet. In one example, the flexible part 211 can also be flexible rubber sheet with other shapes as long as the flexible part 211 can be pressed to the lower sealing element 22 tightly.

Furthermore, please refer to FIG. 17, the upper sealing element 21 further comprises a connecting pin 212. The connecting pin 212 inserts into a pin hole 232 of the supporting element 23, which can achieve the connection between the upper sealing element 1 and the supporting element 23.

Figure 18:
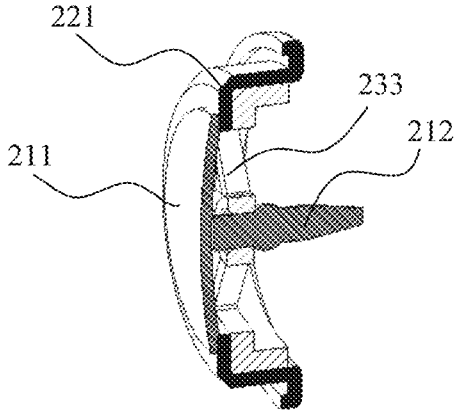
FIG. 18 is a sectional view of a check valve in one embodiment of the present disclosure.

Still further, please refer to FIG. 17 and FIG. 18. FIG. 17 is an explosion diagram of a check valve in one embodiment of the present disclosure. FIG. 18 is a sectional view of a check valve in one embodiment of the present disclosure. The sealing element 22 can be an annular object. The lower sealing element 22 comprises a blocking ring 221. The upper sealing element 21 seals with the outer surface of the blocking ring 221. The supporting element 23 is mounted on the inner surface of the blocking ring 221.

The center of the lower sealing element 22 is a through hole. The supporting element 23 enters into the through hole and abuts against the inner surface of the blocking ring 221 (namely the right side of the FIG. 18). The flexible part 11 contacts tightly with the outer surface of the blocking ring 221 (namely the left side of the FIG. 18).

Further, please refer to FIG. 17, the supporting element 23 is circular. The supporting element 23 further comprises a plurality of rib strips 233 distributed radially. Hollow parts 231 are formed between the adjacent rib strips 233.

The rib strips 233 are used for supporting the flexible part 211 to prevent the flexible part 211 from sinking and deformation when the vacuum sucks and then affecting the sealing between the flexible part 211 and the lower sealing element 22.

In one example, the rib strips 233 can also be other shapes/structures, such as a structure of rib strips distributed in parallel alternately or a structure of rib strips intersected to net-like. In this embodiment, the check valve 20 is installed in the downstream of a vacuum breaker of the toilet. The vacuum breaker and the check valve 20 work together to prevent any backflow of the waste water.

Figure 20:
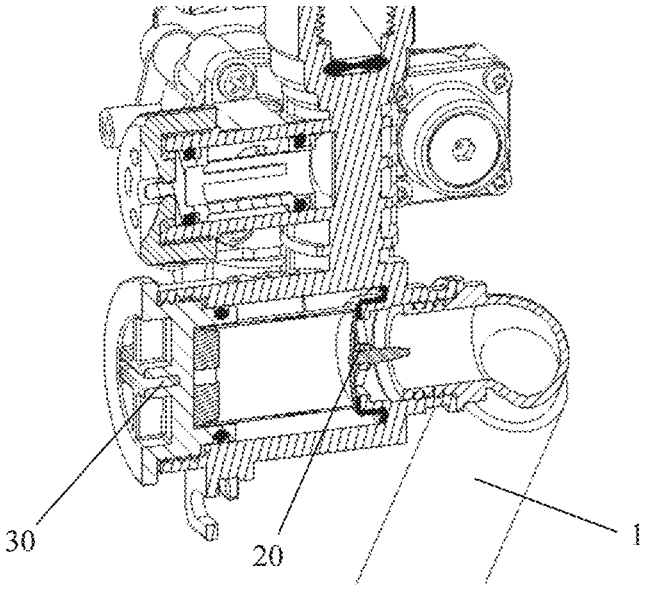
FIG. 20 is a structural diagram of a check valve installed on a toilet in one embodiment of the present disclosure.

In the embodiment of the present disclosure, referring to FIG. 20, the check valve 20 can be mounted at a place between a main water input pipe 1 of the toilet and a main filter screen 30. The outside clean water flows from the main water input pipe 1 through the check valve 20 and then to the main filter screen 30.

The structure of the check valve as provided in the present disclosure is simple, its working space is small but the diameter for flowing forwards is big. The performance is still excellent even if wire-shaped article is mixed therein. Once the check valve is applied onto a toilet, the check valve meets the anti-siphon performance very well and decreases the technical requirement for vacuum breaker.

Method, Device, and Storage Medium for Controlling Toilet Water Consumption

Hereinafter, the embodiments of the present disclosure are described in detail with reference to the accompanying figures.

First Embodiment

Figure 21:
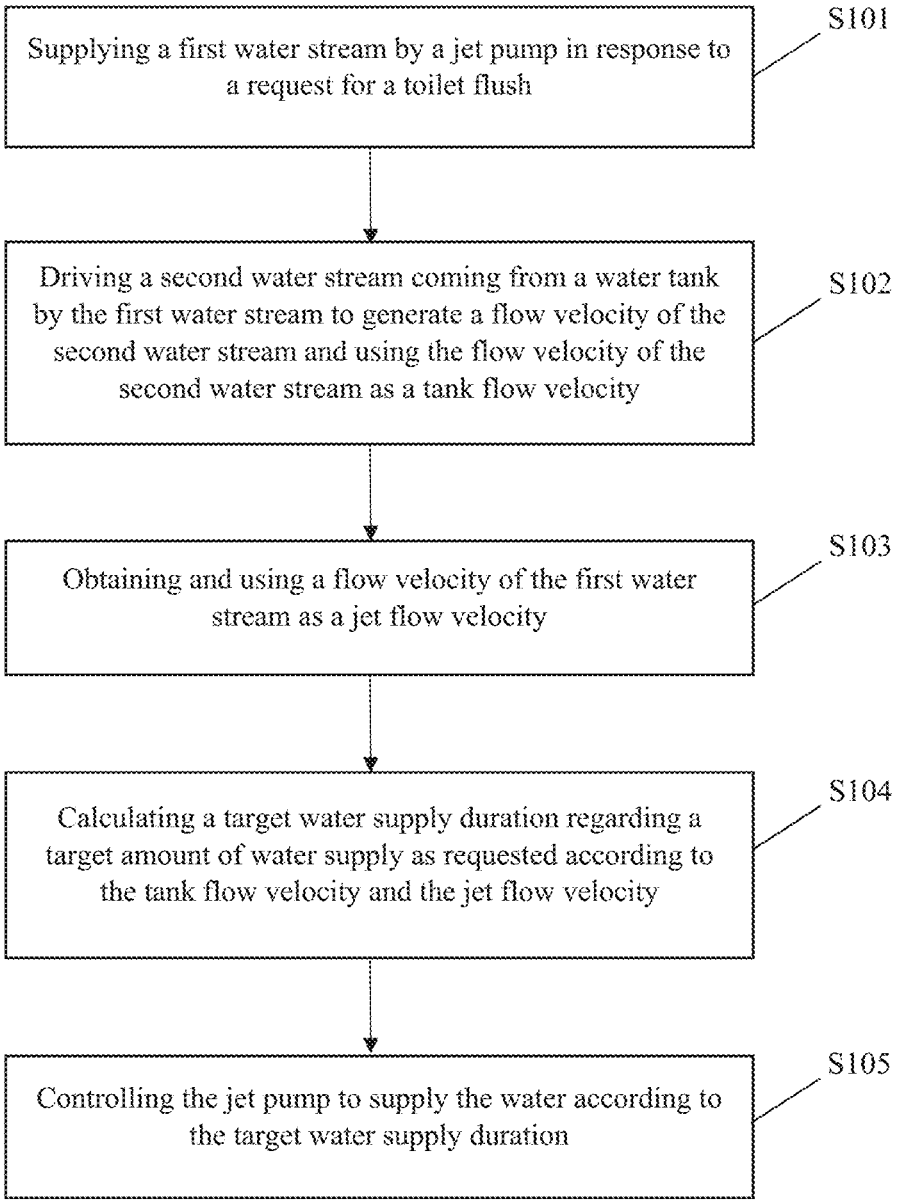
FIG. 21 is a flow chart illustrating a method for controlling toilet water consumption according to the first embodiment of the present disclosure.
Figure 28:
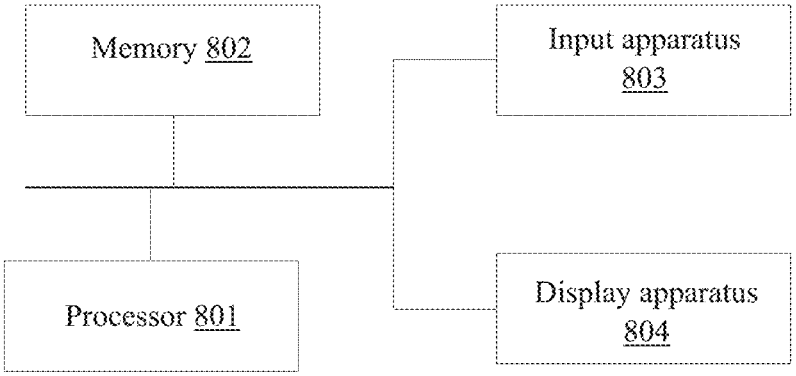
FIG. 28 illustrates a hardware configuration for use in a device for controlling toilet water consumption according to one embodiment of the present disclosure.

FIG. 21 is a flow chart illustrating a method for controlling toilet water consumption according to the first embodiment of the present disclosure. Please also refer to FIG. 28. FIG. 28 illustrates a hardware configuration for use in a device for controlling toilet water consumption according to one embodiment of the present disclosure. The method comprises steps of:

In the step S101, a jet pump supplies a first water stream in response to a request for a toilet flush.

In the step S102, the first water stream drives a second water stream coming from a tank to generate a flow velocity of the second water stream and a processor 801 uses the flow velocity of the second water stream as a tank flow velocity.

In the step S103, the processor 801 obtains and uses a flow velocity of the first water stream as a jet flow velocity.

In the step S104, the processor 801 calculates a target water supply duration regarding a target amount of water supply as requested according to the tank flow velocity and the jet flow velocity.

In the step S105, the processor 801 controls the jet pump to supply the water according to the target water supply duration.

Figure 29:
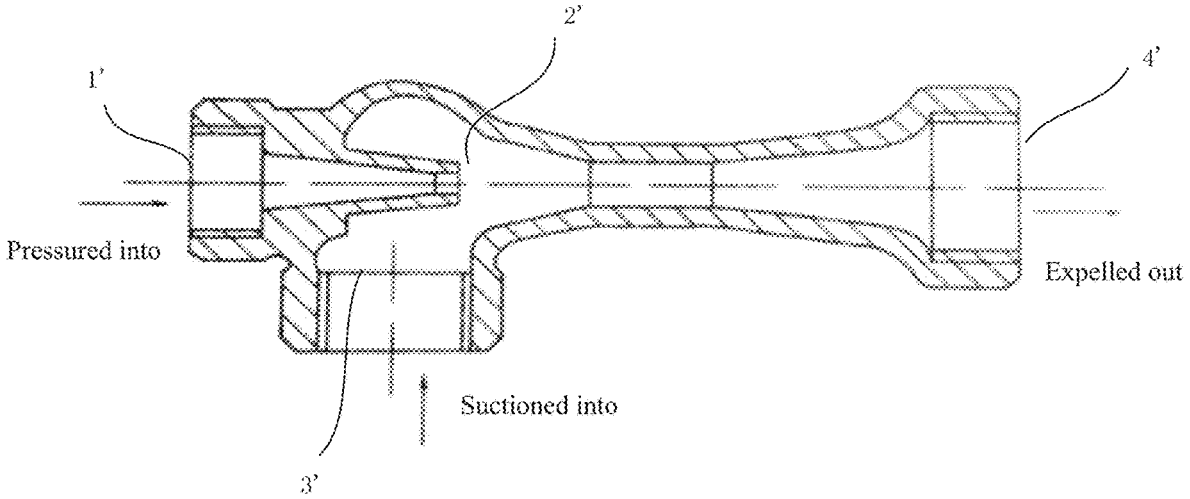
FIG. 29 illustrates a toilet flush performed by a toilet having a jet pump structure.

Specifically, the method according to the first embodiment uses a jet pump to pressurize a stream of water. The pressurized water flows at a velocity $Q_1$, i.e. "jet flow velocity." Due to the Venturi effect, the pressurized water drives a stream of still water in a tank to flow at a velocity $Q_2$, i.e. "tank flow velocity." Two streams meet and flow together to a bowl part or bowl rim. Some methods may not be designed for the toilets having such a jet pump and thus do not distinguish the different flow velocities. Accordingly, these methods cannot be used in a toilet comprising a jet pump to drive, in a single toilet flush, the pressurized water and the tank water to combine and enter the bowl part or bowl rim together. Also, these methods cannot control the duration for the current toilet flush to the bowl part or bowl rim. The jet pump as illustrated in FIG. 29 cannot immediately enable the tank flow velocity of the water coming from a tank outlet 3' to linearly vary with the jet flow velocity of the water coming from a jet mouth 2'. In other words, $Q_2$ may be zero during a time period. Accordingly, these methods cannot precisely estimate and control the amount of the water consumed by a toilet having a jet pump.

According to this embodiment, the method distinguishes the two water streams, i.e. a water stream coming from the jet pump as a first water stream and a water stream coming from the tank and driven by the first water stream as a second water stream. The method comprises a step of using the flow velocity of the first water stream as a jet flow velocity and using the flow velocity of the second water stream as a tank flow velocity. In the step S104, the processor 801 calculates the target water supply duration regarding the target amount of the water supply as requested according to the tank flow velocity and the jet flow velocity. Ultimately, the processor 801 controls the water supply by the jet pump according to the target water supply duration.

The method according to this embodiment may precisely control the amount of the water consumed by a toilet having a jet pump by obtaining the velocities of two water streams. Thus, the fluctuation of toilet flush function may be avoided.

Second Embodiment

Figure 22:
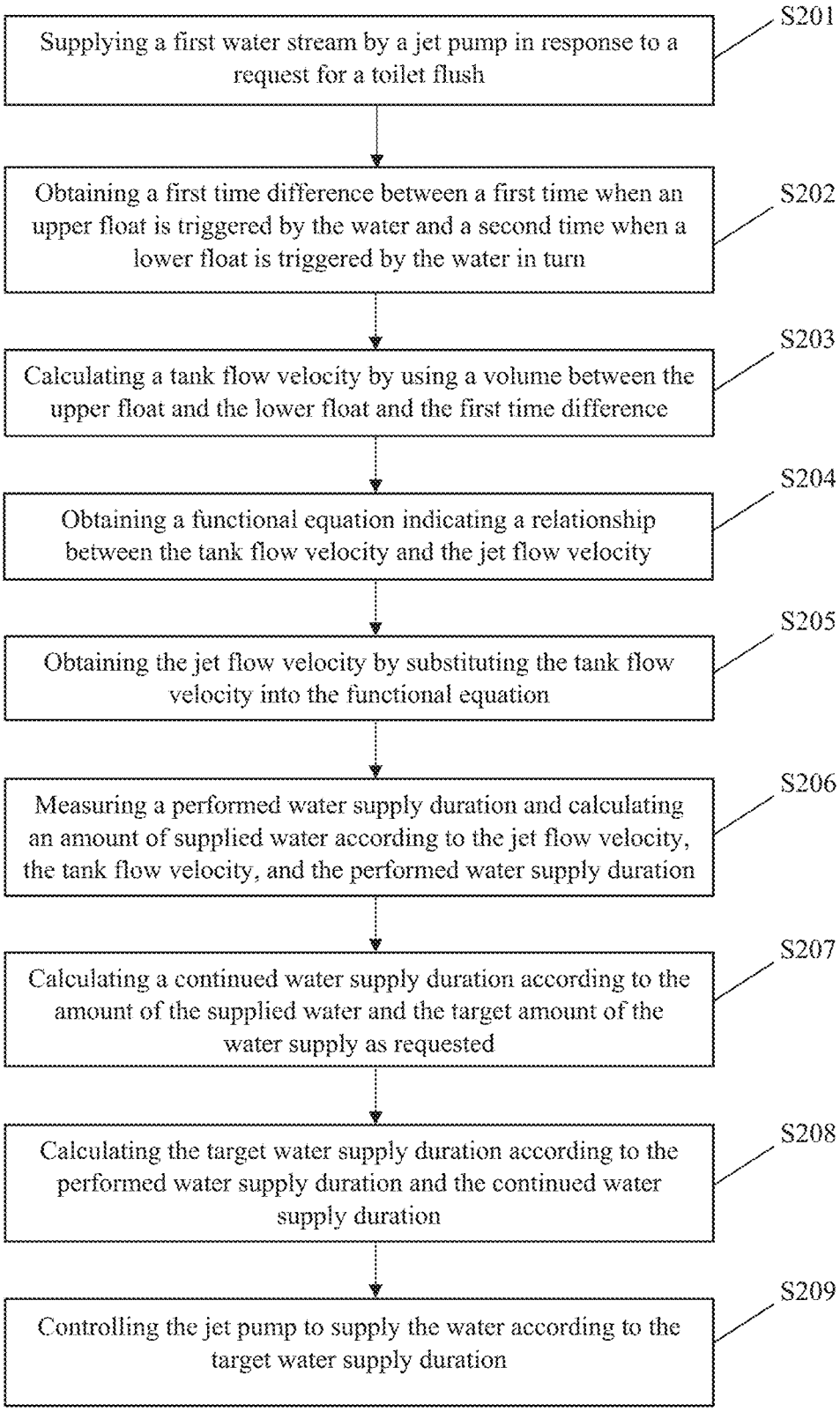
FIG. 22 is a flow chart illustrating a method for controlling toilet water consumption according to the second embodiment of the present disclosure.

FIG. 22 is a flow chart illustrating a method for controlling toilet water consumption according to the second embodiment of the present disclosure. Please also refer to FIG. 28. FIG. 28 illustrates a hardware configuration for use in a device for controlling toilet water consumption according to one embodiment of the present disclosure. The method comprises steps of:

In the step S201, a jet pump supplies a first water stream in response to a request for a toilet flush.

In the step S202, a processor 801 obtains a first time difference between a first time when an upper float is triggered by the water and a second time when a lower float is triggered by the water in turn.

Specifically, an upper float A and a lower float B are disposed in a tank. A controlling circuit is provided with the signals to measure a time difference between the first and second times when the upper float A and the lower float B are triggered by the water.

In the step S203, the processor 801 calculates a tank flow velocity by using a volume between the upper float and the lower float and the first time difference.

Specifically, the time difference $T_{AB}$ is determined according to the first time when the upper float A is triggered by water and the second time when the lower float B is triggered by water. $Q_2$ is calculated according to $T_{AB}$. $Q_2$ represents a tank flow velocity, at which the water leaves from the tank within a time unit. For example, if the volume of the water when the floats A and B are triggered is set as $V_{tk}$, then Equation 1 may be obtained: $Q_2=V_{tk}/T_{AB}$.

In the step S204, the processor 801 obtains a functional equation indicating a relationship between the tank flow velocity and the jet flow velocity.

Specifically, the functional equation indicating the relationship between the tank flow velocity and the jet flow velocity is predetermined through an experiment or a theory.

In the step S205, the processor 801 obtains the jet flow velocity by substituting the tank flow velocity into the functional equation.

According to the predetermined functional equation indicating the relationship between the jet flow velocity $Q_1$ and the tank flow velocity $Q_2$, the jet flow velocity $Q_1$ is obtained from the tank flow velocity $Q_2$. The functional equation may be calculated through an experiment or a theory. For example, in a data fitting method, multiple experiments may be conducted in a laboratory to measure the jet flow velocity and the tank flow velocity. Thus, after the data fitting, the functional equation may be obtained from the multiple jet flow velocities and the multiple tank flow velocities.

In one embodiment, $Q_1$ and $Q_2$ has a following relationship: when $Q_2<A_1$, the toilet is determined to be in a non-working state. It is estimated that $Q_1<B_1$ and thus it is theoretically determined that $Q_1=C_1$ as a constant. When $A_1\leq Q_2<A_2$, the toilet is determined to be in a working state. It is estimated that $Q_1<B_2$ and thus it is theoretically determined that $Q_1=C_2*Q_2*Q_2$ (Equation 2). When $A_2\leq Q_2$, the toilet is determined to be not within the design range and thus it is concluded that the sensor is damaged. $Q_1$, $Q_2$, $A_1$, $A_2$, $C_1$, and $C_2$ are, for example, measured by liters per minute (L/Min).

In the step S206, the processor 801 measures a performed water supply duration and calculates an amount of supplied water according to the jet flow velocity, the tank flow velocity, and the performed water supply duration.

In the step S207, the processor 801 calculates a continued water supply duration according to the amount of the supplied water and the target amount of the water supply as requested.

A duration for water that should be supplied to the bowl part or bowl rim in the current toilet flush is calculated according to the above result. Specifically, the processor 801 measures a water supply duration that has been performed in a first phase $T_{v1}$ before determining the tank flow velocity. Ti is used as the performed water supply duration. The performed water supply duration may be measured by a timer. Here, $T_{v1}$ includes the time difference $T_{AB}$ between the first and second times when the upper float A and the lower float B are triggered by the water in turn. $T_{v1}$ also includes the time difference between times when the water supply commences and the upper float A is triggered by the water. This is resulted from the control delay when the water supply commences. Thus, the water level in the tank is usually higher than the height of the upper float A before the toilet flush. The amount of the supplied water $V_1$ to the bowl part or bowl rim before the lower float is triggered is estimated according to the performed water supply duration. For example, $V_1$ may be obtained from the formula for Equation 3: $V_1=(Q_1+Q_2)*T_{v1}$, wherein $Q_1$ and $Q_2$ may be obtained by the step S203 and the step S205.

Figure 30:
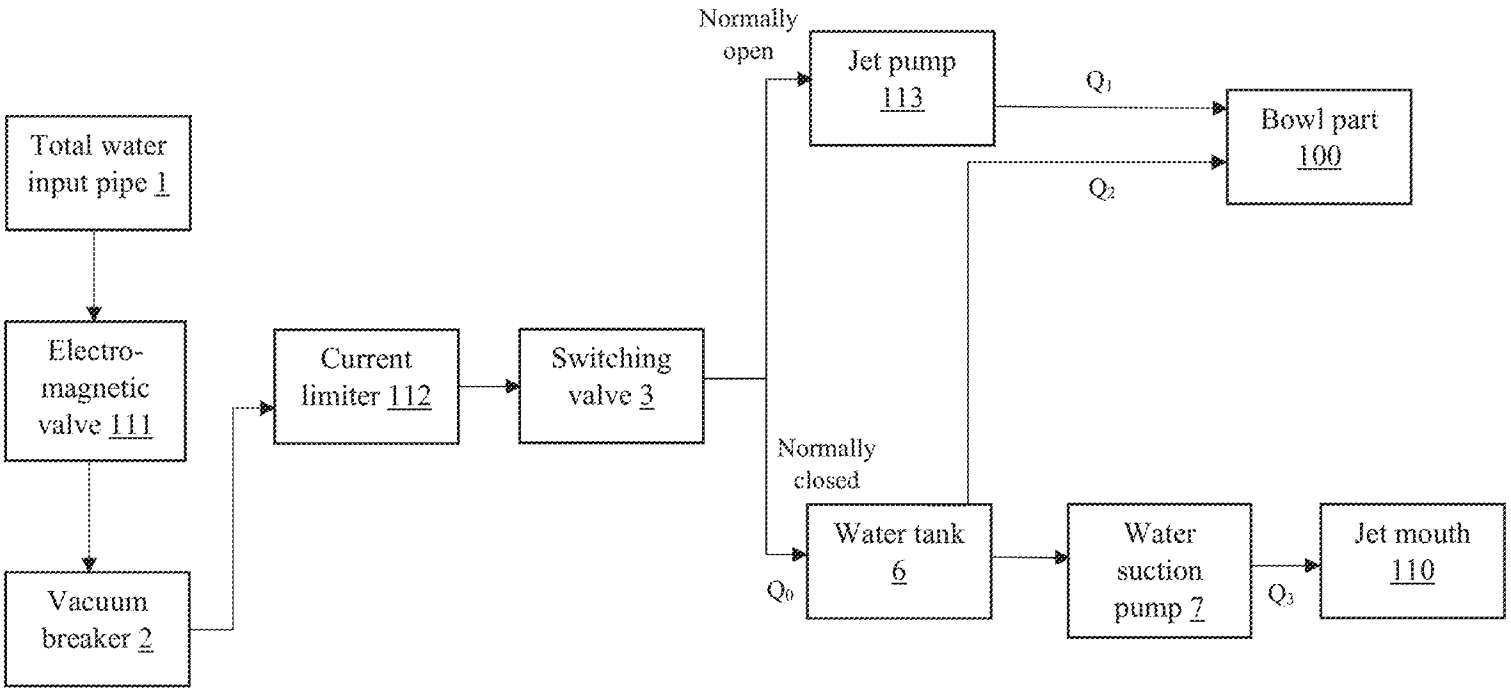
FIG. 30 illustrates a structure of a toilet having a jet pump.

In one embodiment as illustrated in FIG. 30, $T_{v1}$ refers to the duration between times when the tank water is driven by the jet water to leave the tank 37 and when the water level declines and triggers the lower float B. The jet water flows from a jet flow electromagnetic valve 111 and a jet pump 113.

In the step S208, the processor 801 calculates the target water supply duration according to the performed water supply duration and the continued water supply duration.

Specifically, the processor 801 obtains an amount of water supply continued to be supplied to the bowl part or bowl rim in a second phase $V_2$ by using an amount of desired water supply (i.e. the calibrated water amount) minus the amount of supplied water $V_1$ to the bowl part or bowl rim in the first phase $V_1$, i.e. Equation 4: $V_2=V_0-V_1$ may be obtained. For example, according to the different water flush request: $V_0=N_1$ if the requested water flush is large while $V_0=N_2$ if the requested water flush is small. $V_0$, $V_1$, $V_2$, $N_1$, and $N_2$ are, for example, measured by L.

The continued water supply duration is calculated according to the amount of the water supply continued to be supplied to the bowl part or bowl rim $V_2$, the jet flow velocity $Q_1$, and the tank flow velocity $Q_2$. For example, Equation 5: $t=V_2/(Q_1+Q_2)$ may be obtained.

In the step S209, the processor 801 controls the jet pump to supply the water according to the target water supply duration.

Specifically, the processor 801 controls a duration to convey the water from a pressurized water source by using a circuit and a software-controlled system according to $T_{v1}$ and t.

According to this embodiment, the tank flow velocity may be accurately measured by the upper float and the lower float. The jet flow velocity may be obtained via a functional equation indicating the relationship between the jet flow velocity and the tank flow velocity. Because the second water stream is driven by the first water stream, the tank flow velocity and the jet flow velocity have a predetermined relationship. Accordingly, directly obtaining the jet flow velocity by using the predetermined functional equation may reduce the costs for controlling the jet flow velocity. Ultimately, the continued water supply duration is determined according to the performed water supply duration. Thus, the toilet water consumption may be precisely controlled to avoid the fluctuation of toilet flush function.

Third Embodiment

Figure 23:
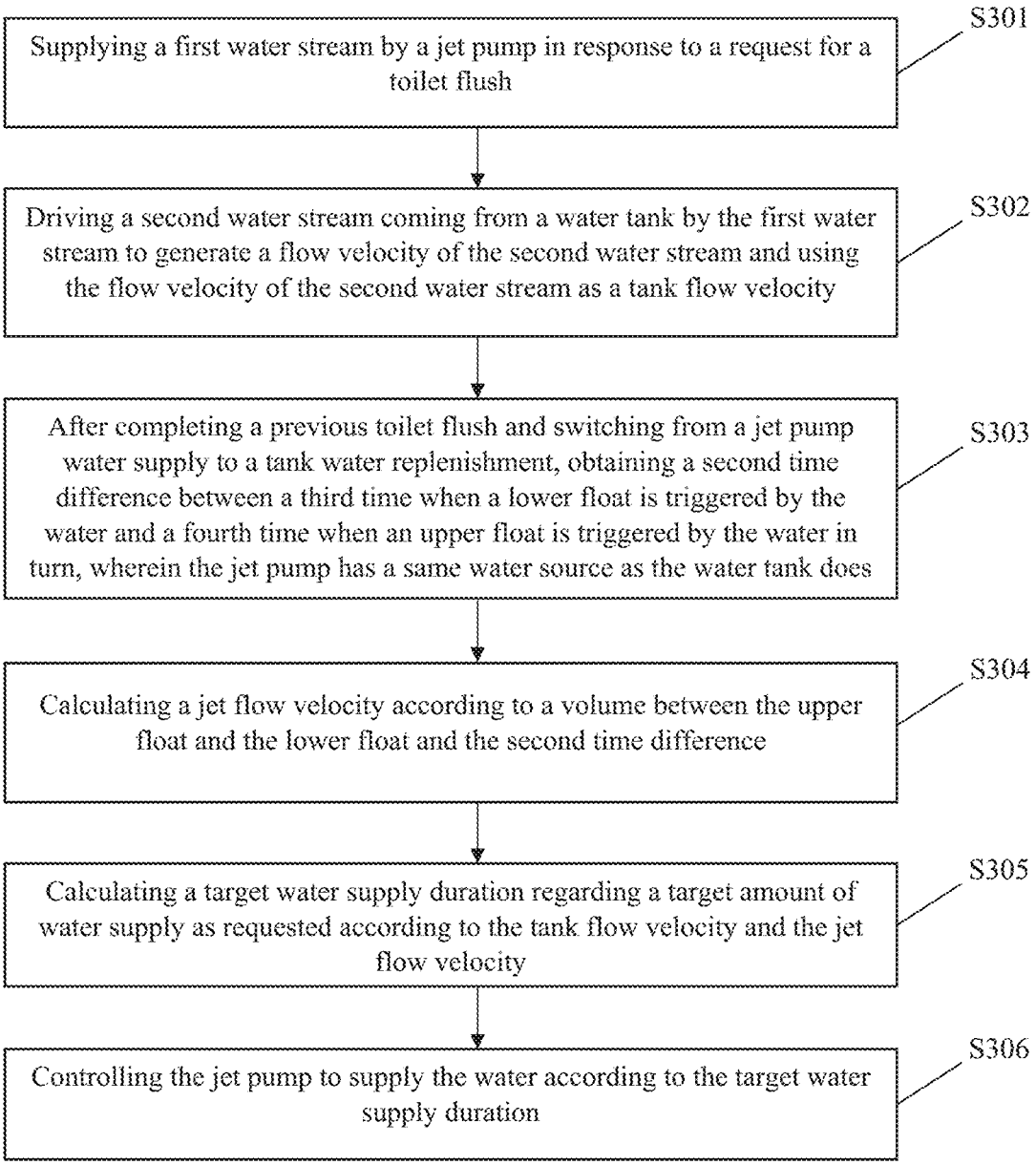
FIG. 23 is a flow chart illustrating a method for controlling toilet water consumption according to the third embodiment of the present disclosure.

FIG. 23 is a flow chart illustrating a method for controlling toilet water consumption according to the third embodiment of the present disclosure. Please also refer to FIG. 28. FIG. 28 illustrates a hardware configuration for use in a device for controlling toilet water consumption according to one embodiment of the present disclosure. The method comprises steps of:

In the step S301, a jet pump supplies a first water stream in response to a request for a toilet flush.

In the step S302, the first water stream drives a second water stream coming from a tank to generate a flow velocity of the second water stream and a processor 801 uses the flow velocity of the second water stream as a tank flow velocity.

In the step S303, after completing a previous toilet flush and switching from a jet pump water supply to a tank water replenishment, the processor 801 obtains a second time difference between a third time when a lower float is triggered by the water and a fourth time when an upper float is triggered by the water in turn, wherein the jet pump has a same water source as the tank does.

In the step S304, the processor 801 calculates a jet flow velocity according to a volume between the upper float and the lower float and the second time difference.

Specifically, because the jet pump has the same water source as the tank does, after the previous toilet flush, the flow velocity of tank water replenishment/supply may be $Q_0 \approx Q_1$. In one embodiment as illustrated in FIG. 30, when opening a jet flow electromagnetic valve 111, a main water stream enters from the jet flow electromagnetic valve 111 to a vacuum breaker 2 and a current limiter 112. A switching valve 3 switches to supply the water to a jet pump 113 or replenish/supply the water to a water tank 6. Thus, the jet pump 113 has the same water source as the tank does. Accordingly, the flow velocity of the water coming from the jet pump 113 is close to or substantially equal to that of the water entering the water tank 6. Here, the word "previous" means previous one time or previous several times. The second time difference may be obtained after a previous toilet flush is completed and the water supplied to the jet pump 113 is switched to replenish the tank. The second time difference is the difference between a third time when a lower float is triggered by the water and a fourth time when an upper float is triggered by the water in turn. Alternatively, the second time difference may be obtained after previous several toilet flushes and the water supplied to the jet pump 113 is switched to replenish the tank. The second time difference is an average value or a weighted value of the differences between the first and second times when a lower float and an upper float are triggered by the water in turn.

After the previous toilet flush is completed and the water is replenished/supplied to the tank, the second time difference $T_{BA}$ is sensed when the lower float and the upper float are triggered by the water in turn. Thus, the flow velocity of the water entering the tank $Q_0$ may be calculated. In one embodiment, Equation 6: $Q_0=V_{tk}/T_{BA}$ may be obtained. The jet flow velocity $Q_1$ is estimated from $Q_0$ for use in the current toilet flush.

In the step S305, the processor 801 calculates a target water supply duration regarding a target amount of water supply as requested according to the tank flow velocity and the jet flow velocity.

In the step S306, the processor 801 controls the jet pump to supply the water according to the target water supply duration.

This embodiment uses the time difference to calculate the flow velocity of the water entering the tank in the previous toilet flush $Q_0$. After the previous toilet flush is completed and the water supplied to the jet pump is switched to replenish the tank, the time difference is obtained between a first time when a lower float is triggered by the water and a second time when an upper float is triggered by the water in turn. Using $Q_0$ as the jet flow velocity in the current toilet flush may reduce the time to measure the tank flow velocity and thus the toilet water consumption may be determined more quickly.

Fourth Embodiment

Figure 24:
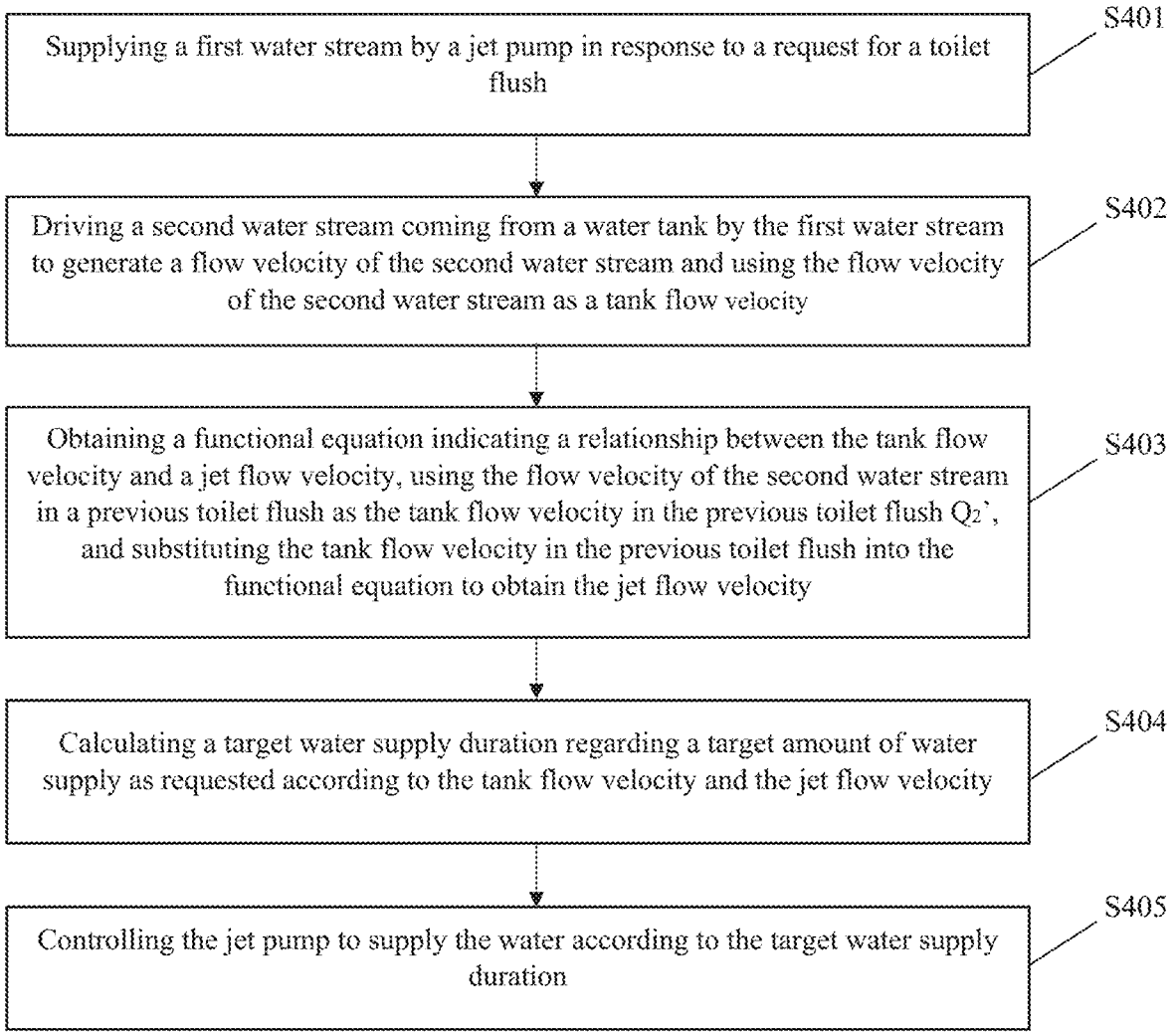
FIG. 24 is a flow chart illustrating a method for controlling toilet water consumption according to the fourth embodiment of the present disclosure.

FIG. 24 is a flow chart illustrating a method for controlling toilet water consumption according to the fourth embodiment of the present disclosure. Please also refer to FIG. 28. FIG. 28 illustrates a hardware configuration for use in a device for controlling toilet water consumption according to one embodiment of the present disclosure. The method comprises steps of:

In the step S401, a jet pump supplies a first water stream in response to a request for a toilet flush.

In the step S402, the first water stream drives a second water stream coming from a tank to generate a flow velocity of the second water stream and a processor 801 uses the flow velocity of the second water stream as a tank flow velocity.

In the step S403, the processor 801 obtains a functional equation indicating a relationship between the tank flow velocity and a jet flow velocity. The processor 801 uses the flow velocity of the second water stream in a previous toilet flush as the tank flow velocity in the previous toilet flush. The processor 801 substitutes the tank flow velocity in the previous toilet flush into the functional equation to obtain the jet flow velocity.

According to a predetermined functional equation F indicating the relationship between the tank flow velocity and the jet flow velocity (calculated through an experiment or a theory), the jet flow velocity in the current toilet flush is estimated from the tank flow velocity in the previous toilet flush $Q_2'$.

Here, the word "previous" means previous one time or previous several times. The flow velocity of the second water stream in the previous toilet flush is used as the tank flow velocity in the previous toilet flush to calculate the jet flow velocity in the current toilet flush. Alternatively, an average value or a weighted value of the flow velocities of the second water stream in the previous several toilet flushes is used as the tank flow velocity in the previous toilet flush to calculate the jet flow velocity in the current toilet flush.

In the step S404, the processor 801 calculates a target water supply duration regarding a target amount of water supply as requested according to the tank flow velocity and the jet flow velocity.

In the step S405, the processor 801 controls the jet pump to supply the water according to the target water supply duration.

This embodiment uses the tank flow velocity in a previous toilet flush to calculate the jet flow velocity in the current toilet flush. This may reduce the time to measure the tank flow velocity and thus determine the toilet water consumption more quickly.

Fifth Embodiment

Figure 25:
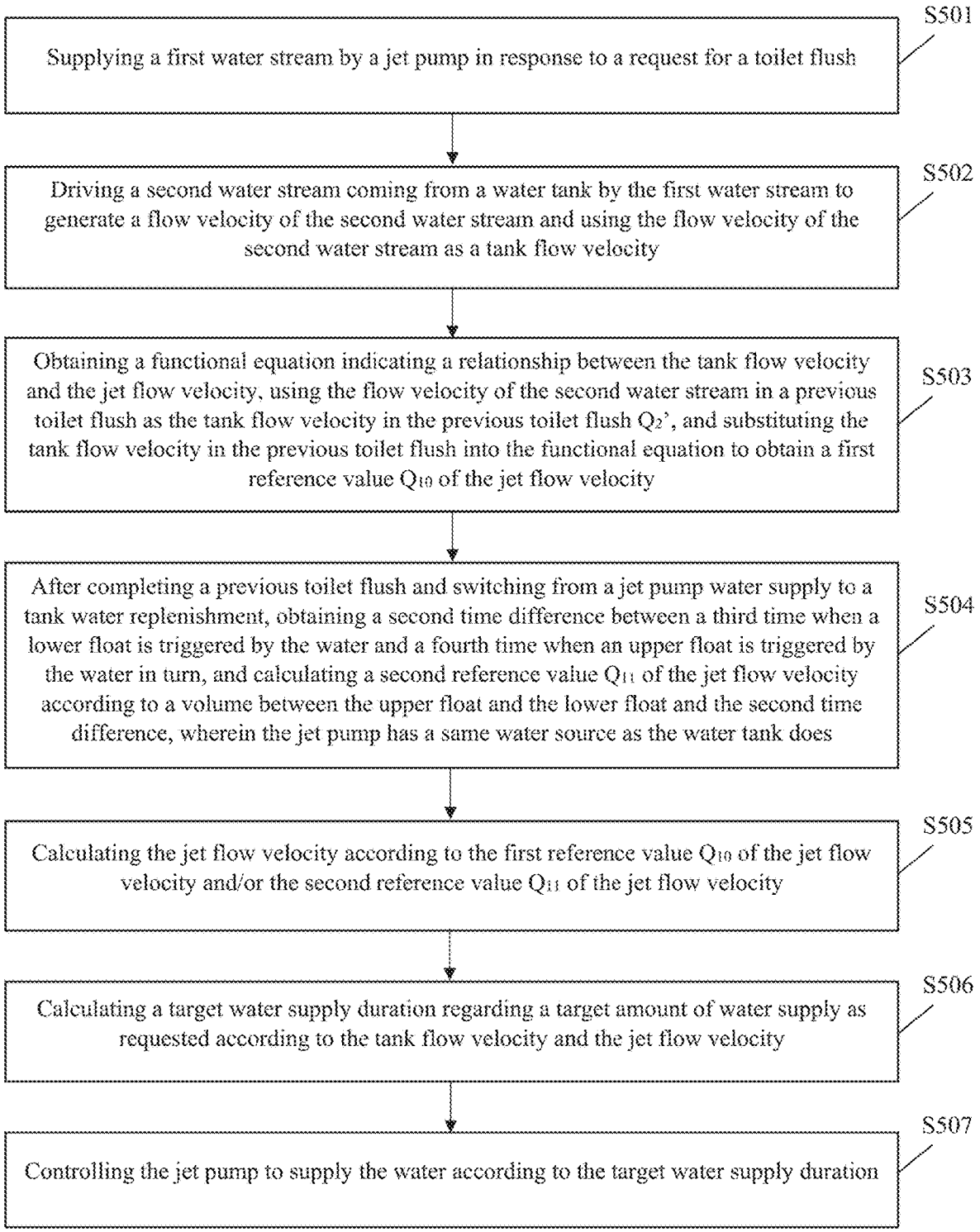
FIG. 25 is a flow chart illustrating a method for controlling toilet water consumption according to the fifth embodiment of the present disclosure.

FIG. 25 is a flow chart illustrating a method for controlling toilet water consumption according to the fifth embodiment of the present disclosure. Please also refer to FIG. 28. FIG. 28 illustrates a hardware configuration for use in a device for controlling toilet water consumption according to one embodiment of the present disclosure. The method comprises steps of:

In the step S501, a jet pump supplies a first water stream in response to a request for a toilet flush.

In the step S502, the first water stream drives a second water stream coming from a tank to generate a flow velocity of the second water stream and a processor 801 uses the flow velocity of the second water stream as a tank flow velocity.

In the step S503, the processor 801 obtains a functional equation indicating a relationship between the tank flow velocity and the jet flow velocity. The processor 801 uses the flow velocity of the second water stream in a previous toilet flush as the tank flow velocity in the previous toilet flush. The processor 801 substitutes the tank flow velocity in the previous toilet flush into the functional equation to obtain a first reference value of the jet flow velocity.

According to a predetermined functional equation F indicating the relationship between the tank flow velocity and the jet flow velocity (calculated through an experiment or a theory), the first reference value of the jet flow velocity in the current toilet flush $Q_{10}$ is estimated from the tank flow velocity in the previous toilet flush $Q_2'$.

Here, the word "previous" means previous one time or previous several times. The flow velocity of the second water stream in the previous toilet flush is used as the tank flow velocity in the previous toilet flush to calculate the first reference value of the jet flow velocity in the current toilet flush $Q_{10}$. Alternatively, an average value or a weighted value of the flow velocities of the second water stream in the previous several toilet flushes is used as the tank flow velocity in the previous toilet flush to calculate the first reference value of the jet flow velocity in the current toilet flush $Q_{10}$.

In the step S504, after completing a previous toilet flush and switching from a jet pump water supply to a tank water replenishment, the processor 801 obtains a second time difference between a third time when a lower float is triggered by the water and a fourth time when an upper float is triggered by the water in turn. The processor 801 calculates a second reference value of the jet flow velocity according to a volume between the upper float and the lower float and the second time difference, wherein the jet pump has a same water source as the tank does.

After the previous toilet flush and the water is replenished/supplied to the tank, the second time difference $T_{BA}$ is sensed when the lower float and the upper float are triggered by the water in turn. Thus, the flow velocity of the water entering the tank $Q_0$ may be calculated. In one embodiment, Equation 6: $Q_0=V_{tk}/T_{BA}$ may be obtained. The second reference value of the jet flow velocity $Q_{11}$ is estimated from $Q_0$ for use in the current toilet flush.

Here, the word "previous" means previous one time or previous several times. The flow velocity of the water entering the tank after the previous toilet flush is used to calculate the second reference value of the jet flow velocity in the current toilet flush $Q_{11}$. Alternatively, an average value or a weighted value of the flow velocities of the water entering the tank after the previous several toilet flushes is used to calculate the second reference value of the jet flow velocity in the current toilet flush $Q_{11}$.

In the step S505, the processor 801 calculates the jet flow velocity according to the first reference value of the jet flow velocity and/or the second reference value of the jet flow velocity.

The first reference value of the jet flow velocity $Q_{10}$ and the second reference value of the jet flow velocity $Q_{11}$ mutually correct each other. For example, an average value, a weighted average value, a maximum value, or a minimum value of the foregoing values is used as a theoretically approximation of the jet flow velocity in the current toilet flush $Q_1$.

In the step S506, the processor 801 calculates a target water supply duration regarding a target amount of water supply as requested according to the tank flow velocity and the jet flow velocity.

In the step S507, the processor 801 controls the jet pump to supply the water according to the target water supply duration.

This embodiment uses a first reference value of the jet flow velocity and a second reference value of the jet flow velocity to calculate the jet flow velocity. This may reduce the time to measure the tank flow velocity, determine the toilet water consumption more quickly, and improve the accuracy of the estimation for the jet flow velocity.

Sixth Embodiment

Figure 26:
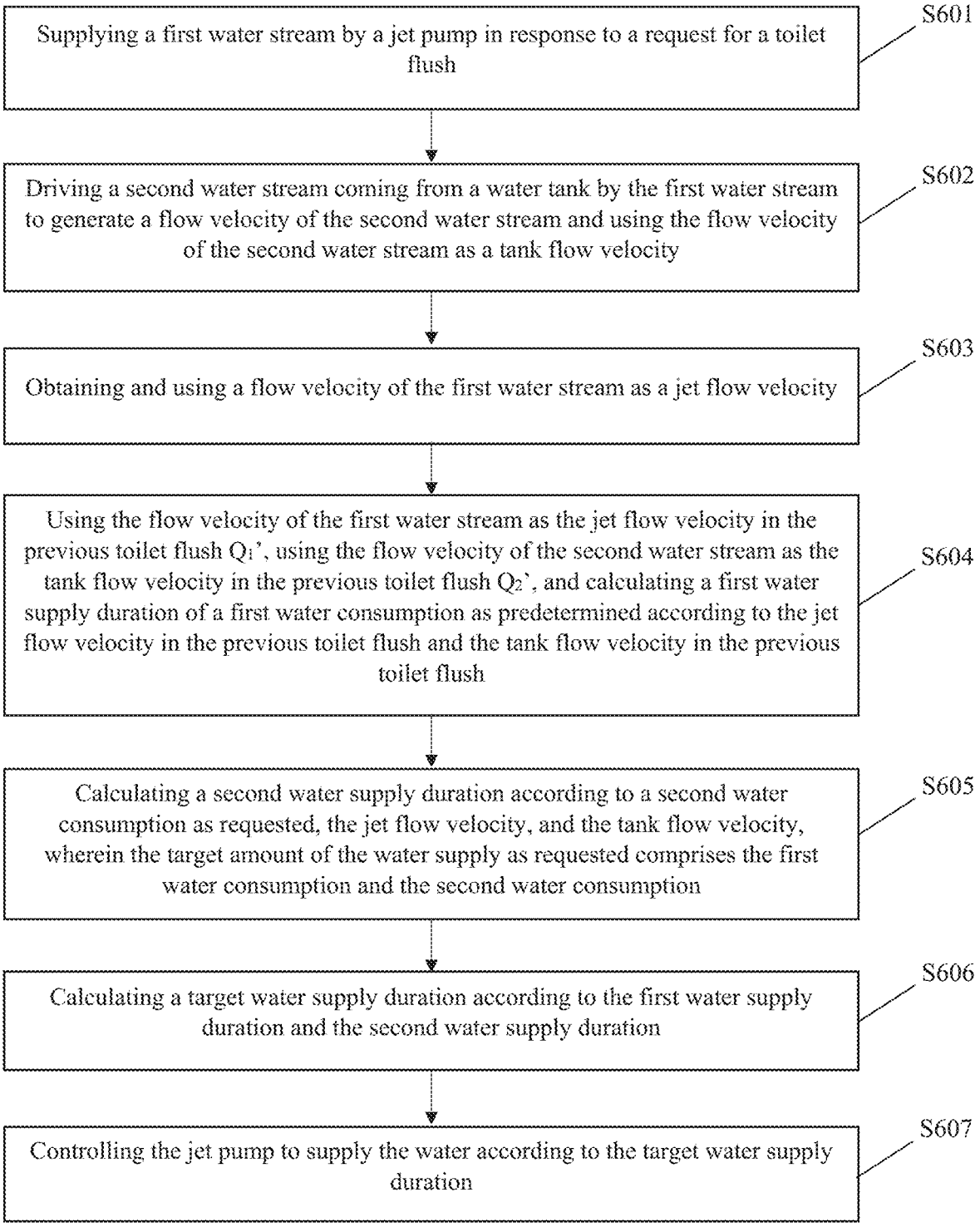
FIG. 26 is a flow chart illustrating a method for controlling toilet water consumption according to the sixth embodiment of the present disclosure.

FIG. 26 is a flow chart illustrating a method for controlling toilet water consumption according to the sixth embodiment of the present disclosure. Please also refer to FIG. 28. FIG. 28 illustrates a hardware configuration for use in a device for controlling toilet water consumption according to one embodiment of the present disclosure. The method comprises steps of:

In the step S601, a jet pump supplies a first water stream in response to a request for a toilet flush.

In the step S602, the first water stream drives a second water stream coming from a tank to generate a flow velocity of the second water stream and a processor 801 uses the flow velocity of the second water stream as a tank flow velocity.

In the step S603, the processor 801 obtains and uses a flow velocity of the first water stream as a jet flow velocity.

In the step S604, the processor 801 uses the flow velocity of the first water stream as the jet flow velocity in the previous toilet flush. The processor 801 uses the flow velocity of the second water stream as the tank flow velocity in the previous toilet flush. The processor 801 calculates a first water supply duration of a first water consumption as predetermined according to the jet flow velocity in the previous toilet flush and the tank flow velocity in the previous toilet flush.

Specifically, at least one definite duration $t_1$ is obtained from at least a portion of the desired water coming from the jet pump in the current toilet flush $V_{d1}$ (i.e. the first water consumption), the jet flow velocity in the previous toilet flush or the previous several toilet flushes $Q_1'$, and the tank flow velocity in the previous toilet flush or the previous several toilet flushes $Q_2'$, i.e. Equation 7: $t_1=V_{d1}/(Q_1'+Q_2')$ may be obtained.

In the step S605, the processor 801 calculates a second water supply duration according to a second water consumption as requested, the jet flow velocity, and the tank flow velocity, wherein the target amount of the water supply as requested comprises the first water consumption and the second water consumption.

Specifically, at least one definite duration $t_2$ is obtained from at least a portion of the desired water coming from the jet pump in the current toilet flush $V_{d2}$ (i.e. the second water consumption), the jet flow velocity in the current toilet flush $Q_1$, and the tank flow velocity in the current toilet flush $Q_2$.

In the step S606, the processor 801 calculates a target water supply duration according to the first water supply duration and the second water supply duration.

Specifically, a water supply duration to the jet pump in the current toilet flush is calculated according to or based on at least one of $t_1$ and $t_2$.

In the step S607, the processor 801 controls the jet pump to supply the water according to the target water supply duration.

This embodiment uses the previous toilet flush or the previous toilet flushes to calculate the water supply duration to the jet pump in the current toilet flush. This may determine the toilet water consumption more quickly and improve the accuracy of the estimation for the water consumption in the current toilet flush.

Seventh Embodiment

Figure 27:
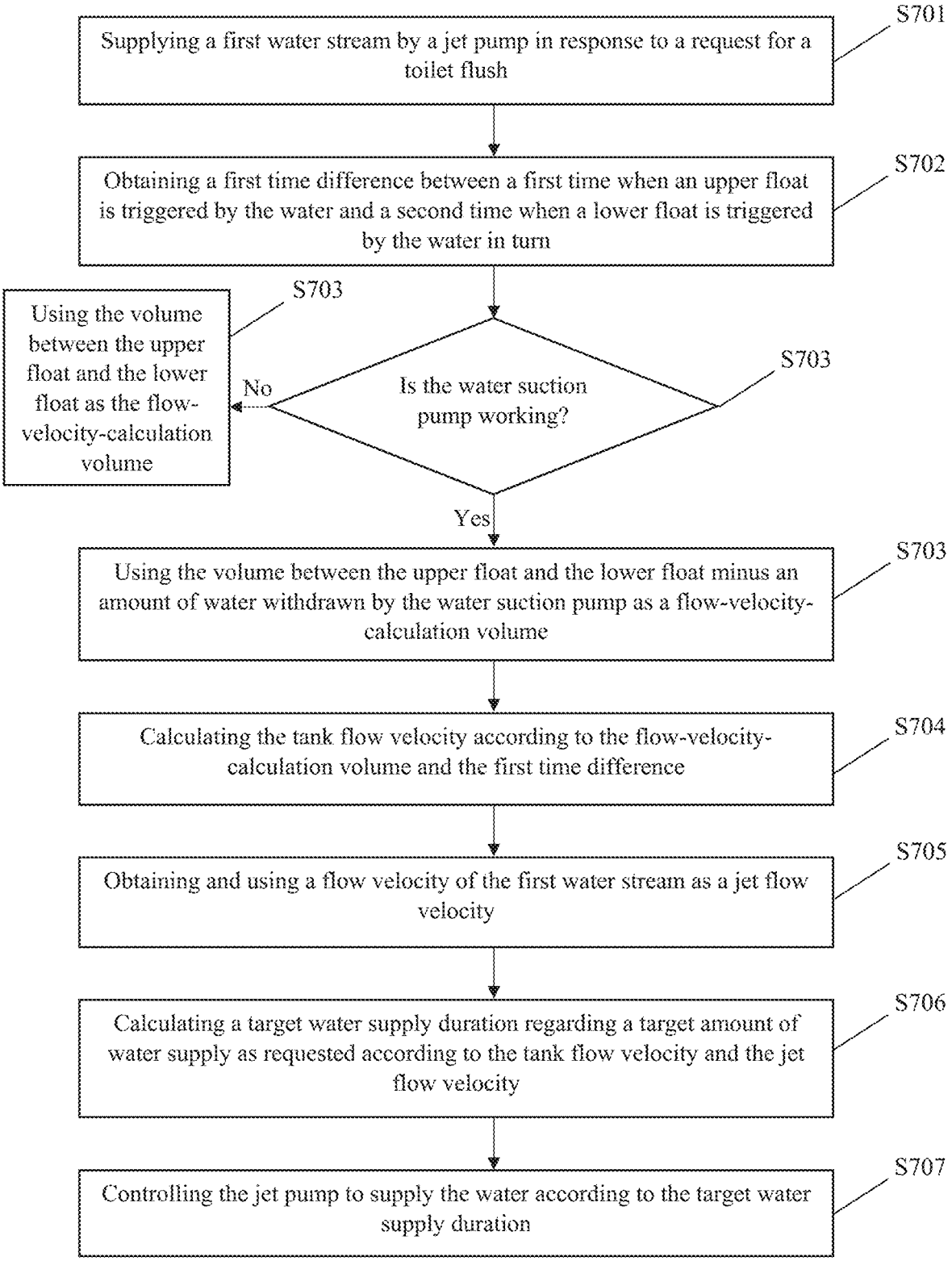
FIG. 27 is a flow chart illustrating a method for controlling toilet water consumption according to the seventh embodiment of the present disclosure.

FIG. 27 is a flow chart illustrating a method for controlling toilet water consumption according to the seventh embodiment of the present disclosure. Please also refer to FIG. 28. FIG. 28 illustrates a hardware configuration for use in a device for controlling toilet water consumption according to one embodiment of the present disclosure. The method comprises steps of:

In the step S701, a jet pump supplies a first water stream in response to a request for a toilet flush.

In the step S702, a processor 801 obtains a first time difference between a first time when an upper float is triggered by the water and a second time when a lower float is triggered by the water in turn.

In the step S703, the processor 801 uses the volume between the upper float and the lower float minus an amount of water withdrawn by a water suction pump as a flow-velocity-calculation volume when the water suction pump withdraws the water during the first time difference (i.e. when the upper float and the lower float are triggered by the water in turn). Alternatively, the processor 801 uses the volume between the upper float and the lower float as the flow-velocity-calculation volume when the water suction pump does not withdraw the water during the first time difference.

In the step S704, the processor 801 calculates the tank flow velocity according to the flow-velocity-calculation volume and the first time difference.

In the step S705, the processor 801 obtains and uses a flow velocity of the first water stream as a jet flow velocity.

In the step S706, the processor 801 calculates a target water supply duration regarding a target amount of water supply as requested according to the tank flow velocity and the jet flow velocity.

In the step S707, the processor 801 controls the jet pump to supply the water according to the target water supply duration.

Figure 31:
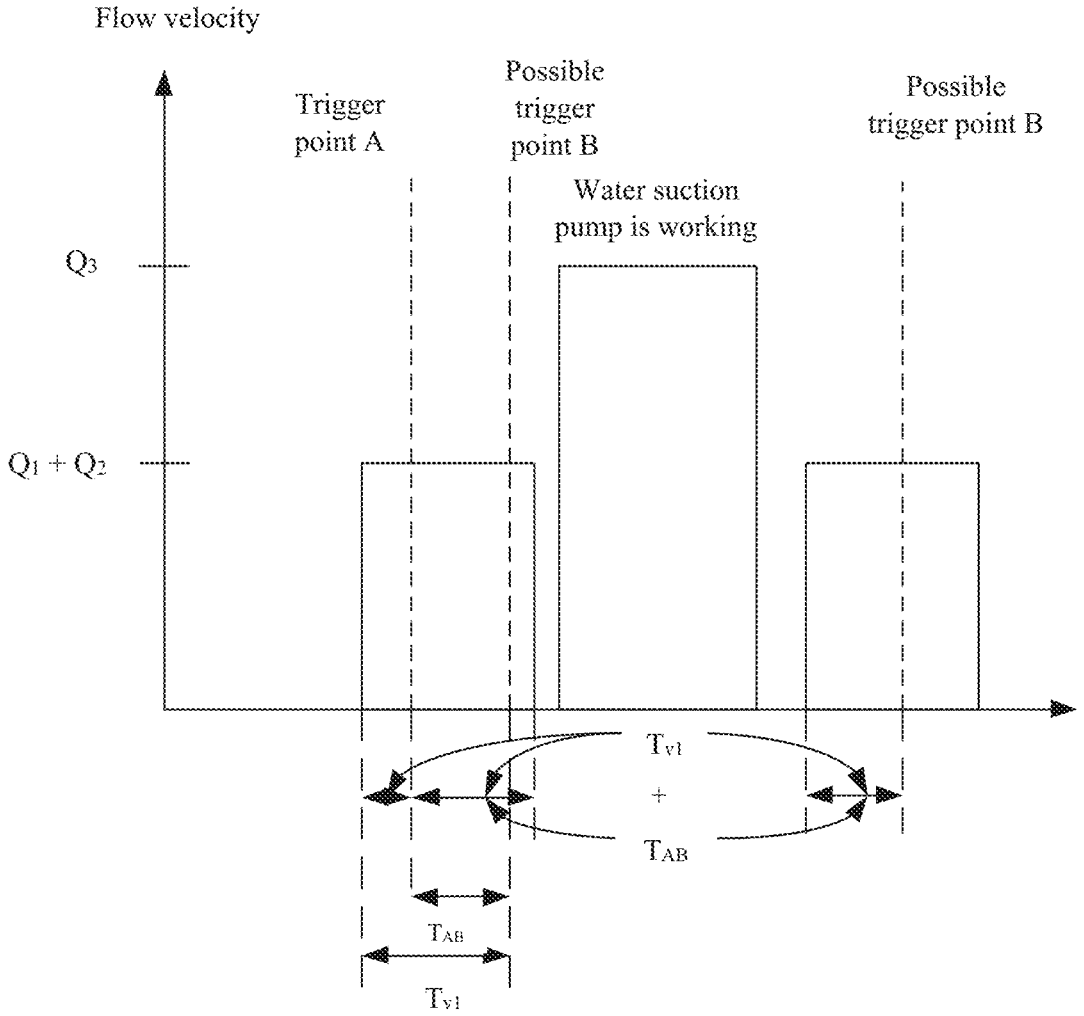
FIG. 31 illustrates the first situation where the flush water level declines from an upper float at the position A to a lower float at the position B while a jet pump is spouting the flush water.
Figure 32:
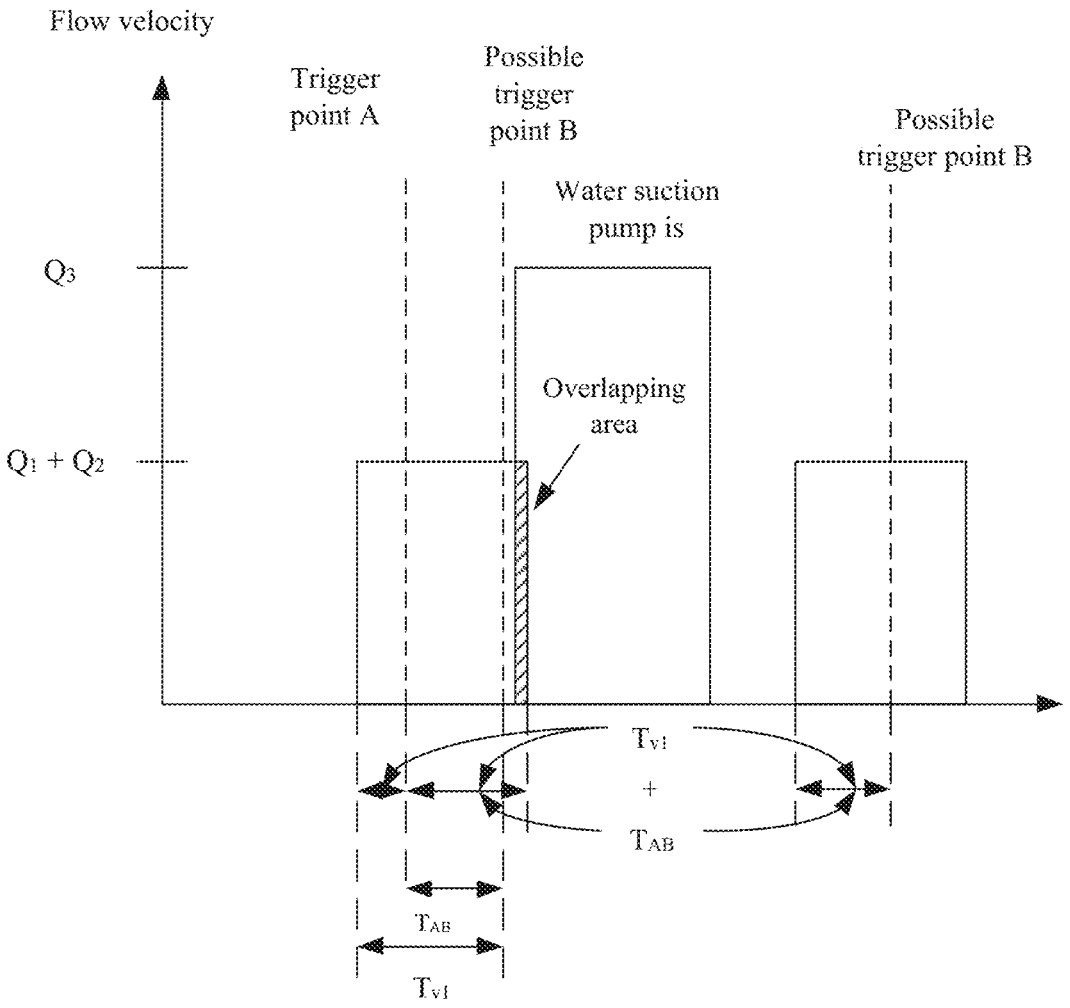
FIG. 32 illustrates the second situation where the flush water level declines from an upper float at the position A to a lower float at the position B while a jet pump is spouting the flush water.
Figure 33:
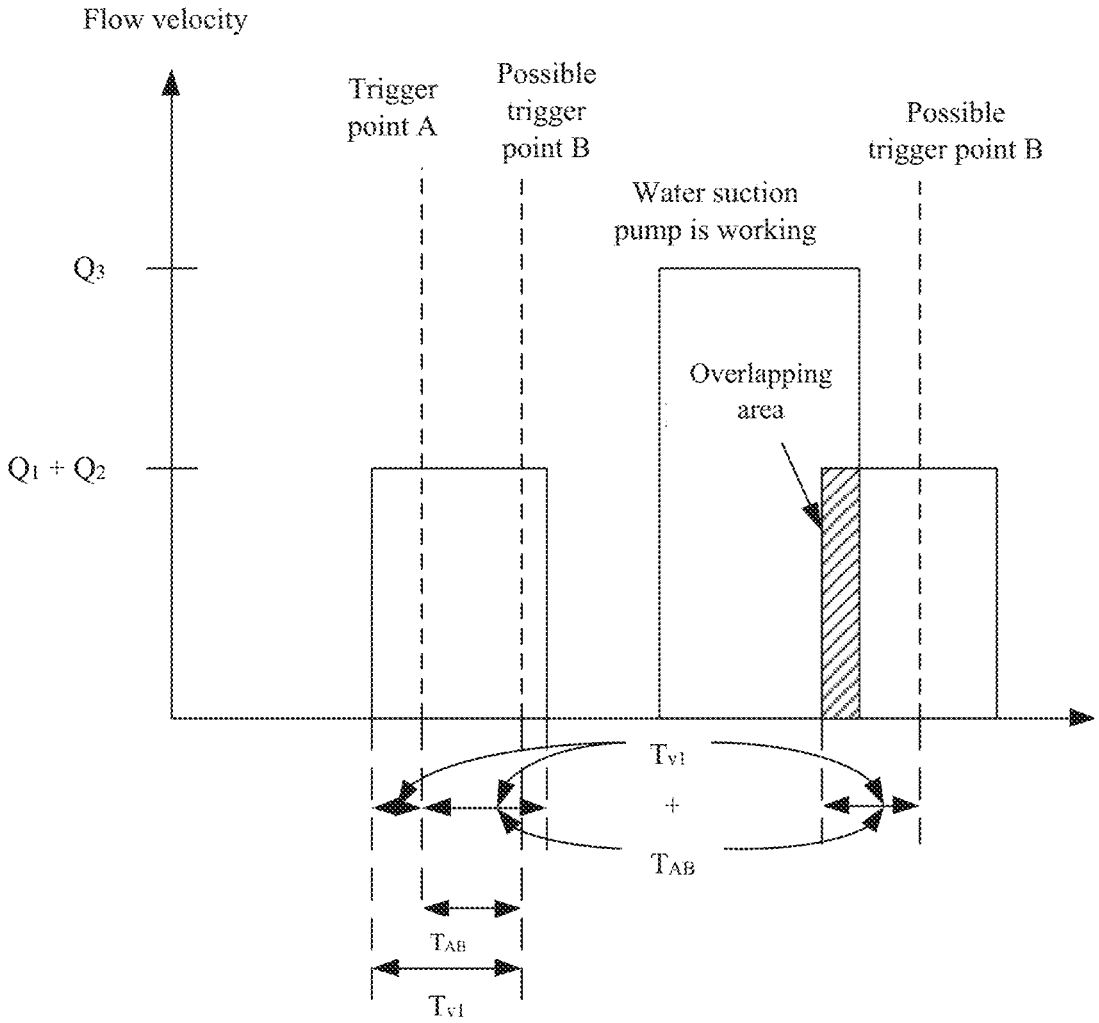
FIG. 33 illustrates the third situation where the flush water level declines from an upper float at the position A to a lower float at the position B while a jet pump is spouting the flush water.
Figure 34:
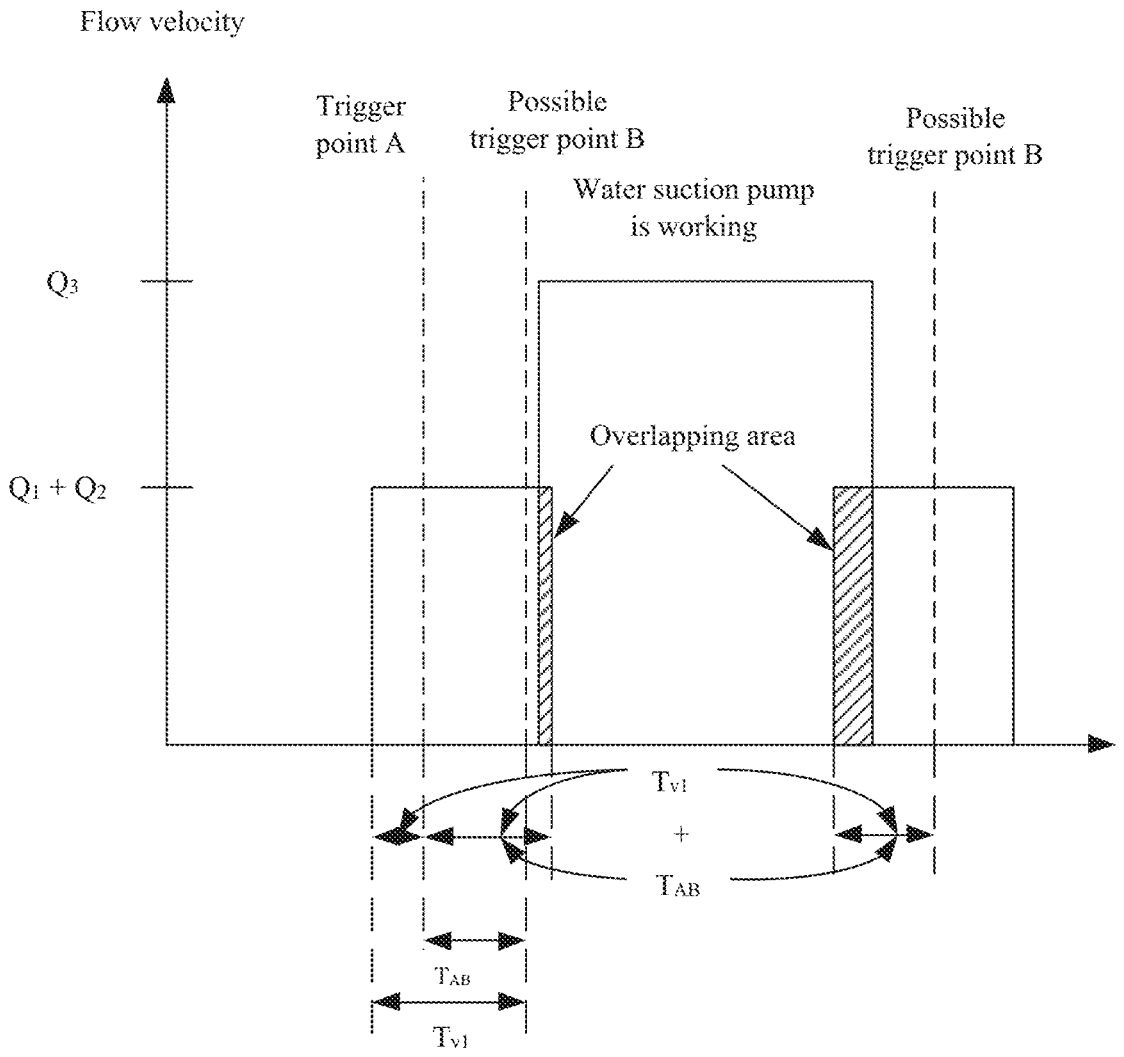
FIG. 34 illustrates the fourth situation where the flush water level declines from an upper float at the position A to a lower float at the position B while a jet pump is spouting the flush water.
Figure 35:
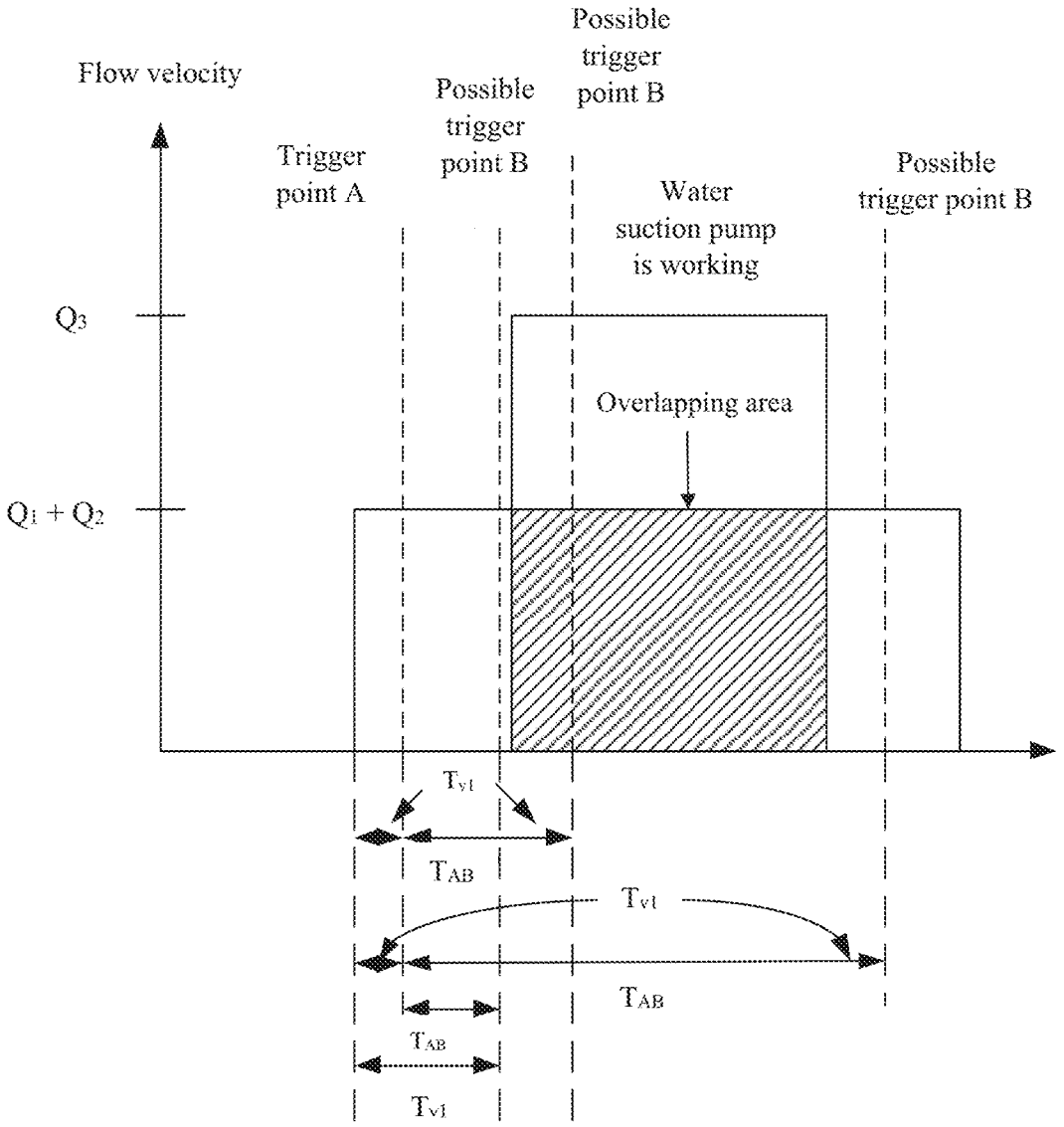
FIG. 35 illustrates the fifth situation where the flush water level declines from an upper float at the position A to a lower float at the position B while a jet pump is spouting the flush water.
Figure 36:
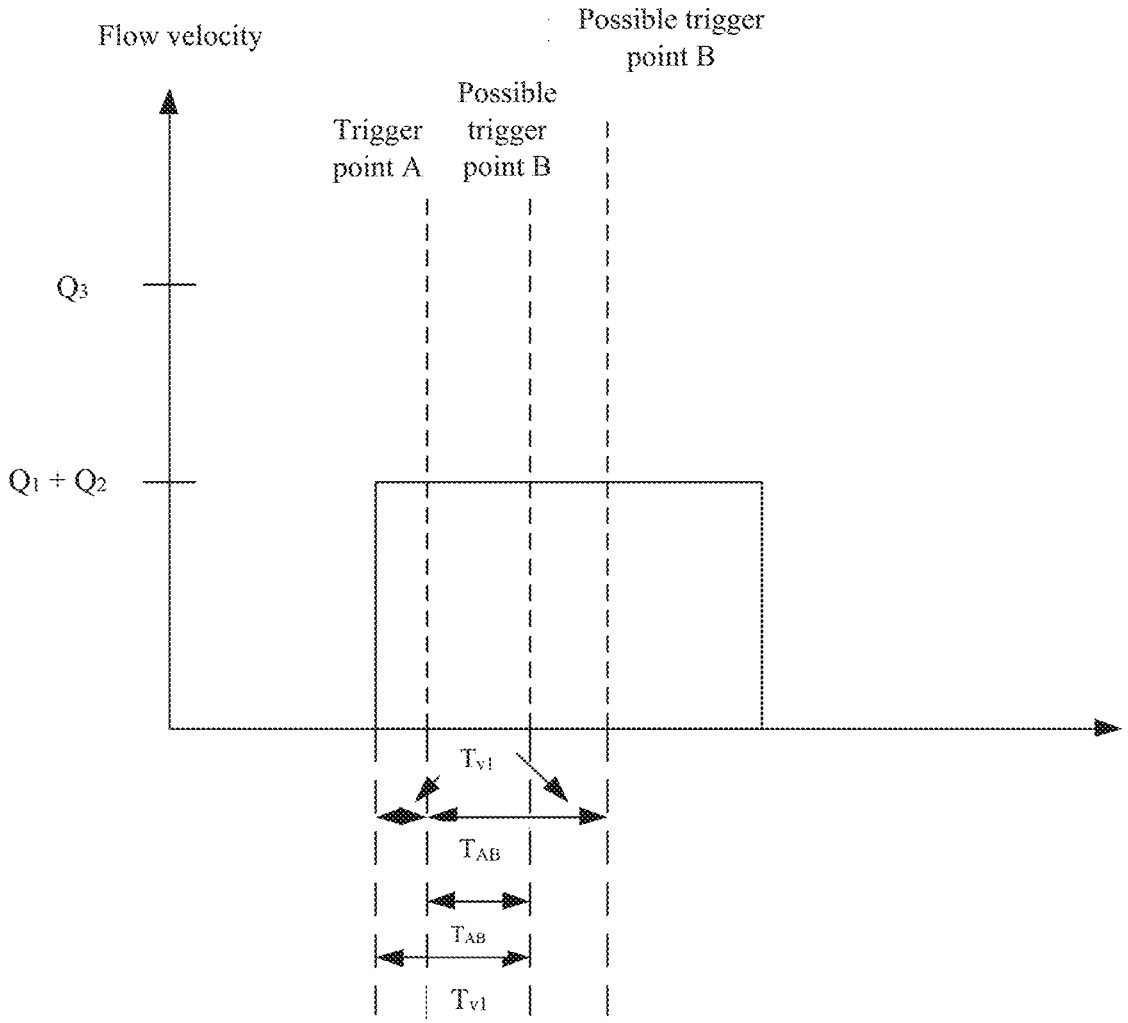
FIG. 36 illustrates a situation where the flush water level declines from an upper float at the position A to a lower float at the position B while a jet pump is not spouting the flush water.

Please refer to FIG. 31 to FIG. 36. FIG. 31 illustrates the first situation where the flush water level declines from an upper float at the position A to a lower float at the position B while a jet pump is spouting the flush water. FIG. 32 illustrates the second situation where the flush water level declines from an upper float at the position A to a lower float at the position B while a jet pump is spouting the flush water. FIG. 33 illustrates the third situation where the flush water level declines from an upper float at the position A to a lower float at the position B while a jet pump is spouting the flush water. FIG. 34 illustrates the fourth situation where the flush water level declines from an upper float at the position A to a lower float at the position B while a jet pump is spouting the flush water. FIG. 35 illustrates the fifth situation where the flush water level declines from an upper float at the position A to a lower float at the position B while a jet pump is spouting the flush water. FIG. 36 illustrates a situation where the flush water level declines from an upper float at the position A to a lower float at the position B while a jet pump is not spouting the flush water.

During $T_{AB}$ when the upper float and the lower float are triggered, the flush water level in the tank declines from the upper float at the position A to the lower float at the position B. The water suction pump connecting to a jet mouth JET might be powered on for a certain amount of time and thus withdraws a certain volume of the water $V_p$ out of the tank. Therefore, while the water suction pump is working, the water suction pump withdraws the volume of the water $V_p$ out of the tank. Accordingly, the volume withdrawn by the water suction pump should be deducted to increase the calculation accuracy of the tank flow velocity.

Eighth Embodiment

FIG. 28 illustrates a hardware configuration used in a device for controlling toilet water consumption according to one embodiment of the present disclosure. Please also refer to FIG. 28. FIG. 28 illustrates a hardware configuration for use in a device for controlling toilet water consumption according to one embodiment of the present disclosure. The device comprises: at least one processor 801; and a memory 802 communicably coupled to the at least one processor 801, wherein the memory 802 stores instructions executable by the at least one processor 801 to perform the following steps: a jet pump supplies a first water stream in response to a request for a toilet flush; the first water stream drives a second water stream coming from a tank to generate a flow velocity of the second water stream and the first water stream uses the flow velocity of the second water stream as a tank flow velocity; the at least one processor 801 obtains and uses a flow velocity of the first water stream as a jet flow velocity; the first water stream calculates a target water supply duration regarding a target amount of water supply as requested according to the tank flow velocity and the jet flow velocity; and the first water stream controls the jet pump to supply the water according to the target water supply duration.

In one embodiment, the device comprises one processor 801. The device further comprises an input apparatus 803 and an output apparatus 804, e.g. display apparatus.

The processor 801, the memory 802, the input apparatus 803, and the output apparatus 804 are coupled to a main line (as shown in the figures) or connected by other methods.

The memory 802 may be a non-volatile computer readable medium to store non-volatile program or non-volatile computer executable program and module, e.g. program/module corresponding to the methods for controlling toilet water consumption as illustrated in FIG. 21 to FIG. 27. FIG. 21 is a flow chart illustrating a method for controlling toilet water consumption according to the first embodiment of the present disclosure. FIG. 22 is a flow chart illustrating a method for controlling toilet water consumption according to the second embodiment of the present disclosure. FIG. 23 is a flow chart illustrating a method for controlling toilet water consumption according to the third embodiment of the present disclosure. FIG. 24 is a flow chart illustrating a method for controlling toilet water consumption according to the fourth embodiment of the present disclosure. FIG. 25 is a flow chart illustrating a method for controlling toilet water consumption according to the fifth embodiment of the present disclosure. FIG. 26 is a flow chart illustrating a method for controlling toilet water consumption according to the sixth embodiment of the present disclosure. FIG. 27 is a flow chart illustrating a method for controlling toilet water consumption according to the seventh embodiment of the present disclosure. The processor 801 performs the functions and processes the data to control the toilet water consumption by running the programs, the instructions, and the modules stored on the memory 802.

The memory 802 comprises a program storage area and a data storage area. The software store area may store an operation system and at least one application program. The data storage area may store data for use in the method for controlling toilet water consumption. In addition, the memory 802 may comprise a high speed random access memory and a non-volatile memory, e.g. at least one magnetic disk storage device, a flash memory device, or other non-volatile solid state storage devices. In some embodiments, the memory 802 may comprise a memory remotely located relative to the processor 801. The remote memory may perform the method for controlling the toilet water consumption via a network. The embodiments of the network include, but are not limited to, the Internet, intranets, local area networks, mobile communication networks, and combinations thereof.

The input apparatus 803 may receive users' input and generate input signal according to users' setting regarding the toilet water consumption and the functions. The display apparatus 804 may comprise a screen.

When the at least one processor 802 runs one or several modules stored on the memory 802, the processor 802 implements the method for controlling the toilet water consumption according to any of the above embodiments.

Ninth Embodiment

Please refer to FIG. 28. FIG. 28 illustrates a hardware configuration for use in a device for controlling toilet water consumption according to one embodiment of the present disclosure. According to the ninth embodiment of the present disclosure, a device for controlling toilet water consumption comprises: at least one processor 801; and a memory 802 communicably coupled to the at least one processor 801, wherein the memory 802 stores instructions executable by the at least one processor 801 to perform the following steps:

A jet pump supplies a first water stream in response to a request for a toilet flush; the at least one processor 801 obtains a first time difference between a first time when an upper float is triggered by the water and a second time when a lower float is triggered by the water in turn; the at least one processor 801 calculates a tank flow velocity by using a volume between the upper float and the lower float and the first time difference; the at least one processor 801 obtains a functional equation indicating a relationship between the tank flow velocity and a jet flow velocity; the at least one processor 801 obtains the jet flow velocity by substituting the tank flow velocity into the functional equation; the at least one processor 801 measures a performed water supply duration and calculates an amount of supplied water according to the jet flow velocity, the tank flow velocity, and the performed water supply duration; the at least one processor 801 calculates a continued water supply duration according to the amount of the supplied water and the target amount of the water supply as requested; the at least one processor 801 calculates the target water supply duration according to the performed water supply duration and the continued water supply duration; and the at least one processor 801 controls the jet pump to supply the water according to the target water supply duration.

Tenth Embodiment

Please refer to FIG. 28. FIG. 28 illustrates a hardware configuration for use in a device for controlling toilet water consumption according to one embodiment of the present disclosure. According to the tenth embodiment of the present disclosure, a device for controlling toilet water consumption comprises: at least one processor 801; and a memory 802 communicably coupled to the at least one processor 801, wherein the memory 802 stores instructions executable by the at least one processor to perform the following steps:

A jet pump supplies a first water stream in response to a request for a toilet flush; the first water stream drives a second water stream coming from a tank to generate a flow velocity of the second water stream and the at least one processor 801 uses the flow velocity of the second water stream as a tank flow velocity; after completing a previous toilet flush and switching from a jet pump water supply to a tank water replenishment, the at least one processor 801 obtains a second time difference between a third time when a lower float is triggered by the water and a fourth time when an upper float is triggered by the water in turn, wherein the jet pump has a same water source as the tank does; the at least one processor 801 calculates a jet flow velocity according to a volume between the upper float and the lower float and the second time difference; the at least one processor 801 calculates a target water supply duration regarding a target amount of water supply as requested according to the tank flow velocity and the jet flow velocity; and the at least one processor 801 controls the jet pump to supply the water according to the target water supply duration.

Eleventh Embodiment

Please refer to FIG. 28. FIG. 28 illustrates a hardware configuration for use in a device for controlling toilet water consumption according to one embodiment of the present disclosure. According to the eleventh embodiment of the present disclosure, a device for controlling toilet water consumption comprises: at least one processor 801; and a memory 802 communicably coupled to the at least one processor 801, wherein the memory stores instructions executable by the at least one processor 801 to perform the following steps:

A jet pump supplies a first water stream in response to a request for a toilet flush; the first water stream drives a second water stream coming from a tank to generate a flow velocity of the second water stream and the at least one processor 801 uses the flow velocity of the second water stream as a tank flow velocity; the at least one processor 801 obtains a functional equation indicating a relationship between the tank flow velocity and a jet flow velocity, uses the flow velocity of the second water stream in a previous toilet flush as the tank flow velocity in the previous toilet flush, and substitutes the tank flow velocity in the previous toilet flush into the functional equation to obtain the jet flow velocity; the at least one processor 801 calculates a target water supply duration regarding a target amount of water supply as requested according to the tank flow velocity and the jet flow velocity; and the at least one processor 801 controls the jet pump to supply the water according to the target water supply duration.

Twelfth Embodiment

Please refer to FIG. 28. FIG. 28 illustrates a hardware configuration for use in a device for controlling toilet water consumption according to one embodiment of the present disclosure. According to the twelfth embodiment of the present disclosure, a device for controlling toilet water consumption comprises: at least one processor 801; and a memory 802 communicably coupled to the at least one processor 801, wherein the memory stores instructions executable by the at least one processor to perform the following steps:

A jet pump supplies a first water stream in response to a request for a toilet flush; the first water stream drives a second water stream coming from a tank to generate a flow velocity of the second water stream and using the flow velocity of the second water stream as a tank flow velocity; the at least one processor 801 obtains a functional equation indicating a relationship between the tank flow velocity and the jet flow velocity, uses the flow velocity of the second water stream in a previous toilet flush as the tank flow velocity in the previous toilet flush, and substitutes the tank flow velocity in the previous toilet flush into the functional equation to obtain a first reference value of the jet flow velocity; after completing a previous toilet flush and switching from a jet pump water supply to a tank water replenishment, the at least one processor 801 obtains a second time difference between a third time when a lower float is triggered by the water and a fourth time when an upper float is triggered by the water in turn, and calculates a second reference value of the jet flow velocity according to a volume between the upper float and the lower float and the second time difference, wherein the jet pump has a same water source as the tank does; the at least one processor 801 calculates the jet flow velocity according to the first reference value of the jet flow velocity and/or the second reference value of the jet flow velocity; the at least one processor 801 calculates a target water supply duration regarding a target amount of water supply as requested according to the tank flow velocity and the jet flow velocity; and the at least one processor 801 controls the jet pump to supply the water according to the target water supply duration.

Thirteenth Embodiment

Please refer to FIG. 28. FIG. 28 illustrates a hardware configuration for use in a device for controlling toilet water consumption according to one embodiment of the present disclosure. According to the thirteenth embodiment of the present disclosure, a device for controlling toilet water consumption comprises: at least one processor 801; and a memory 802 communicably coupled to the at least one processor 801, wherein the memory stores instructions executable by the at least one processor to perform the following steps:

A jet pump supplies a first water stream in response to a request for a toilet flush; the first water stream drives a second water stream coming from a tank to generate a flow velocity of the second water stream and using the flow velocity of the second water stream as a tank flow velocity; the at least one processor 801 obtains and uses a flow velocity of the first water stream as a jet flow velocity; the at least one processor 801 uses the flow velocity of the first water stream as the jet flow velocity in the previous toilet flush, uses the flow velocity of the second water stream as the tank flow velocity in the previous toilet flush, and calculates a first water supply duration of a first water consumption as predetermined according to the jet flow velocity in the previous toilet flush and the tank flow velocity in the previous toilet flush; the at least one processor 801 calculates a second water supply duration according to a second water consumption as requested, the jet flow velocity, and the tank flow velocity, wherein the target amount of the water supply as requested comprises the first water consumption and the second water consumption; the at least one processor 801 calculates a target water supply duration according to the first water supply duration and the second water supply duration; and the at least one processor 801 controls the jet pump to supply the water according to the target water supply duration.

Fourteenth Embodiment

Please refer to FIG. 28. FIG. 28 illustrates a hardware configuration for use in a device for controlling toilet water consumption according to one embodiment of the present disclosure. According to the fourteenth embodiment of the present disclosure, a device for controlling toilet water consumption comprises: at least one processor 801; and a memory 802 communicably coupled to the at least one processor 801, wherein the memory 802 stores instructions executable by the at least one processor 801 to perform the following steps:

A jet pump supplies a first water stream in response to a request for a toilet flush; the at least one processor 801 obtains a first time difference between a first time when an upper float is triggered by the water and a second time when a lower float is triggered by the water in turn; the at least one processor 801 uses the volume between the upper float and the lower float minus an amount of water withdrawn by a water suction pump as a flow-velocity-calculation volume when the water suction pump withdraws the water during the first time difference (i.e. when the upper float and the lower float are triggered by the water in turn), or uses the volume between the upper float and the lower float as the flow-velocity-calculation volume when the water suction pump does not withdraw the water during the first time difference; the at least one processor 801 calculates a tank flow velocity according to the flow-velocity-calculation volume and the first time difference; the at least one processor 801 obtains and uses a flow velocity of the first water stream as a jet flow velocity; the at least one processor 801 calculates a target water supply duration regarding a target amount of water supply as requested according to the tank flow velocity and the jet flow velocity; and the at least one processor 801 controls the jet pump to supply the water according to the target water supply duration.

Fifteenth Embodiment

According to the fifteenth embodiment of the present disclosure, a storage medium stores instructions executable by a computer to perform the steps of the aforementioned methods for controlling toilet water consumption.

Figure 37:
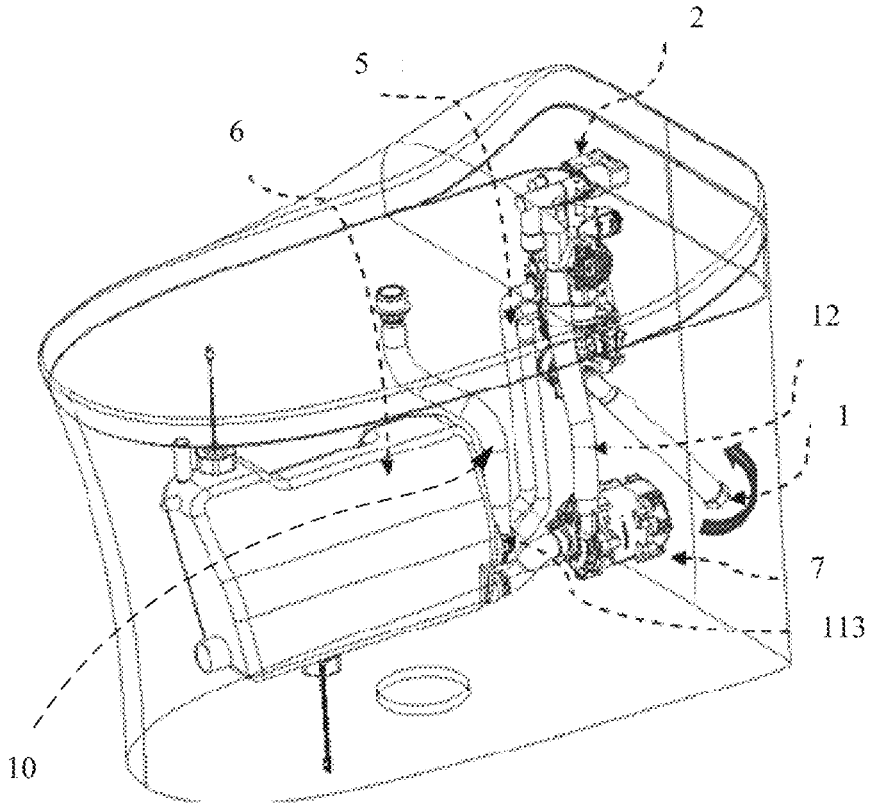
FIG. 37 illustrates a structure of the toilet according to the present disclosure.
Figure 38:
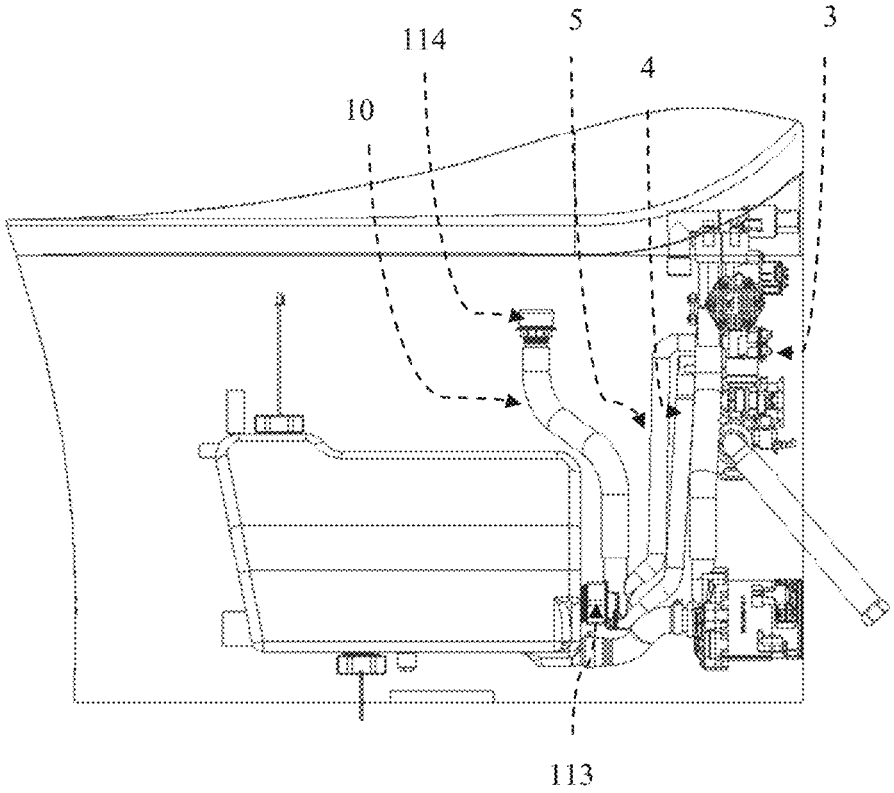
FIG. 38 illustrates a structure of the toilet in a side view according to the of the present disclosure.
Figure 39:
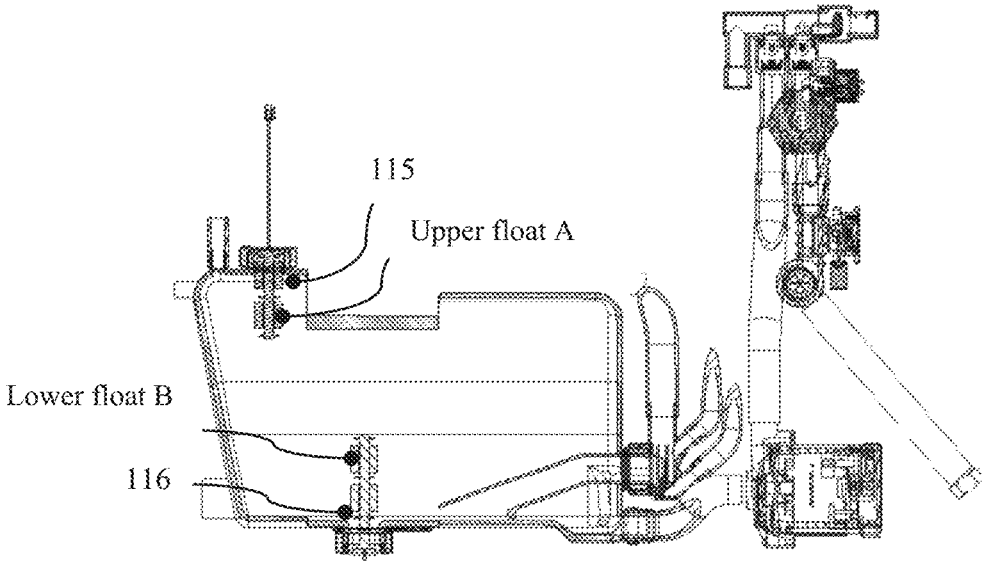
FIG. 39 illustrates the installation of floats according to the of the present disclosure.
Figure 40:
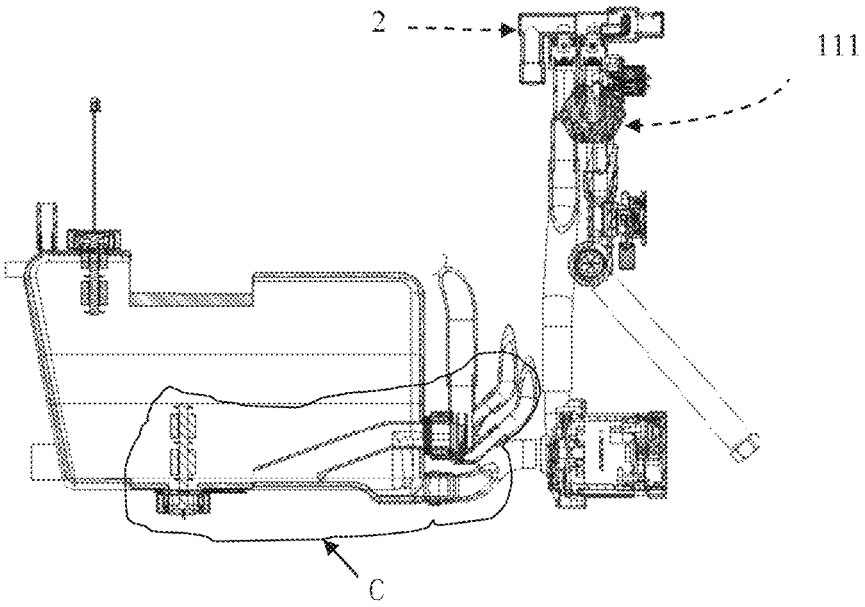
FIG. 40 illustrates a structure of the toilet in a sectioned view according to the of the present disclosure.
Figure 41:
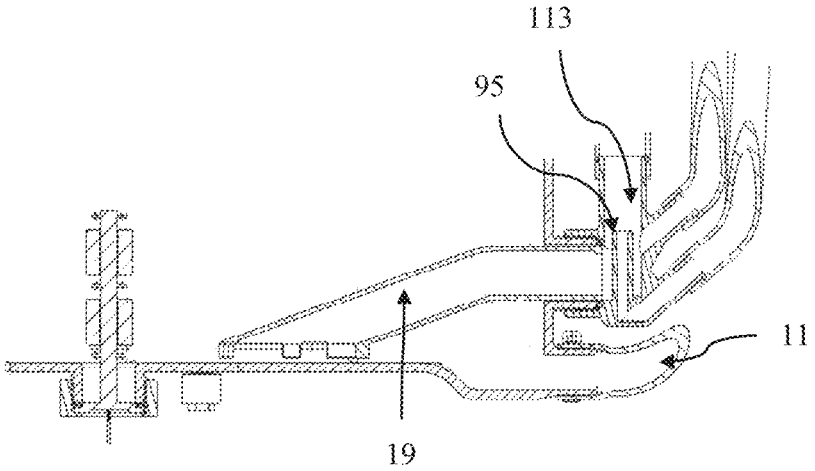
FIG. 41 illustrates a structure of the toilet of FIG. 40 in a partially enlarged view according to the of the present disclosure.
Figure 42:
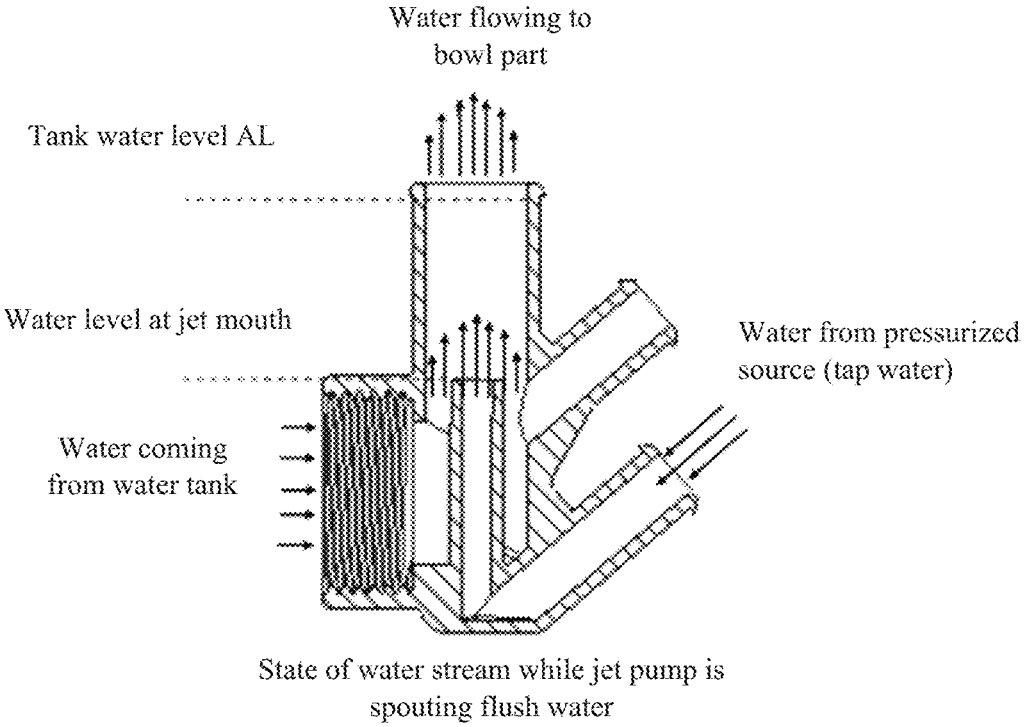
FIG. 42 illustrates the water flow while the jet flush is being performed.
Figure 43:
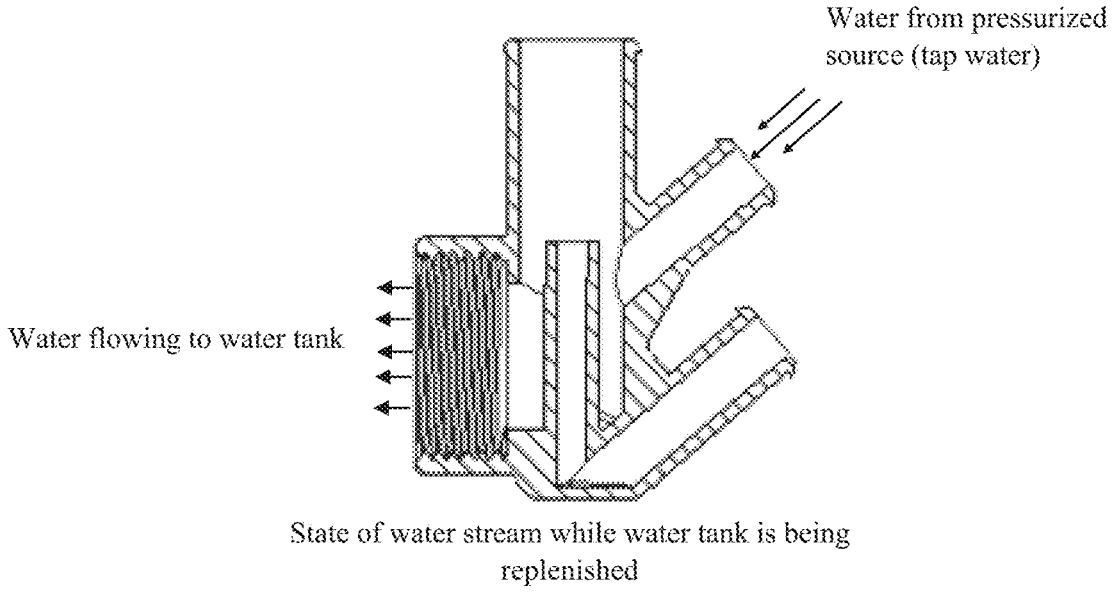
FIG. 43 illustrates the water flow while the tank is being replenished.

FIG. 37 to FIG. 43 illustrate a structure of the toilet according to the of the present disclosure. FIG. 37 illustrates a structure of the toilet according to the present disclosure. FIG. 38 illustrates a structure of the toilet in a side view according to the of the present disclosure. FIG. 39 illustrates the installation of floats according to the of the present disclosure. FIG. 40 illustrates a structure of the toilet in a sectioned view according to the of the present disclosure. FIG. 41 illustrates a structure of the toilet of FIG. 40 in a partially enlarged view according to the of the present disclosure. FIG. 42 illustrates the water flow while the jet flush is being performed. FIG. 43 illustrates the water flow while the tank is being replenished.

The toilet comprises a main water input pipe 1, a jet flow electromagnetic valve 111, a vacuum breaker 2, a current limiter 112, a switching valve 3, a jet pump 113, a water tank 6, a bowl part 100, a water suction pump 7, a pump water output pipe 12, a jet mouth, a jet flow water input 4, a water tank input pipe 5, a jet flow water output pipe 10, a bowl part upper inlet 114, an upper float A, a lower float B, an upper protection float 115, a lower protection float 116, a jet flow pipe 95, and a lower position water suction pipe 19. These elements are connected as illustrated in FIG. 30. The water from an external source enters the main water input pipe 1, the jet flow electromagnetic valve 111, the vacuum breaker 2, the current limiter 112, and the switching valve 3 in turn. The switching valve 3 controls the jet pump 113 to output a first water stream, which drives a second water stream from the water tank 6. The first water stream and the second water stream ultimately enter the bowl part 100. The first water stream has a flow velocity $Q_1$ and the second water stream has a flow velocity $Q_2$. The switching valve 3 may switch to supply the water to the tank's inlet at a flow velocity $Q_0$. The water suction pump 7 withdraws the water from the water tank 6 to the jet mouth at a flow velocity $Q_3$.

While the present disclosure has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

We claim:

1. A water supply assembly of a toilet, the water supply assembly comprising:

a main water input pipe;

a water tank connected to the main water input pipe and configured to receive clean water coming from the main water input pipe, the water tank comprising:

a main water tank portion;

an auxiliary water tank portion;

a water equalizing pipe connected to the main water tank portion and the auxiliary water tank portion;

a water outlet disposed at the main water tank portion; and a water inlet disposed at the main water tank portion, wherein the water tank is connected to the main water input pipe through the water inlet;

a water suction pump connected to the water tank and disposed at the water outlet; and a water output pipe connected to the water suction pump, wherein the water suction pump is configured to pump the clean water in the water tank into the water output pipe, wherein the water tank further comprises an air equalizing pipe connected to an upper part of the main water tank portion and an upper part of the auxiliary water tank portion, wherein the water equalizing pipe is connected to a lower part of the main water tank portion and a lower part of the auxiliary water tank portion, and wherein a diameter of the air equalizing pipe is smaller than a diameter of the water equalizing pipe.

2. The water supply assembly according to claim 1, wherein a top of the auxiliary water tank portion comprises a first air inlet and a top of the main water tank portion comprises a second air inlet.

3. The water supply assembly according to claim 2, wherein when the main water tank portion supplies the water, the second air inlet is blocked.

4. The water supply assembly according to claim 3, wherein the second air inlet comprises an automatic blocking element comprising a blocking pipe and a blocking bead disposed in the blocking pipe, wherein a vacuum effect is triggered by supplying the clean water via the main water tank portion and the triggered vacuum effect moves the blocking bead toward the blocking pipe and blocks the blocking pipe, and wherein the vacuum effect is ceased by stopping supplying the clean water via the main water tank portion and the ceased vacuum effect releases the blocking bead from the blocking pipe and unlocks the blocking pipe.

5. The water supply assembly according to claim 4, wherein the main water tank portion and the auxiliary water tank portion each has an upper part and a lower part smaller than the upper part.

6. A water supply assembly of a toilet, the water supply assembly comprising:

a main water input pipe;

a water tank connected to the main water input pipe and configured to receive clean water coming from the main water input pipe, the water tank comprising:

a main water tank portion;

an auxiliary water tank portion;

a water equalizing pipe connected to the main water tank portion and the auxiliary water tank portion;

a water outlet disposed at the main water tank portion; and a water inlet disposed at the main water tank portion, wherein the water tank is connected to the main water input pipe through the water inlet;

a water suction pump connected to the water tank and disposed at the water outlet; and a water output pipe connected to the water suction pump, wherein the water suction pump is configured to pump the clean water in the water tank into the water output pipe, wherein a top of the auxiliary water tank portion comprises a first air inlet and a top of the main water tank portion comprises a second air inlet, wherein when the main water tank portion supplies the water, the second air inlet is blocked, wherein the second air inlet comprises an automatic blocking element comprising a blocking pipe and a blocking bead disposed in the blocking pipe, wherein a vacuum effect is triggered by supplying the clean water via the main water tank portion and the triggered vacuum effect moves the blocking bead toward the blocking pipe and blocks the blocking pipe, and wherein the vacuum effect is ceased by stopping supplying the clean water via the main water tank portion and the ceased vacuum effect releases the blocking bead from the blocking pipe and unlocks the blocking pipe.

7. The water supply assembly according to claim 6, wherein the main water tank portion and the auxiliary water tank portion each has an upper part and a lower part smaller than the upper part.

* * * * *